US011754946B2

(12) United States Patent
Koguchi et al.

(10) Patent No.: US 11,754,946 B2
(45) Date of Patent: Sep. 12, 2023

(54) IMAGE FORMING APPARATUS

(71) Applicant: CANON KABUSHIKI KAISHA, Tokyo (JP)

(72) Inventors: Kohei Koguchi, Kanagawa (JP); Isao Koishi, Kanagawa (JP); Katsuhiko Oba, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/934,028

(22) Filed: Sep. 21, 2022

(65) Prior Publication Data

US 2023/0019464 A1 Jan. 19, 2023

Related U.S. Application Data

(63) Continuation of application No. 17/220,545, filed on Apr. 1, 2021, now Pat. No. 11,474,452.

(30) Foreign Application Priority Data

Apr. 10, 2020 (JP) ..... 2020-071153

(51) Int. Cl.
*G03G 15/08* (2006.01)

(52) U.S. Cl.
CPC ..... *G03G 15/0886* (2013.01); *G03G 15/0872* (2013.01); *G03G 2215/0692* (2013.01)

(58) Field of Classification Search
CPC ..... G03G 15/0886; G03G 15/0872; G03G 2215/0692
See application file for complete search history.

(56) References Cited

U.S. PATENT DOCUMENTS

2010/0239308 A1* 9/2010 Kikuchi ..... G03G 21/1623 399/119

* cited by examiner

*Primary Examiner* — Victor Verbitsky
(74) *Attorney, Agent, or Firm* — Canon U.S.A., Inc. IP Division

(57) ABSTRACT

An image forming apparatus includes an attachment portion to which to attach a supply container for supplying a developer, a housing including a discharge portion for discharging a sheet in a discharging direction, a discharge tray including a first stack portion for stacking the sheet thereon, in which the first stack portion is configured to be movable between a closed position and an opened position, a top portion fixed to the housing, and a display portion and an operation portion arranged on the top portion. The top portion includes a first region, a first extension portion, and a second extension portion. As viewed along a vertical direction, the first extension portion and the second extension portion extend from the first region in the discharging direction, and at least a part of the first stack portion is located between the first extension portion and the second extension portion.

19 Claims, 41 Drawing Sheets

IMAGE FORMING APPARATUS

CROSS-REFERENCE TO RELATED APPLICATIONS

The present application is a continuation of U.S. patent application Ser. No. 17/220,545, filed on Apr. 1, 2021, which claims priority from Japanese Patent Application No. 2020-071153 filed Apr. 10, 2020, which are hereby incorporated by reference herein in their entireties.

BACKGROUND

Field of the Disclosure

Aspects of the present disclosure generally relate to an image forming apparatus which forms an image on a recording material.

Description of the Related Art

Generally, an electrophotographic type image forming apparatus forms an image by transferring, to a transfer material, a toner image formed on the surface of a photosensitive drum. Then, with regard to a method of supplying a developer, there are known, for example, a process cartridge method and a toner supplying method. The process cartridge method is a method of integrating a photosensitive drum and a developing container into a process cartridge and, if a developer has run out, replacing the process cartridge with a new process cartridge.

There is also, the toner supplying method is a method of supplying toner anew to a developing container. Conventionally, there has been proposed a one-component developing device of the toner supplying method in which a toner supply box capable of supplying toner is connected to a toner conveyance path through which toner is conveyed, as discussed in Japanese Patent Application Laid-Open No. 08-30084. Toner stored in the toner supply box is conveyed to the toner conveyance path by a conveyance screw.

Recently, with regard to image forming apparatuses, various usages such as the above-mentioned process cartridge method and toner supplying method have been being demanded by users.

SUMMARY

Aspects of the present disclosure are generally directed to providing various forms of image forming apparatuses.

According to an aspect of the present disclosure, an image forming apparatus to which a supply container for supplying a developer is detachably attachable includes a storage portion configured to store the developer supplied from the supply container, an attachment portion to which to attach the supply container in such a manner that the developer is allowed to be supplied from the supply container to the storage portion, the attachment portion including an attachment opening into which to insert the supply container, a housing which houses the storage portion and includes a discharge portion for discharging a sheet in a discharging direction, a discharge tray including a first stack portion for stacking thereon the sheet discharged from the discharge portion, in which the first stack portion is configured to be movable between a closed position for covering the attachment portion and an opened position for making the attachment portion exposed outside, a top portion extending in a direction intersecting with a vertical direction and fixed to the housing, the top portion being located above the attachment portion with respect to the vertical direction and including a first region, a first extension portion, and a second extension portion, in which, as viewed along the vertical direction, the first extension portion extends from the first region in the discharging direction, the second extension portion extends from the first region in the discharging direction, and at least a part of the first stack portion is located between the first extension portion and the second extension portion, a display portion arranged at the top portion and configured to display information, and an operation portion arranged at the top portion, wherein, in a width direction perpendicular to the discharging direction and parallel to a horizontal direction, the attachment opening, the operation portion, and the first extension portion are arranged on one end side with respect to a central portion of the first stack portion.

Further features of the present disclosure will become apparent from the following description of exemplary embodiments with reference to the attached drawings.

DESCRIPTION OF THE EMBODIMENTS

Various exemplary embodiments, features, and aspects of the disclosure will be described in detail below with reference to the drawings.

Figure 1:
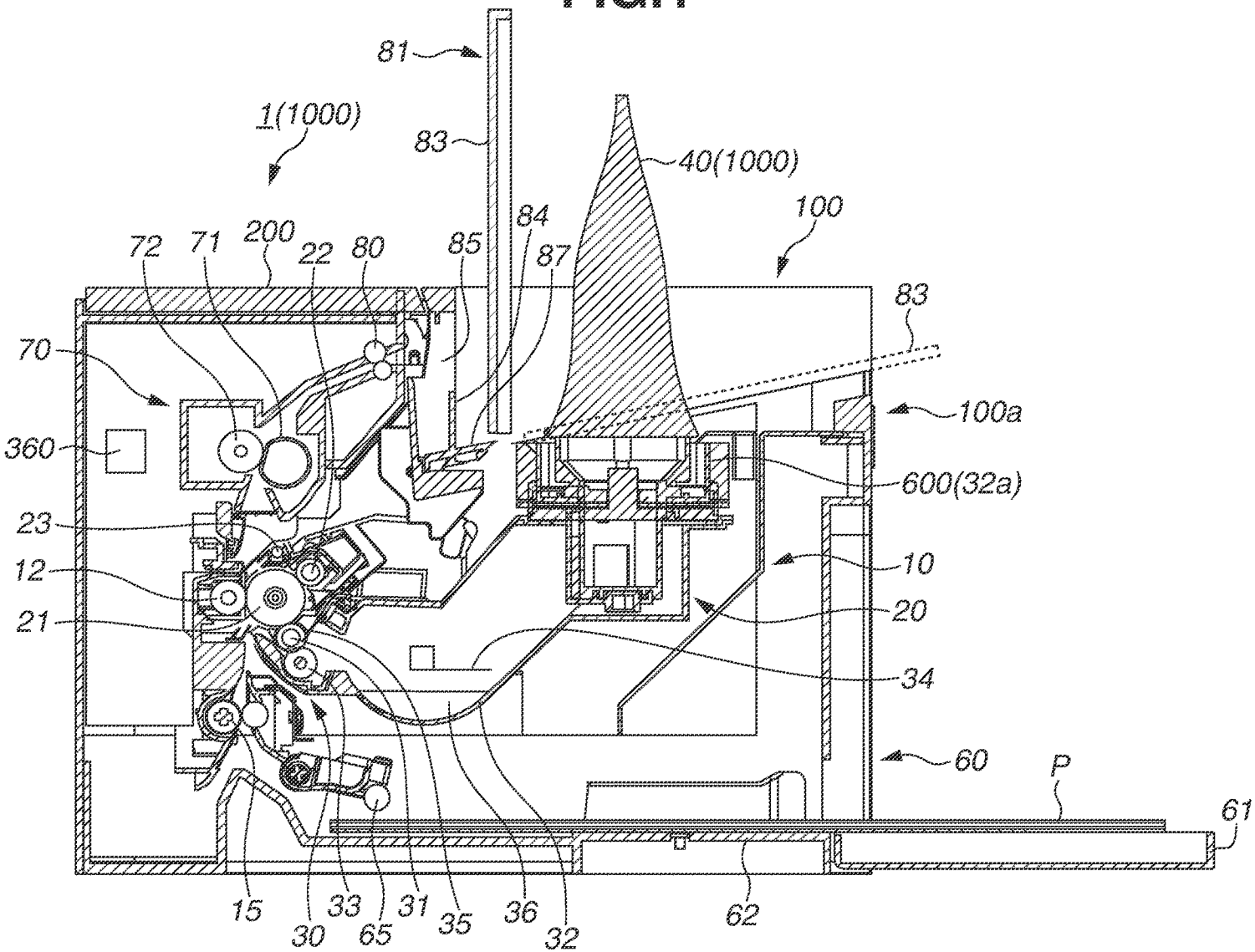
FIG. 1 is a schematic view illustrating a configuration of an image forming apparatus according to a first exemplary embodiment.
Figure 2:
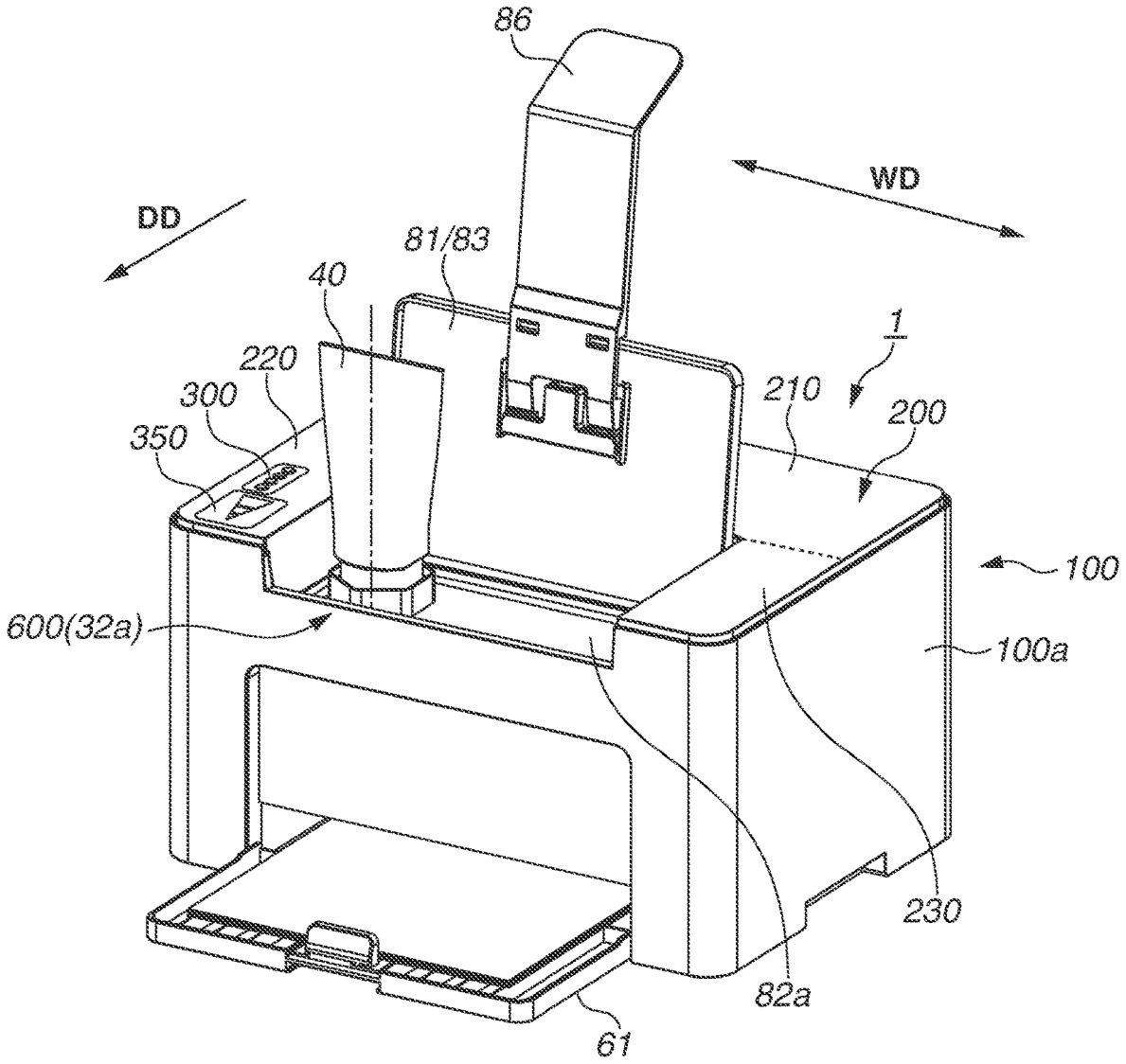
FIG. 2 is a perspective view illustrating the image forming apparatus according to the first exemplary embodiment.

FIG. 1 is a schematic view illustrating a configuration of an image forming apparatus 1 according to a first exemplary embodiment. FIG. 2 is a perspective view of the image forming apparatus according to the first exemplary embodiment. The image forming apparatus 1 is a monochrome printer which forms an image on a recording material based on image information input from an external apparatus. The recording material includes, for example, various sheet materials differing in quality of material, including, for example, paper such as plain paper or heavy paper, a plastic film such as a sheet for an overhead projector, a specially shaped sheet such as an envelope or an index sheet, and a cloth. FIG. 1 illustrates a configuration of the image forming apparatus 1 as viewed along the direction of a rotational axis line of a photosensitive drum 21 described below, and the up-and-down direction of the image forming apparatus 1 is parallel to the vertical direction (direction of gravitational force) and the right-and-left direction thereof is parallel to the horizontal direction (direction perpendicular to the direction of gravitational force). Furthermore, the respective rotational axes of a developing roller 31, a discharge roller pair 80, a registration roller pair 15, and an opening and closing member 83, which are described below, are parallel to the rotational axis line of the photosensitive drum 21.

[Overall Configuration]

As illustrated in FIG. 1 and FIG. 2, the image forming apparatus 1 includes a printer body 100, which serves as an apparatus body, an operation portion 300, which is mounted on an exterior surface of the printer body 100, and a display portion 350, which displays information to the user. The printer body 100 includes an image forming unit 10, which forms a toner image on a recording material (sheet) P, a feeding unit 60, which feeds a recording material P to the image forming unit 10, a fixing unit 70, which fixes the toner image formed by the image forming unit 10 to a recording material, and a discharge roller pair 80. Moreover, the printer body 100 further includes a control unit 360, which controls, for example, an image forming operation, which is performed on a recording material P by the image forming unit 10, and an operation of the display portion 350.

The image forming unit 10 includes a scanner unit (not illustrated), a process cartridge 20 of the electrophotographic system, and a transfer roller 12, which transfers a toner image formed on a photosensitive drum 21 of the process cartridge 20 to a recording material P. The process cartridge 20 includes the photosensitive drum 21, a charging roller 22, which is arranged near the photosensitive drum 21, a pre-exposure device 23, and a development device 30, which includes the developing roller 31.

The photosensitive drum 21 is a photosensitive member shaped in a cylindrical form. The photosensitive drum 21 in the first exemplary embodiment includes a photosensitive layer formed from a negatively charged type organic photosensitive member on a drum-shaped base formed from aluminum. Moreover, the photosensitive drum 21, which serves as an image bearing member, is configured to be rotationally driven at a predetermined process speed in a predetermined direction (clockwise direction in FIG. 1) by a motor.

The charging roller 22 is in contact with the photosensitive drum 21 at a predetermined pressure contact force to form a charging portion. Moreover, when receiving a predetermined charging voltage applied from a charging high-voltage power source, the charging roller 22 electrically charges the surface of the photosensitive drum 21 to a predetermined potential in a homogenous manner. In the first exemplary embodiment, the photosensitive drum 21 is electrically charged to a negative polarity by the charging roller 22. To cause stable electric discharge to occur at the charging portion, the pre-exposure device 23 electrically removes the surface potential of the photosensitive drum 21 before the photosensitive drum 21 enters the charging portion.

The scanner unit (not illustrated), which serves as an exposure unit, performs scanning to expose the surface of the photosensitive drum 21 by irradiating the photosensitive drum 21 with laser light corresponding to image information input from an external apparatus with use of a polygonal mirror. With this exposure, an electrostatic latent image corresponding to the image information is formed on the surface of the photosensitive drum 21. Furthermore, the scanner unit to be employed is not limited to a laser scanner device, but can be a light-emitting diode (LED) exposure device including an LED array having a plurality of LEDs arranged along the longitudinal direction of the photosensitive drum 21.

The development device 30 includes a developing roller 31, which serves as a developer bearing member which bears a developer, a developing container 32, which serves as a frame of the development device 30, and a supply roller 33, which is able to supply a developer to the developing roller 31. The developing roller 31 and the supply roller 33 are supported by the developing container 32 in such a way as to be rotatable. Moreover, the developing roller 31 is located at an opening portion of the developing container 32 in such a way as to face the photosensitive drum 21. The supply roller 33 is in abutting contact with the developing roller 31 in such a way as to be rotatable, and toner, which serves as a developer, stored in the developing container 32 is applied to the surface of the developing roller 31 by the supply roller 33. Furthermore, if a configuration capable of sufficiently supplying toner to the developing roller 31 is employed, the supply roller 33 is not necessarily needed.

The development device 30 in the first exemplary embodiment uses a contact development method as a development method. Specifically, a toner layer borne by the developing roller 31 comes into contact with the photosensitive drum 21 at a developing portion (developing region), at which the photosensitive drum 21 and the developing roller 31 face each other. A developing voltage is applied to the developing roller 31 by a developing high-voltage power source. Under the developing voltage, toner borne by the developing roller 31 transfers from the developing roller 31 to the surface of the photosensitive drum 21 according to the electric potential distribution of the surface of the photosensitive drum 21, so that the electrostatic latent image is developed into a toner image. Furthermore, in the first exemplary embodiment, a reversal development method is employed. Specifically, a toner image is formed by toner adhering to the surface region of the photosensitive drum 21 the electric charge amount of which has decreased due to the surface region of the photosensitive drum 21 being exposed in an exposure process after being electrically charged in a charging process.

Moreover, in the first exemplary embodiment, toner the particle diameter of which is 6 micrometers (μm) and the regular charging polarity of which is negative polarity is used. As toner in the first exemplary embodiment, for example, polymerized toner produced by a polymerization method is employed. Moreover, toner in the first exemplary embodiment does not contain a magnetic component and is what is called a non-magnetic one-component developer, in which toner is borne on the developing roller 31 mainly by intermolecular force or electrostatic force (mirror-image force). However, a one-component developer containing a magnetic component can also be used. Moreover, the one-component developer may contain, in addition to toner particles, additives for adjusting the fluidity or charging performance of toner (for example, wax or silica microparticles). Moreover, a two-component developer made from non-magnetic toner and carrier having magnetic property can be used as a developer. In a case where a developer having magnetic property is used, for example, a cylindrical developing sleeve having a magnet mounted on the inner side thereof is used as a developer bearing member.

The developing container 32 includes a storage portion 36, which stores toner supplied from a toner pack 40 described below, and a stirring member 34, which serves as a stirring unit arranged inside the storage portion 36. When rotating by being driven by a motor (not illustrated), the stirring member 34 stirs toner contained in the developing container 32 and, at the same time, feeds toner to the developing roller 31 and the supply roller 33. Moreover, the stirring member 34 has the role of circulating toner stripped from the developing roller 31 without being used for development inside the developing container 32 and then making toner inside the developing container 32 homogeneous. Furthermore, the stirring member 34 is not limited to a configuration which rotates. For example, a stirring member configured to make a swinging movement can be employed.

Moreover, a development blade 35, which regulates the amount of toner borne by the developing roller 31, is arranged at the opening portion of the developing container 32, at which the developing roller 31 is arranged. Toner supplied to the surface of the developing roller 31 is made into a thin layer in a homogenous manner or electrically charged to a negative polarity due to triboelectric charging by passing through a portion facing the development blade 35 in conjunction with the rotation of the developing roller 31.

The feeding unit 60 includes a front door 61, which is supported by the printer body 100 in such a way as to be able to be opened and closed as illustrated in FIG. 1, a tray portion 62, and a pickup roller 65, which is able to move up and down. The tray portion 62 constitutes the bottom surface of a recording material storage space which emerges in response to the front door 61 being opened. Furthermore, the front door 61 closes the recording material storage space when being closed relative to the printer body 100, and supports a recording material P in conjunction with the tray portion 62 when being opened relative to the printer body 100.

The fixing unit 70 is of the heat fixing type, which performs fixing processing of an image by heating and fusing toner on a recording material P. The fixing unit 70 includes a fixing film 71, a fixing heater, such as a ceramic heater, which heats the fixing film 71, a thermistor which measures the temperature of the fixing heater, and a pressure roller 72, which is in pressure contact with the fixing film 71.

Next, an image forming operation of the image forming apparatus 1 is described. When an instruction for image formation is input to the image forming apparatus 1, the image forming apparatus 1 starts an image forming process based on image information input from an external computer connected to the image forming apparatus 1. The scanner unit (not illustrated) radiates laser light toward the photosensitive drum 21 based on the input image information. At this time, the photosensitive drum 21 is electrically charged by the charging roller 22 in advance, and an electrostatic latent image is formed on the photosensitive drum 21 in response to the photosensitive drum 21 being irradiated with laser light. Then, the electrostatic latent image is developed by the developing roller 31, so that a toner image is formed on the photosensitive drum 21.

In parallel with the above-described image forming process, the pickup roller 65 of the feeding unit 60 feeds a recording material P, which has been supported by the front door 61 and the tray portion 62. The recording material P is fed to the registration roller pair 15 by the pickup roller 65 and then collides with a nip portion of the registration roller pair 15, so that skew of the recording material P is corrected. Then, the registration roller pair 15 is driven in conformity with transfer timing of the toner image and thus conveys the recording material P toward a transfer nip, which is formed by the transfer roller 12 and the photosensitive drum 21.

When a transfer voltage is applied from a transfer high-voltage power source to the transfer roller 12, which serves as a transfer unit, the toner image borne on the photosensitive drum 21 is transferred to the recording material P, which is being conveyed by the registration roller pair 15. The recording material P with the toner image transferred thereto is conveyed to the fixing unit 70, and, when the recording material P passes through a nip portion between the fixing film 71 and the pressure roller 72 of the fixing unit 70, the toner image is heated and pressed. With this process, toner particles are fused and are then firmly fixed, so that the toner image is fixed to the recording material P. The recording material P, which has passed through the fixing unit 70, is discharged in a discharging direction DD by the discharge roller pair 80, which serves as a discharge unit. Then, the recording material P is discharged to the outside of the image forming apparatus 1 (outside region) after passing through a discharge port 85 for discharging a recording material P to an outside region, and is then stacked on a discharge tray 81, which is arranged at an upper portion of the printer body 100.

The discharge tray 81 is inclined in an ascending manner toward the downstream side in the discharging direction DD of a recording material P, and a recording material P discharged to the discharge tray 81 slips over the discharge tray 81, so that the rear end of the recording material P is aligned by a regulation surface 84. The discharge port 85 is an opening formed in the regulation surface 84 and has a width through which a recording material with the maximum width size which the image forming apparatus 1 is able to convey is able to pass in a width direction WD perpendicular to the discharging direction DD. Furthermore, in the following description, front and back directions, right and left directions, and up and down directions are defined based on a state in which viewing faces the front of the operation portion 300.

The discharge tray 81 is configured to allow an extension tray 86 to be attached thereto, and a recording material P discharged from the discharge port 85 is able to be supported by the discharge tray 81 and the extension tray 86. Furthermore, the extension tray 86 can be configured to be movably supported by the discharge tray 81 and to be movable between a usable position where the extension tray 86 is able to support a recording material P and a concealed position where the extension tray 86 is located when not being in use. Moreover, the extension tray 86 can be configured to be attachable to and detachable from the discharge tray 81.

In the above-described way, the recording material P discharged from the discharge port 85 to the outside of a housing 100*a* is stacked on the discharge tray 81.

The housing 100*a* of the printer body 100 contains the developing container 32, which includes the storage portion 36, and has the discharge port 85. In the first exemplary embodiment, the housing 100*a* contains, for example, the photosensitive drum 21, the development device 30, the fixing unit 70, and the registration roller pair 15. Moreover, a top portion (top surface portion, top surface) 200 is fixed to an upper portion of the housing 100*a* in the vertical direction, and the discharge tray 81 is arranged at the top portion 200. The top portion 200 is fixed in such a way as not to move relative to the housing 100*a*.

The image forming apparatus 1 includes a toner receiving portion (attachment portion) 600, which has a supplying port (attachment opening) 32*a*. As described below, in the first exemplary embodiment, the toner receiving portion 600 is provided at the developing container 32. After a part of the toner pack 40 is inserted into the supplying port 32*a* of the toner receiving portion 600 and a predetermined operation is performed, supplying of toner from the toner pack 40 to the storage portion 36 is allowed to be performed.

As illustrated in FIG. 1 and FIG. 2, the discharge tray 81 includes the opening and closing member 83, which serves as a cover portion that is openable and closable. The opening and closing member 83 is configured to be movable relative to the housing 100*a* and the top portion 200. Specifically, the opening and closing member 83 is configured to be movable between a closed position for covering the supplying port 32*a* and an opened position for making the supplying port 32*a* exposed on the outside of the housing 100*a*.

In FIG. 1, an opening and closing member 83 drawn with a solid line represents the opening and closing member 83 being present in the opened position, and an opening and closing member 83 drawn with a dashed line represents the opening and closing member 83 being present in the closed position. The opening and closing member 83 being present in the closed position functions as a first stack portion for stacking thereon a recording material P discharged from the discharge port 85.

Moreover, in the first exemplary embodiment, the discharge tray 81 includes a second stack portion 87 for stacking thereon a recording material P discharged from the discharge port 85 in conjunction with the opening and closing member 83. The second stack portion 87 is configured not to relatively move with respect to the housing 100*a* or the top portion 200. However, the second stack portion 87 can be omitted and the whole portion of the discharge tray 81 for stacking a recording material P thereon can be formed with the opening and closing member 83.

An upper wall 82*a* is formed below the discharge tray 81, and, when the opening and closing member 83 is present in the closed position, the upper wall 82*a* is covered by the opening and closing member 83. The upper wall 82*a* has an opening formed therein, via which the toner receiving portion 600 is exposed on the outside of the housing 100*a*.

When the opening and closing member 83 is present in the closed position, to prevent the toner pack 40 from being mounted to the toner receiving portion 600, the supplying port 32*a* of the toner receiving portion 600 and the upper wall 82*a* are covered by the opening and closing member 83. When the opening and closing member 83 is present in the opened position, to allow the toner pack 40 to be mounted to the toner receiving portion 600, the supplying port 32*a* of the toner receiving portion 600 and the upper wall 82*a* are exposed outside.

As illustrated in FIG. 1, when the toner pack 40 has been attached to the supplying port 32*a* of the toner receiving portion 600, a part of the toner pack 40 projects toward the outside of the housing 100*a*, thus restricting moving the opening and closing member 83 to the closed position. The image forming apparatus 1 when being in a state in which the toner pack 40 has been attached is restricted from performing an image forming operation. To enable an image forming operation to be performed by the image forming apparatus 1, it is necessary to detach the toner pack 40 and move the opening and closing member 83 to the closed position.

In the first exemplary embodiment, with respect to the width direction WD, which is parallel to the horizontal direction, the opening and closing member 83 and the upper wall 82*a* are formed over the entire width of the discharge tray 81. Thus, in the width direction WD, the width of the discharge tray 81 (the width of a portion for supporting a recording material P) is equal to the width of the opening and closing member 83.

The upper wall 82*a* is arranged in such a manner that the supplying port 32*a* for supplying of toner formed at the upper portion of the developing container 32 is exposed outside, and, when the opening and closing member 83 is opened, the user is able to access the supplying port 32*a*. Furthermore, in the first exemplary embodiment, a method in which the user supplies toner from the toner pack 40, which is filled with toner for supplying, to the development device 30 while keeping a state in which the development device 30 is mounted in the image forming apparatus 1 (a direct supplying method) is employed.

Therefore, since such an operation as to, in a case where the remaining amount of toner of a process cartridge 20 has become small, take out the process cartridge 20 from the printer body 100 and replace the process cartridge 20 with a new process cartridge becomes unnecessary, it is possible to improve usability. Moreover, it is possible to supply toner to the developing container 32 at a cost lower than in the case of replacing the entire process cartridge 20. Furthermore, the direct supplying method does not need to replace, for example, various rollers and gears and is, therefore, able to contribute to cost reduction even as compared with the case of replacing only the development device 30 of the process cartridge 20. Furthermore, the image forming apparatus 1 and the toner pack 40 constitute an image forming system 1000. Furthermore, the process cartridge 20 can be configured to be able to be detached from the printer body 100.

[Collection of Transfer-Residual Toner]

In the first exemplary embodiment, a cleaner-less configuration which collects transfer-residual toner, which has remained as a residue on the photosensitive drum 21 without being transferred to a recording material P, into the development device 30 and reuses the collected toner is employed. Transfer-residual toner is removed in the following process. Transfer-residual toner additionally contains, in a mixed manner, toner which is charged to a positive polarity and toner which is charged to a negative polarity but does not have a sufficient amount of electric charge. Removing electricity of the photosensitive drum 21 subjected to transfer with use of the pre-exposure device 23 and then causing uniform electric discharge to occur on the photosensitive drum 21 with use of the charging roller 22 causes transfer-residual toner to be electrically charged to a negative polarity again. The transfer-residual toner electrically charged to a negative polarity again in the charging portion arrives at the developing portion along with the rotation of the photosensitive drum 21. Then, the surface region of the photosensitive drum 21 having passed through the charging portion while keeping a state in which transfer-residual toner has adhered to the surface of the photosensitive drum 21 is exposed by the scanner unit, so that an electrostatic latent image is written to the surface of the photosensitive drum 21.

Here, the behavior of transfer-residual toner is described separately with regard to an exposed portion and a non-exposed portion of the photosensitive drum 21. Transfer-residual toner adhering to the non-exposed portion of the photosensitive drum 21 transfers to the developing roller 31 due to a potential difference between the electric potential of the non-exposed portion of the photosensitive drum 21 (dark portion potential) and the developing voltage in the developing portion, and is then collected into the developing container 32. This is because, assuming that the regular charging polarity of toner is a negative polarity, the developing voltage to be applied to the developing roller 31 is of a relatively positive polarity with respect the electric potential of the non-exposed portion. Furthermore, toner collected into the developing container 32 is stirred and scattered by the stirring member 34 together with toner stored in the developing container 32, and is then borne by the developing roller 31 to be used for the developing process again.

On the other hand, transfer-residual toner adhering to the exposed portion remains on the surface of the photosensitive drum 21 without transferring from the photosensitive drum 21 to the developing roller 31 in the developing portion. This is because, assuming that the regular charging polarity of toner is a negative polarity, the developing voltage to be applied to the developing roller 31 has an electric potential of more negative polarity than the electric potential of the exposed portion (bright portion potential). Transfer-residual toner having remained on the surface of the photosensitive drum 21 is borne by the photosensitive drum 21 together with toner which transfers from the developing roller 31 to the exposed portion, is moved to the transfer portion, and is then transferred to a recording material P at the transfer portion.

In this way, while, in the first exemplary embodiment, the cleaner-less configuration, which collects transfer-residual toner into the development device 30 and reuses the collected toner, is employed, a known conventional configuration which collects transfer-residual toner with use of a cleaning blade which is in abutting contact with the photosensitive drum 21 can be employed. In that case, transfer-residual toner collected by the cleaning blade is collected into a collection container which is arranged separately from the development device 30. However, with the cleaner-less configuration employed, the arrangement space of a collection container for collecting, for example, transfer-residual toner becomes unnecessary, so that it becomes possible to further reduce the size of the image forming apparatus 1, and, moreover, since transfer-residual toner is re-used, it is possible to make a reduction in printing cost.

[Configuration of Toner Pack]

Figure 3A:
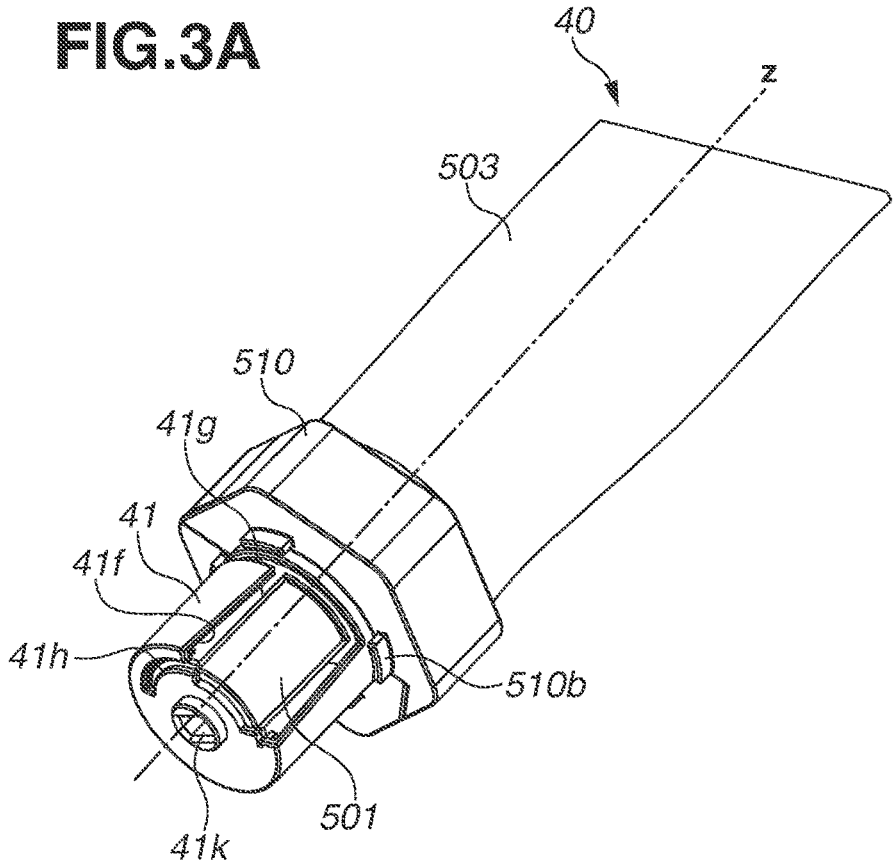
FIG. 3A is a perspective view illustrating a toner pack.
Figure 3B:
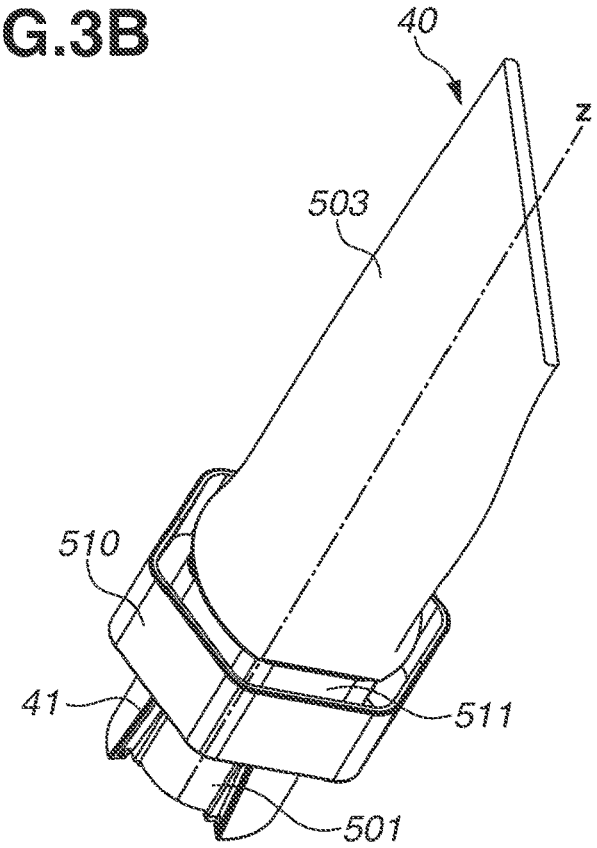
FIG. 3B is a perspective view illustrating the toner pack.
Figure 4:
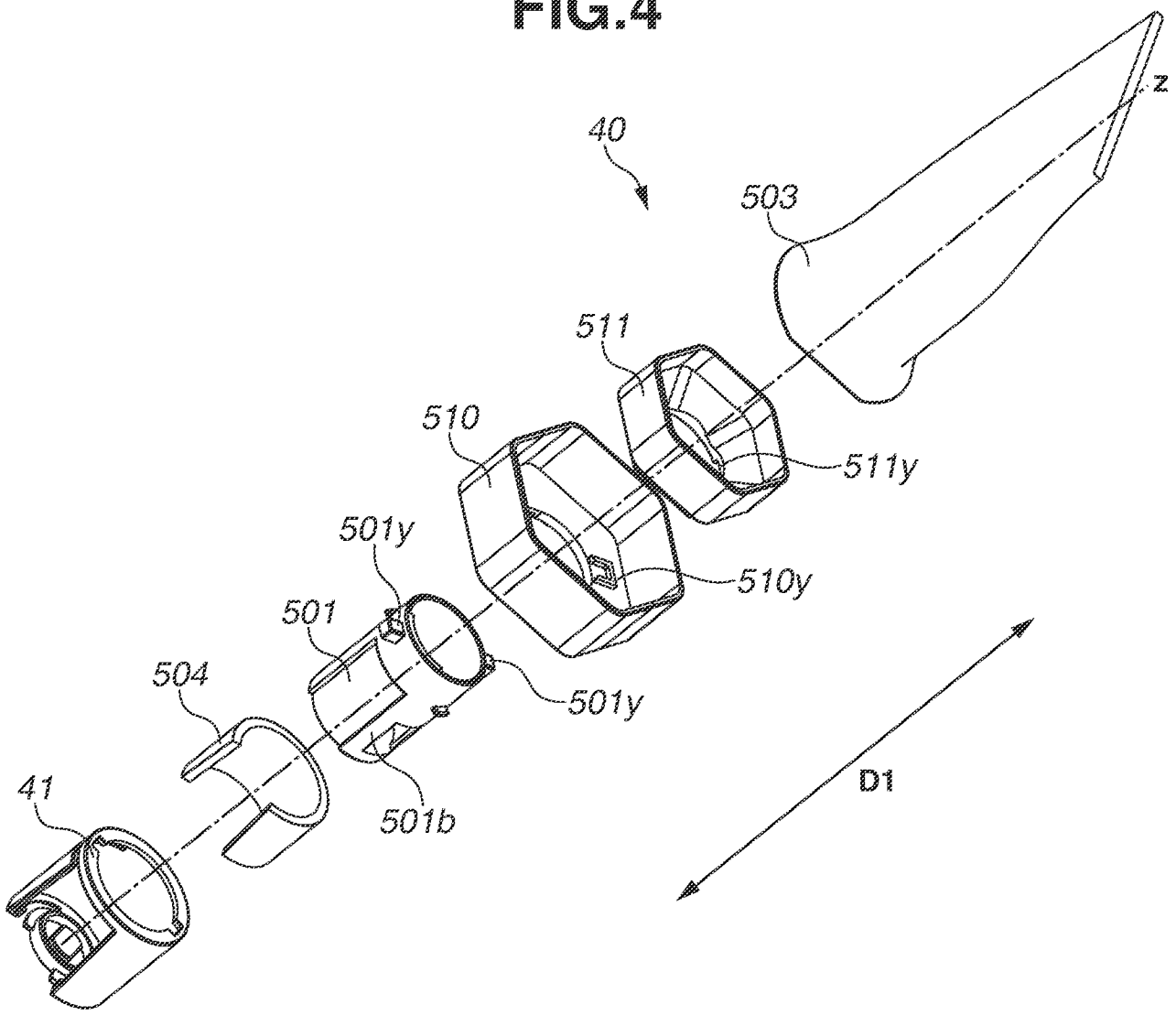
FIG. 4 is an exploded perspective view illustrating the toner pack.
Figure 5:
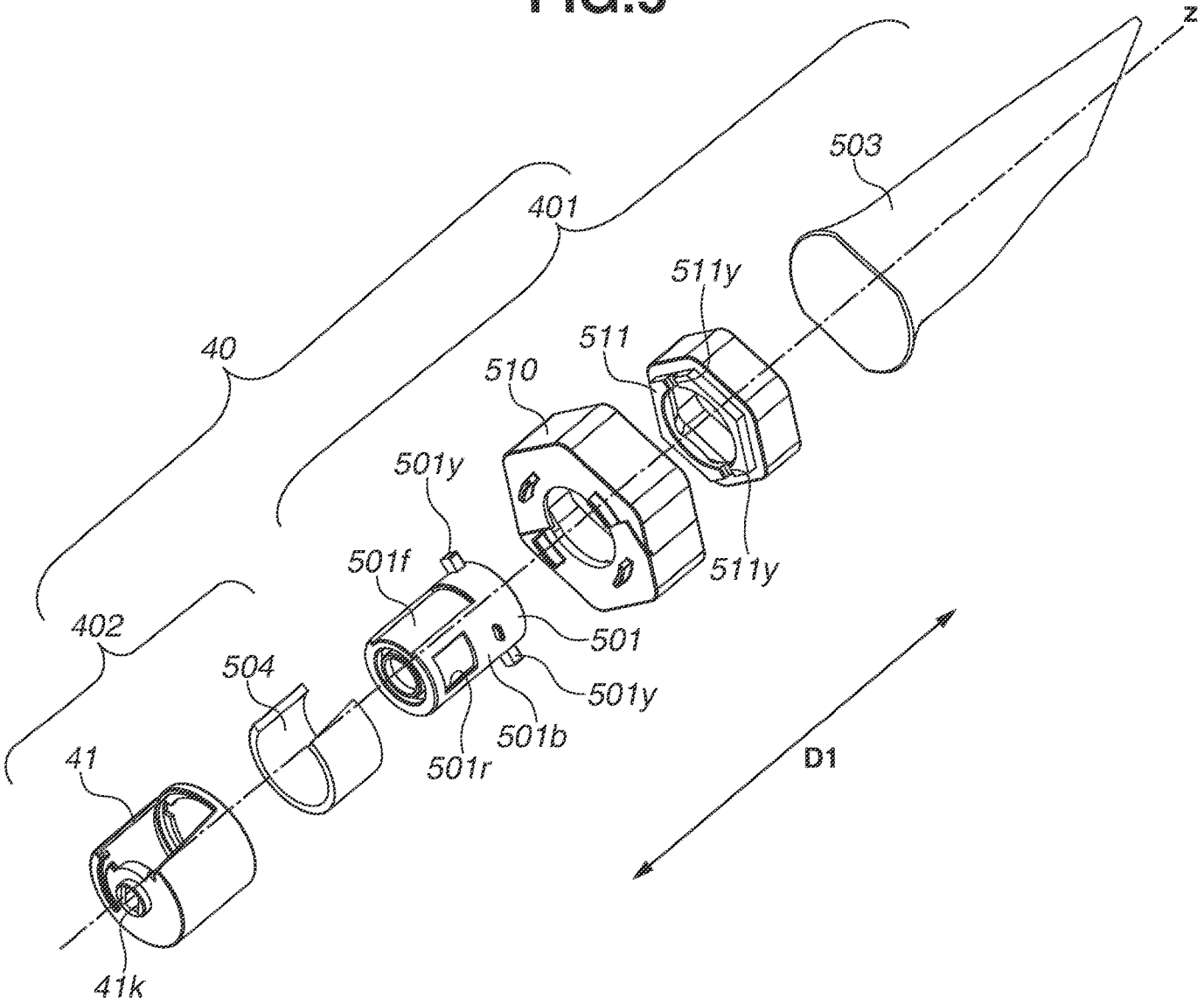
FIG. 5 is an exploded perspective view illustrating the toner pack.
Figure 6:
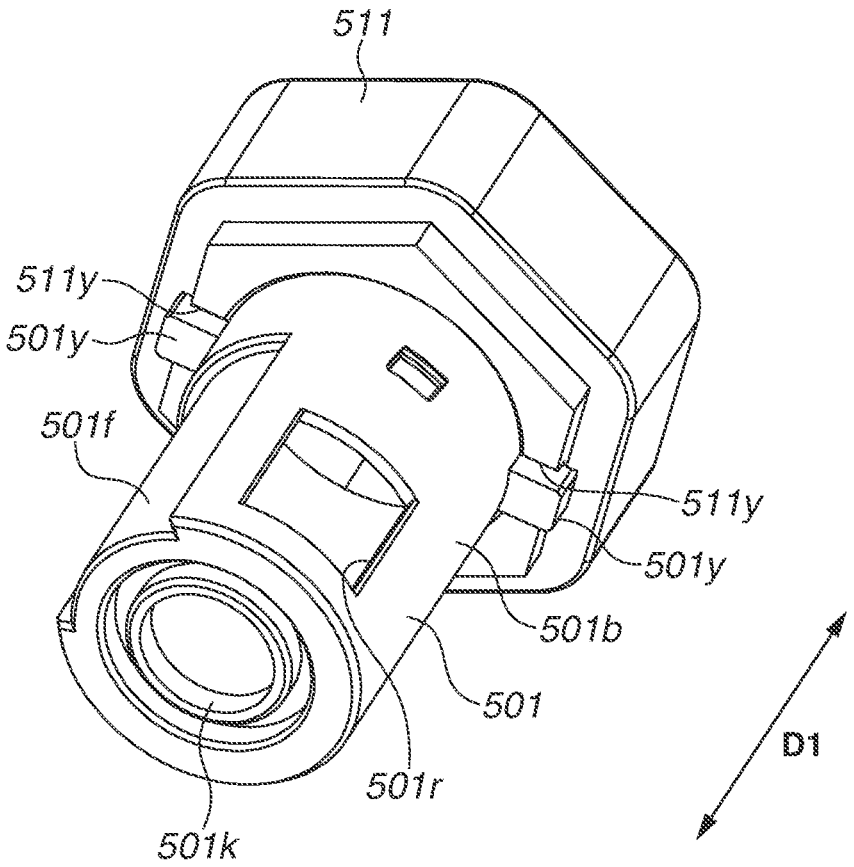
FIG. 6 is a perspective view illustrating an inner ring member and a supplying base.
Figure 7:
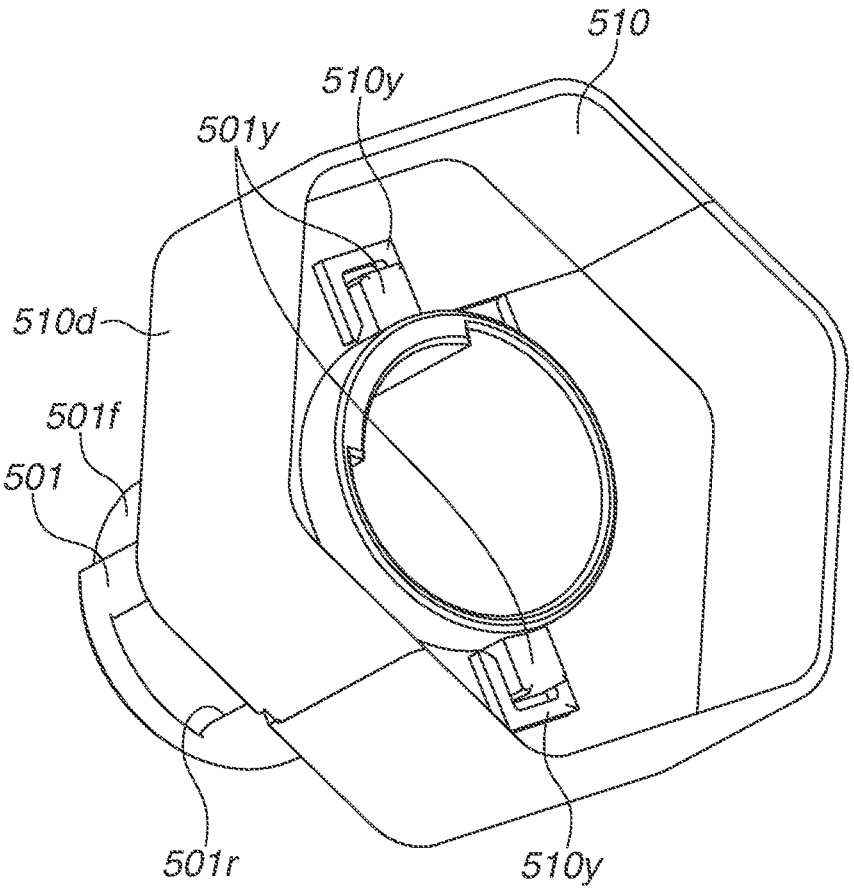
FIG. 7 is a perspective view illustrating an outer ring member and the supplying base.

FIGS. 3A and 3B are perspective views illustrating the toner pack 40. FIG. 4 and FIG. 5 are exploded perspective views illustrating the toner pack 40. The toner pack 40 includes a supplying base 501, a pouch 503, an outer ring member 510, an inner ring member 511, and a shutter member 41. FIG. 6 is a perspective view illustrating the inner ring member 511 and the supplying base 501. FIG. 7 is a perspective view illustrating the outer ring member 510 and the supplying base 501.

The supplying base 501, which serves as a container base portion, includes an outer circumference portion 501*b*, which is a side surface extending along an axial direction D1 parallel to a rotational axis line z, and a toner discharge port 501*r*, which is formed in the outer circumference portion 501*b*. Moreover, the supplying base 501 includes a recessed portion 501*f*, which is recessed toward the radially inner side with respect to the outer circumference portion 501*b*, and projecting portions 501*y* and 501*y*, which project toward the radially outer side from the outer circumference portion 501*b*. The toner discharge port 501*r* is a through-hole leading to the pouch 503. The projecting portions 501*y* and 501*y* are arranged to differ from each other in phase by 180 degrees.

As illustrated in FIG. 4 to FIG. 7, the outer ring member 510 is a resin member with an outer circumferential surface thereof formed in an approximately hexagonal shape, and engagement portions 510*y* and 510*y*, with which the projecting portions 501*y* and 501*y* of the supplying base 501 are engageable, are formed in the outer ring member 510. The outer ring member 510 is configured to cover the inner ring member 511, and forms the outermost shape of the toner pack 40 in such a way as to function as a grip used to grasp the toner pack 40. Accordingly, the outer ring member 510 is configured to be operated at a position more away from the rotational axis line z in the radial direction, and is, therefore, able to reduce a force required for the user to operate the outer ring member 510, thus improving usability.

The inner ring member 511, which serves as a supporting member, is a resin member with an outer circumferential surface thereof formed in an approximately hexagonal shape, as with the outer ring member 510, and is coupled to an opening portion 503*a* (see FIG. 10A) of the pouch 503. Thus, the opening portion 503*a* of the pouch 503 is supported in such a manner that the opening portion 503*a* is maintained by the inner ring member 511 in a state of being opened. Then, the inner ring member 511 is fixed to the supplying base 501 in such a manner that the opening portion 503*a* and the toner discharge port 501*r* communicate with each other, as described below. Coupling between the inner ring member 511 and the pouch 503 can be made by any method, which includes, for example, a method of using any type of adhesive such as hot-melt adhesive and a method of performing thermal adhesion of the pouch 503 to be coupled to the inner ring member 511. Furthermore, it is favorable that the outer circumferential surface of the outer ring member 510 has a shape unlikely to cause slipping when the user grasps and then rotates the outer ring member 510, such as a polygonal shape.

Moreover, recessed portions 511*y* and 511*y*, with which the projecting portions 501*y* and 501*y* are engageable, are formed in the inner ring member 511. Each of the recessed portions 511*y* and 511*y* has a groove shape through which each of the projecting portions 501*y* and 501*y* is able to pass, and each of the engagement portions 510*y* and 510*y* has such a rib shape as to surround each of the projecting portions 501*y* and 501*y*.

As illustrated in FIG. 6, the inner ring member 511 is fitted to the supplying base 501 in such a manner that the projecting portion 501*y* and the recessed portion 511*y* are engaged with each other. Then, as illustrated in FIG. 7, the outer ring member 510 is fitted to the supplying base 501 in such a manner that the projecting portion 501*y* and the engagement portion 510*y* are engaged with each other. Accordingly, the outer ring member 510 and the inner ring member 511 are supported by the supplying base 501 in such a way as to be prevented from rotating relative to the supplying base 501.

Figure 8A:
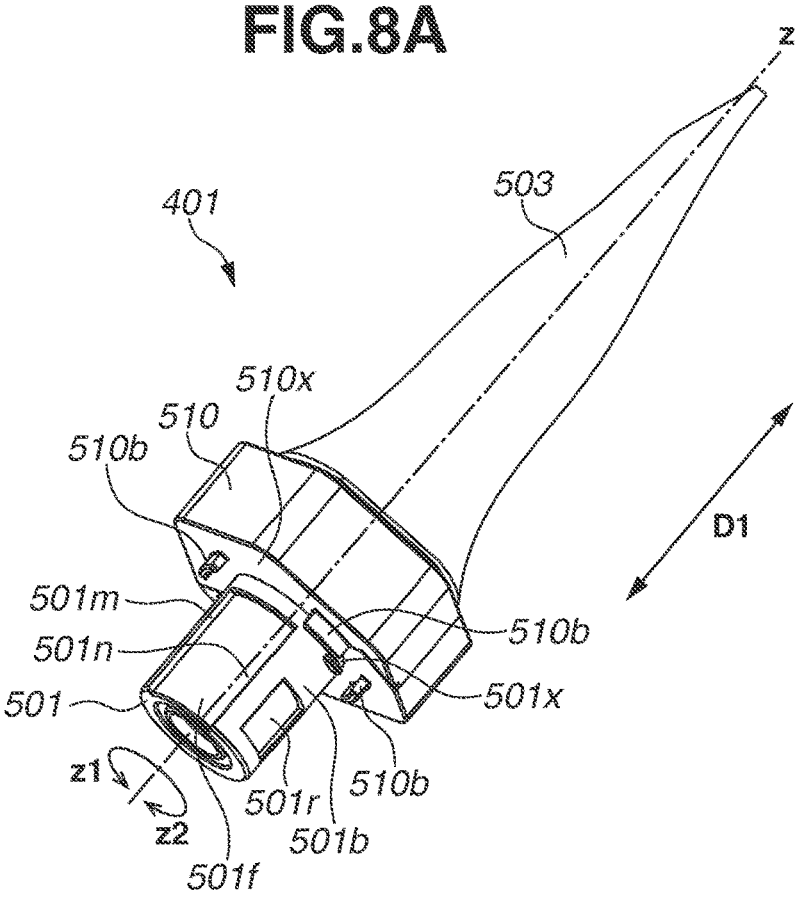
FIG. 8A is a perspective view illustrating a rotary container unit of the toner pack.
Figure 8B:
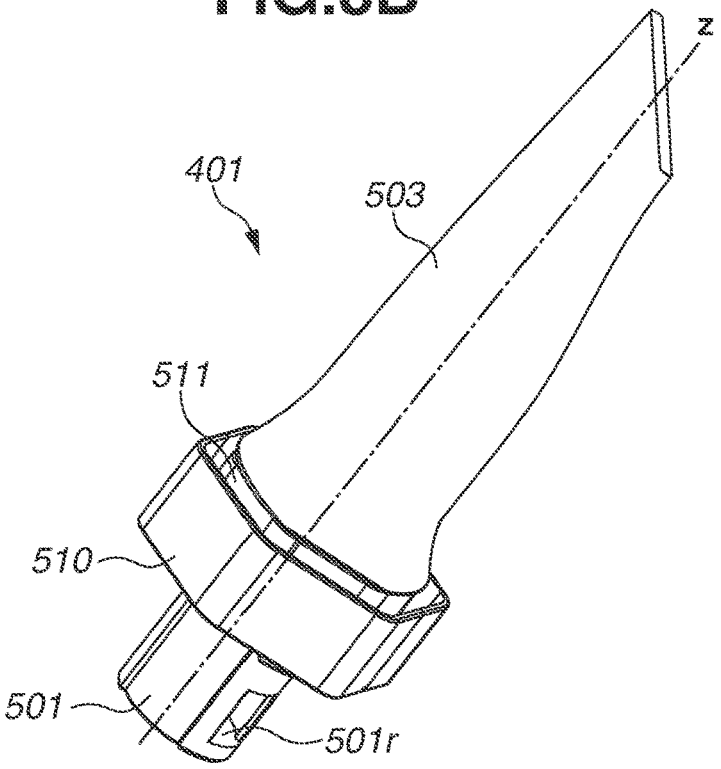
FIG. 8B is a perspective view illustrating the rotary container unit.

Additionally, the projecting portion 501*y* is coupled to the recessed portion 511*y* and the engagement portion 510*y* in the axial direction D1 of the rotational axis line z and in the radial direction perpendicular to the axial direction D1. For example, the projecting portion 501*y* can be press-fitted into the recessed portion 511*y* and the engagement portion 510*y*, and can be coupled to the recessed portion 511*y* and the engagement portion 510*y* by using thermal adhesion or adhesive. Thus, the supplying base 501, the outer ring member 510, the inner ring member 511, and the pouch 503 are integrally coupled to each other as illustrated in FIGS. 8A and 8B. Furthermore, the outer ring member 510 is a cylindrical member having an outer circumferential surface 510*d* at a position more away from the rotational axis line z than the supplying base 501 in the radial direction perpendicular to the axial direction D1. Moreover, the inner ring member 511 is fixed to the supplying base 501 at the inner side of the outer ring member 510.

Hereinafter, the supplying base 501, the outer ring member 510, the inner ring member 511, and the pouch 503, which have been integrally coupled to each other, are referred to as a "rotary container unit 401", and the shutter member 41 and a seal member 504, which have been integrally coupled to each other as described below, are referred to as a "container shutter unit 402". Thus, as illustrated in FIG. 5, the toner pack 40 includes the container shutter unit 402 and the rotary container unit 401, which is able to relatively rotate with respect to the container shutter unit 402. As illustrated in FIG. 8A, the rotary container unit 401 is provided in such a way as to be able to rotate in the direction of arrow z1 and the direction of arrow z2 opposite to the direction of arrow z1 around the rotational axis line z with respect to the container shutter unit 402.

Figure 9A:
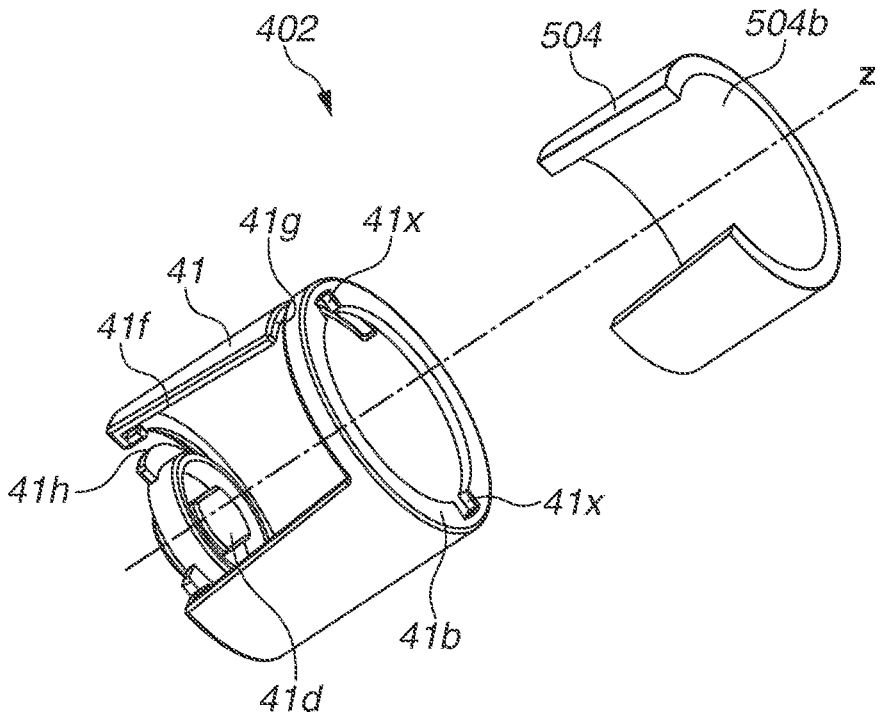
FIG. 9A is an exploded perspective view illustrating a shutter member and a seal member.
Figure 9B:
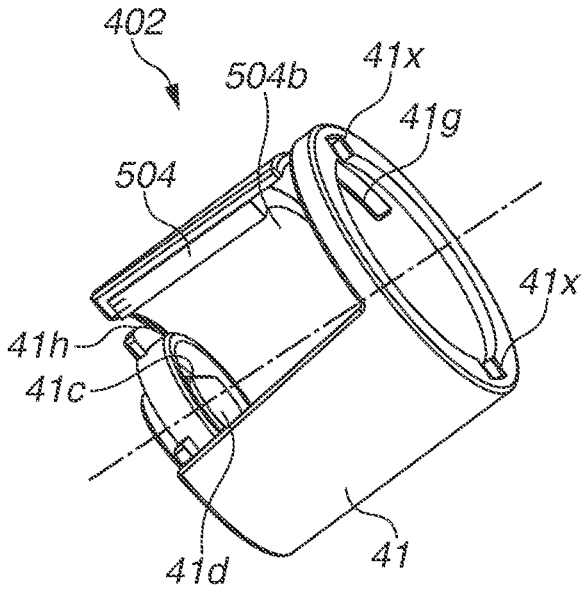
FIG. 9B is a perspective view illustrating the shutter member and the seal member.

As illustrated in FIGS. 9A and 9B, the shutter member 41, which serves as a container shutter, is configured with an approximately cylindrically-shaped resin member, and a cutout portion 41*f* and slot portions 41*g* and 41*h* are formed in the shutter member 41. The cutout portion 41*f* and the slot portion 41*g* are formed in the outer circumference portion of the shutter member 41, and the slot portion 41*h* is formed in the bottom surface portion of the shutter member 41. The cutout portion 41*f* is approximately rectangle-shaped, and the slot portion 41*g* is formed in such a way as to extend in a circumferential direction in a partial range (about 90 degrees) along the circumferential direction of the shutter member 41. Moreover, the slot portion 41*h* is formed in such a way as to extend in the circumferential direction in a partial range (about 90 degrees) along the circumferential direction of the shutter member 41 in the bottom surface portion.

The seal member 504 is configured with a material such as urethane foam or non-woven fabric which is elastically deformable, and is fixed to the inside surface of the shutter member 41 by, for example, double-sided adhesive tape. More specifically, the seal member 504 is arranged at a position different from that of the cutout portion 41*f* of the shutter member 41. Thus, the seal member 504 and the shutter member 41 are integrally coupled to each other to constitute the container shutter unit 402. This enables the container shutter unit 402 to prevent or reduce any leakage of toner at the interface between the seal member 504 and the shutter member 41.

As illustrated in FIGS. 8A and 8B to FIGS. 10A and 10B, at the time of fitting the rotary container unit 401 to the container shutter unit 402, position adjustment is performed between a rib 501*x* projecting from the outer circumference portion 501*b* of the supplying base 501 and a recessed portion 41*x* formed in the shutter member 41. Then, a state in which the rotary container unit 401 has been fitted to the container shutter unit 402 with the rib 501*x* passing through the recessed portion 41*x* is illustrated FIG. 10A. At this time, a cylindrical portion 41*c* of the shutter member 41 is inserted into a groove-shaped inner diameter portion 501*e* formed in the end portion of the supplying base 501. The inner diameter portion 501*e* and the cylindrical portion 41*c* are a cylindrical groove and a cylindrical projection portion, respectively, which are concentric about the rotational axis line z. Therefore, the cylindrical portion 41*c* (an annular rib) being inserted into the inner diameter portion 501*e* (an annular groove) causes the supplying base 501 to be guided to be rotatable around the rotational axis line z with respect to the shutter member 41.

Additionally, a hole portion 501*k* (see FIG. 6), which is arranged on the inner side in the radial direction of the inner diameter portion 501*e*, is provided in the supplying base 501. Then, a mounting portion 41*d* (see FIG. 9A), which is inserted into the hole portion 501*k*, is provided in the shutter member 41. An engaged portion 41*k*, which is opened on the front end side of the toner pack 40, is formed in the mounting portion 41*d*, and the engaged portion 41*k* defines a beveled hole. Therefore, the mounting portion 41*d* has a beveled projecting shape in conformity with the shape of the engaged portion 41*k*. The outermost diameter of the mounting portion 41*d* is set smaller than the inner diameter of the hole portion 501*k*, and the mounting portion 41*d* is configured to be freely rotatable inside the hole portion 501*k*.

Moreover, a plurality of (in the first exemplary embodiment, four) ribs 510*b* extending in the axial direction D1 is formed on an end surface 510*x*, facing the shutter member 41, of the outer ring member 510. Then, as illustrated in FIG. 10B, a base end portion 41*b* of the shutter member 41 is surrounded by the end surface 510*x* and the rib 501*x* and is thus restricted from moving in the axial direction D1 and in the radial direction perpendicular to the axial direction D1. With this configuration, the rotary container unit 401 including the supplying base 501 is fitted to the container shutter unit 402 including the shutter member 41 in such a manner that the rotary container unit 401 is relatively rotatable around the rotational axis line z with respect to the container shutter unit 402 and is restricted from moving in the axial direction D1 and in the radial direction.

Then, the seal member 504 fixed to the shutter member 41 has a sliding surface 504*b*, which slides with respect to the outer circumference portion 501*b* of the supplying base 501. The seal member 504 becomes deformed by being pressed by the outer circumference portion 501*b* in a direction to come close to the shutter member 41, i.e., outward in the radial direction perpendicular to the rotational axis line z, and thus generates a surface pressure between the outer circumference portion 501*b* and the sliding surface 504*b*. This enables preventing or reducing any leakage of toner at the interface between the seal member 504 and the supplying base 501.

More specifically, as viewed in the axial direction D1 of the rotational axis line z, the supplying base 501 and the shutter member 41 are cylindrically shaped members. The supplying base 501 is configured to rotate around the rotational axis line z along an inner circumferential surface 41*j* of the shutter member 41 inside the shutter member 41.

Figure 10A:
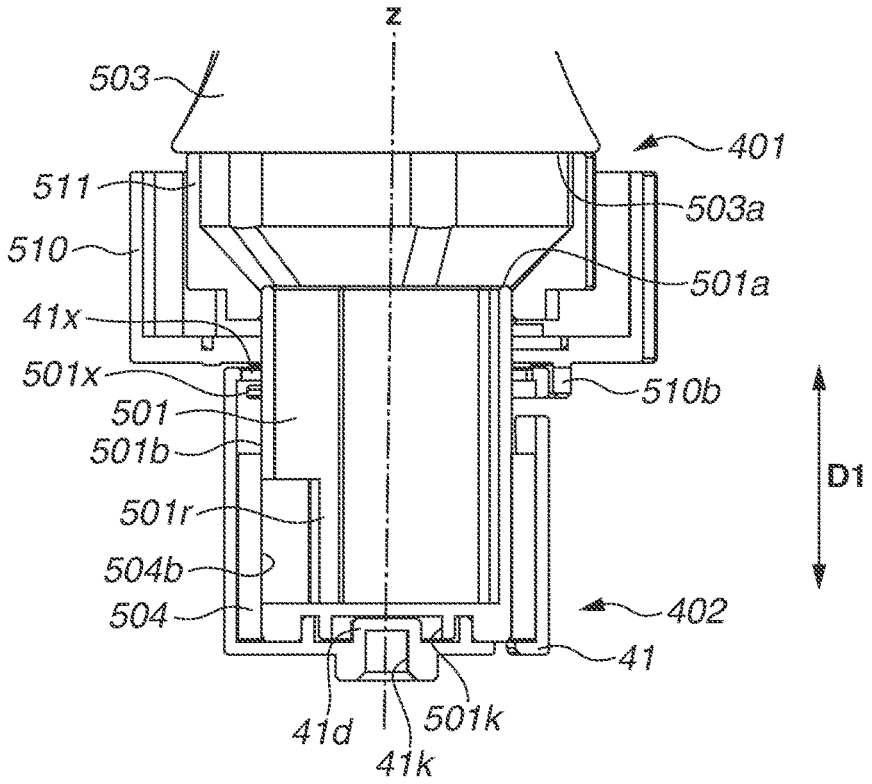
FIG. 10A is a sectional view illustrating the toner pack being in a shielded state.
Figure 10B:
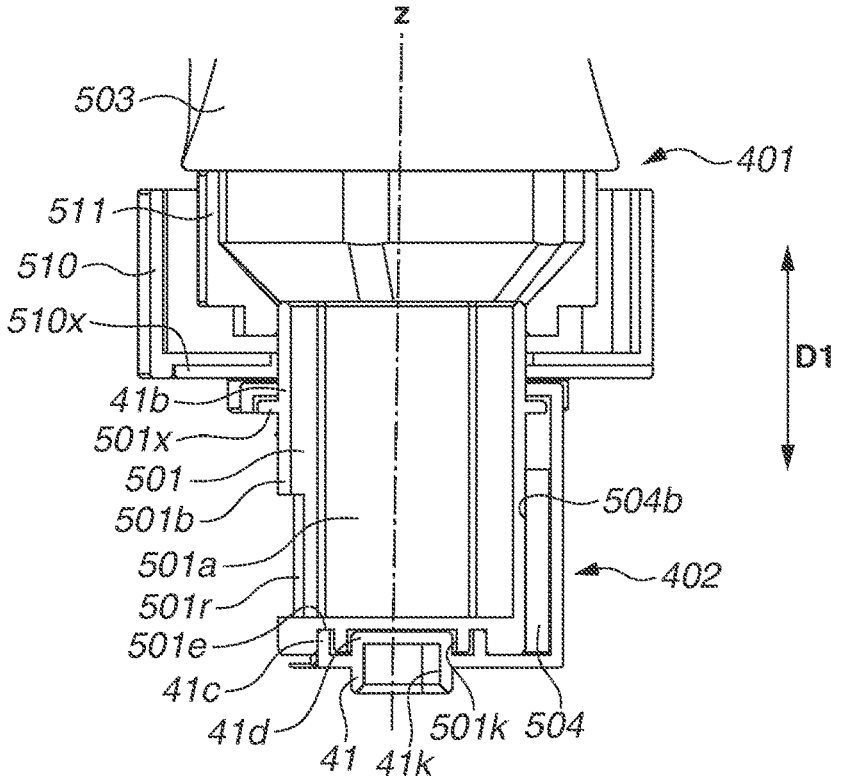
FIG. 10B is a sectional view illustrating the toner pack being in an opened state.
Figure 11A:
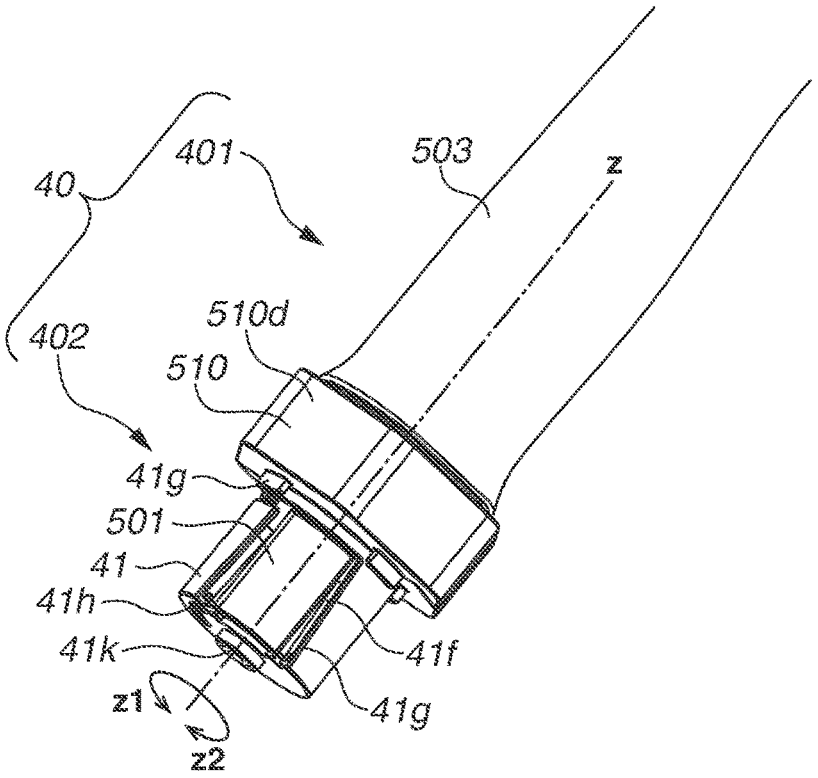
FIG. 11A is a perspective view illustrating the toner pack being in a shielded state.

FIG. 10A and FIG. 11A each illustrate a state in which the toner discharge port 501*r* formed in the supplying base 501 has been shielded by the shutter member 41 and the seal member 504. At this time, toner stored in the pouch 503 is able to pass through the opening portion 503*a* of the pouch 503, an inner space of the inner ring member 511, an opening portion 501*a* of the supplying base 501, and an inner space of the supplying base 501 and then move to the toner discharge port 501*r*. However, since the toner discharge port 501*r* is currently shielded by the shutter member 41 and the seal member 504, the toner pack 40 when being present alone is sealed in such a way as to prevent toner stored in the pouch 503 from being leaked to the outside. Furthermore, the opening portion 503*a* of the pouch 503 is provided at one end portion in the axial direction D1 of the pouch 503.

Figure 11B:
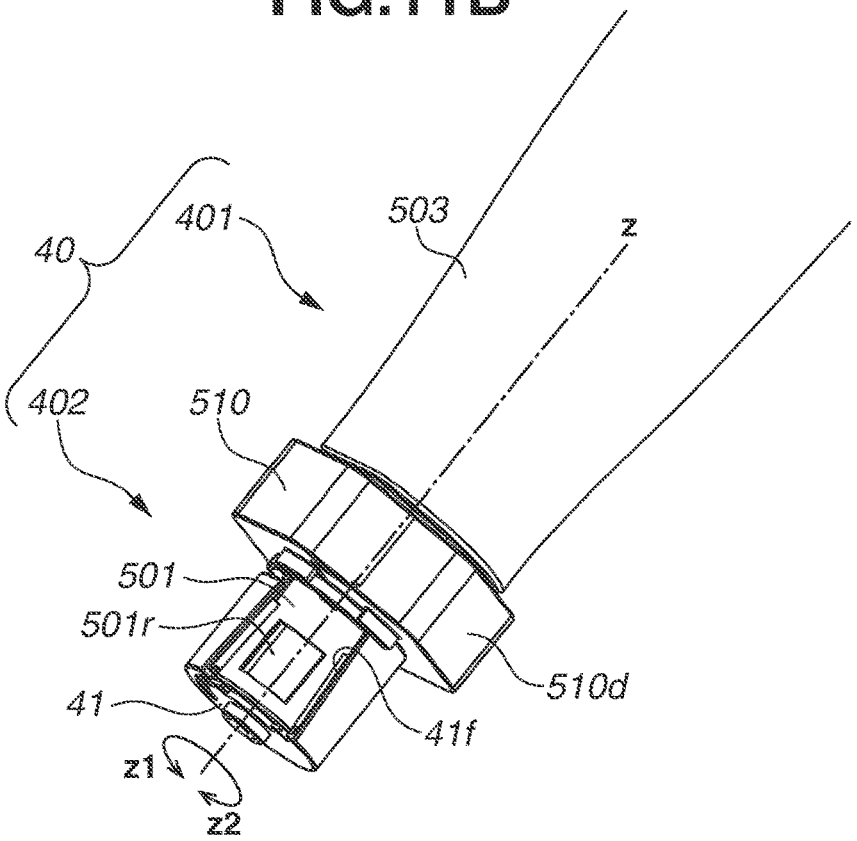
FIG. 11B is a perspective view illustrating the toner pack being in an opened state.

FIG. 10B and FIG. 11B each illustrate a state in which the toner discharge port 501*r* formed in the supplying base 501 has been opened without being shielded by the shutter member 41 and the seal member 504. At this time, the toner discharge port 501*r* is present at a position facing the cutout portion 41*f* of the shutter member 41, so that toner stored in the pouch 503 is able to be discharged to the outside of the toner pack 40 via the toner discharge port 501*r* and the cutout portion 41*f*.

For example, the state of the toner pack 40 illustrated in FIG. 11A is referred to as a "shielded state", and the state of the toner pack 40 illustrated in FIG. 11B is referred to as an "opened state". In this case, rotating the rotary container unit 401, from the shielded state, about 90 degrees in the direction of arrow z1 around the rotational axis line z causes the toner pack 40 to transition to the opened state. Moreover, rotating the rotary container unit 401, from the opened state, about 90 degrees in the direction of arrow z2 around the rotational axis line z causes the toner pack 40 to transition to the shielded state. Furthermore, by what degrees rotating the rotary container unit 401 causes the toner pack 40 to transition to the opened state or the shielded state can be optionally set.

The position of the supplying base 501 obtained when the toner pack 40 is in the shielded state as illustrated in FIG. 11A is referred to as a "shielded position" or a "first shielded position", and the position of the supplying base 501 obtained when the toner pack 40 is in the opened state as illustrated in FIG. 11B is referred to as an "opened position" or an "first opened position".

When the supplying base 501 is present in the shielded position, the toner discharge port 501*r* is shielded by the shutter member 41. Moreover, when the supplying base 501 is present in the opened position, the toner discharge port 501*r* is opened by the shutter member 41 in such a way as to allow toner stored in the pouch 503 to be discharged to the outside of the toner pack 40 via the toner discharge port 501*r*.

Furthermore, after mounting the toner pack 40 to the developing container 32, the user grasps the outer circumference portion of the outer ring member 510 and then rotates the outer ring member 510 in the direction of arrow z1 around the rotational axis line z. This also causes the supplying base 501 to rotate in the direction of arrow z1 around the rotational axis line z, so that the toner discharge port 501*r* of the supplying base 501 becomes exposed outside via the cutout portion 41*f*. As a result, the toner pack 40 transitions from the shielded state to the opened state, so that toner stored in the pouch 503 becomes able to be discharged to the outside of the toner pack 40. Here, the axial direction D1 parallel to the rotational axis line z is a direction parallel to the vertical direction, and a direction in which to mount the toner pack 40 to the image forming apparatus 1 is a direction parallel to the axial direction D1. Thus, the toner pack 40 is configured to be mounted to the image forming apparatus 1 in such a manner that the axial direction D1, which is a direction of the rotational axis line z, becomes a direction parallel to the vertical direction.

The material of the pouch 503 is configured with, for example, a resin sheet made from, for example, polyethylene (PE), polypropylene (PP), or polyethylene terephthalate (PET), a compound material of these materials, non-woven fabric, paper, or a compound material of these materials with a resin. In a case where the pouch 503 is configured with a material which is able to be elastically deformed by the user, the user pressing or squeezing the pouch 503 enables readily discharging toner stored in the pouch 503.

After finishing discharging toner stored in the pouch 503 to the developing container 32, the user grasps the outer circumferential surface 510*d* of the outer ring member 510 and then rotates the outer ring member 510 in the direction of arrow z2 around the rotational axis line z. This also causes the supplying base 501 to rotate in the direction of arrow z2 around the rotational axis line z, so that the toner discharge port 501*r* of the supplying base 501 is shielded by the shutter member 41 and the seal member 504. As a result, the toner pack 40 transitions from the opened state to the shielded state, so that it becomes possible to demount the toner pack 40 from the developing container 32.

[Toner Receiving Portion of Developing Container]

Next, the toner receiving portion 600 provided in the developing container 32 is described. As illustrated in FIGS. 12A and 12B to FIG. 15, the toner receiving portion 600 includes a receiving base unit 602 and a receiving shutter unit 601, which is supported in such a way as to be rotatable around the rotational axis line z with respect to the receiving base unit 602.

Figure 12A:
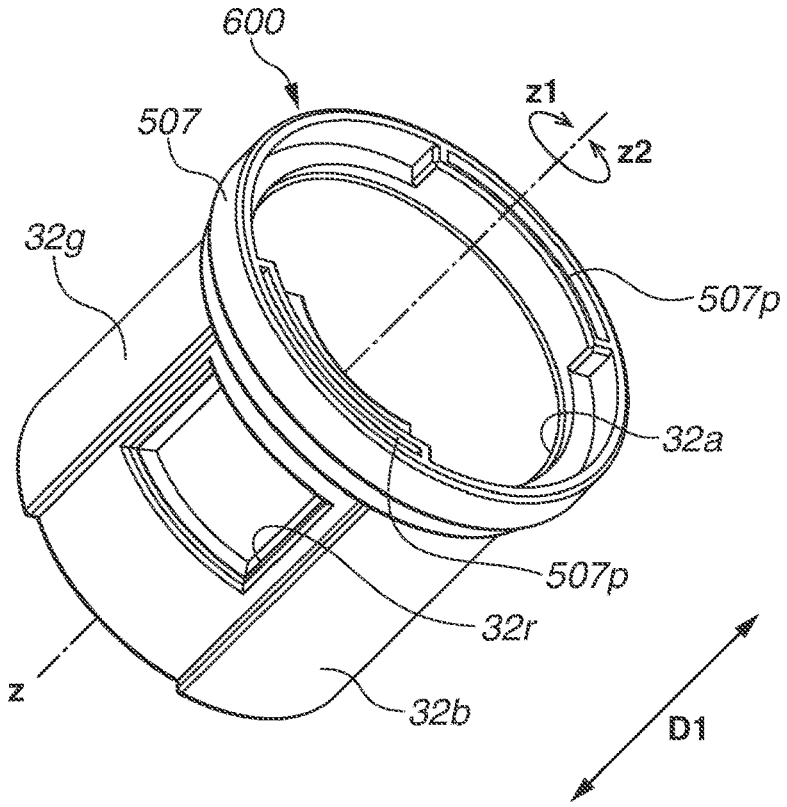
FIG. 12A is a perspective view illustrating a toner receiving portion being in a shielded state.
Figure 12B:
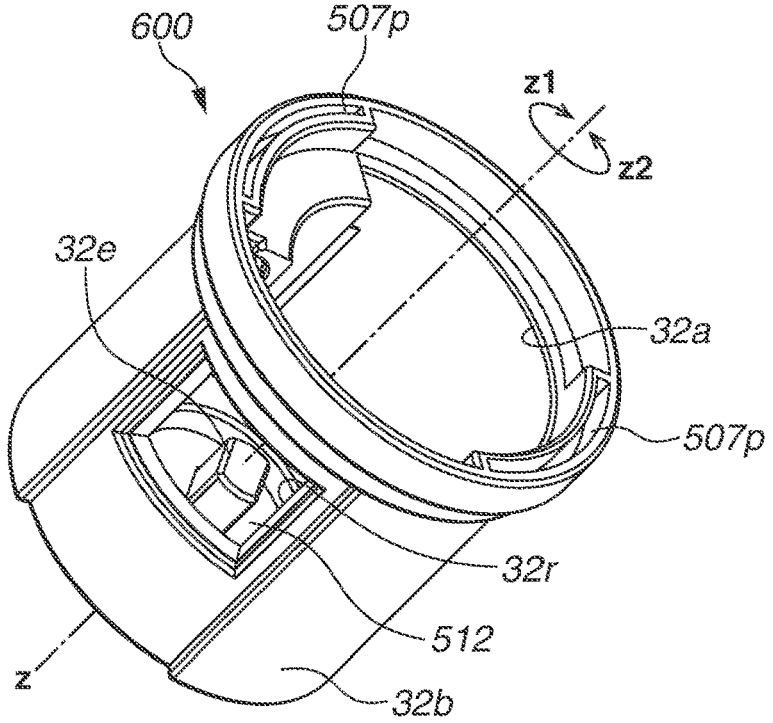
FIG. 12B is a perspective view illustrating the toner receiving portion being in an opened state.
Figure 13A:
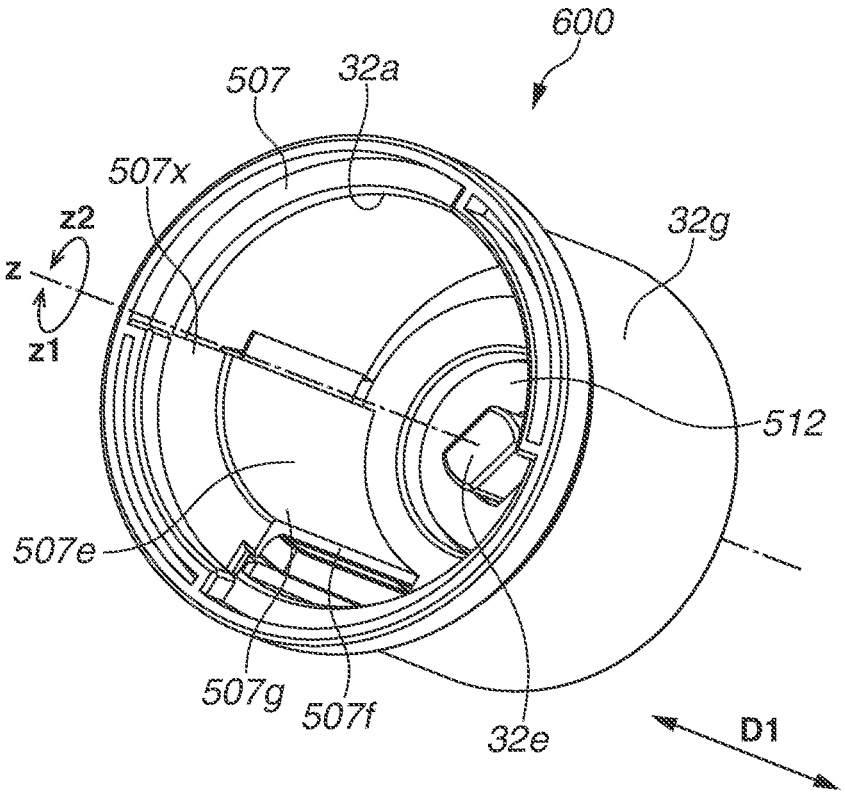
FIG. 13A is a perspective view illustrating the toner receiving portion being in a shielded state.
Figure 13B:
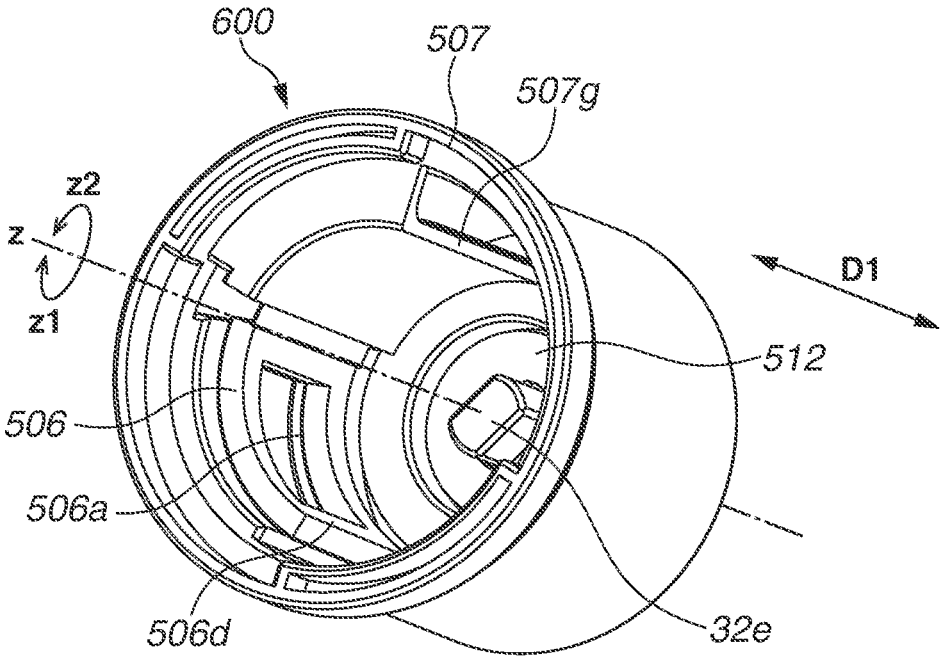
FIG. 13B is a perspective view illustrating the toner receiving portion being in an opened state.
Figure 14:
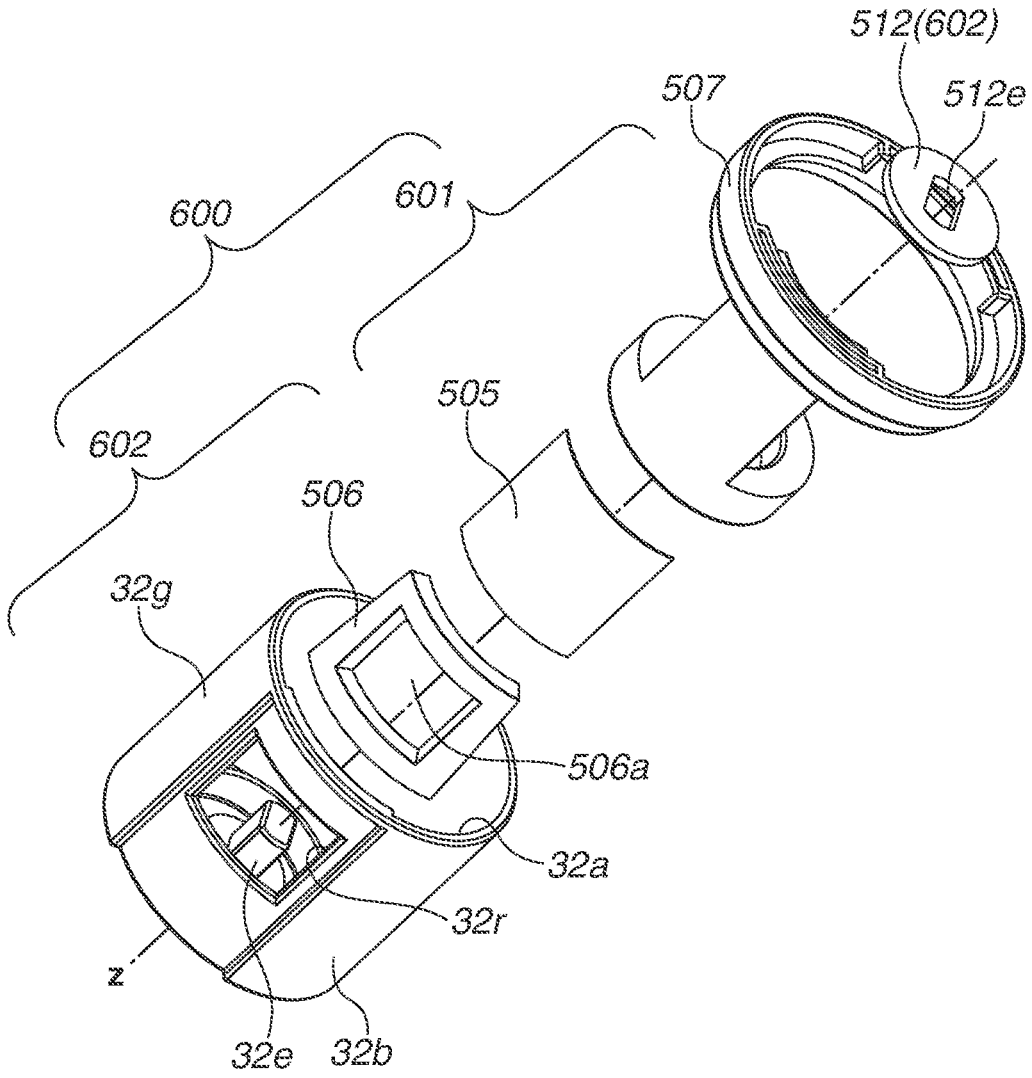
FIG. 14 is an exploded perspective view illustrating the toner receiving portion.

FIG. 12A and FIG. 13A each illustrate a state in which a toner supply port 32*r* leading to the storage portion 36 has been shielded, and FIG. 12B and FIG. 13B each illustrate a state in which the toner supply port 32*r* has been opened. Hereinafter, the state of the toner receiving portion 600 in which the toner supply port 32*r* has been shielded as illustrated in FIG. 12A and FIG. 13A is referred to as a "shielded state", and the state of the toner receiving portion 600 in which the toner supply port 32*r* has been opened as illustrated in FIG. 12B and FIG. 13B is referred to as an "opened state".

The receiving base unit 602 includes a cylindrical portion 32*g*, which serves as an approximately cylindrically shaped body base portion, a base seal 506, and a shutter presser member 512. Furthermore, while, in the first exemplary embodiment, the cylindrical portion 32*g* is formed integrally with the developing container 32 (see FIG. 1), the first exemplary embodiment is not limited to this. For example, the cylindrical portion 32*g* can be configured with a member different from the developing container 32 and be fixed to the developing container 32. Moreover, a configuration in which the cylindrical portion 32*g* is provided in a portion of the printer body 100 that is not the developing container 32 and toner is supplied to the developing container 32 via the cylindrical portion 32*g* can be employed.

The cylindrical portion 32*g* includes a supplying port 32*a*, through which toner is supplied from the toner pack 40 to the storage portion 36 (see FIG. 1) of the developing container 32, an outer circumference portion 32*b*, which serves as a side surface extending along the axial direction D1, and the toner supply port 32*r*, which is formed in the outer circumference portion 32*b*. Moreover, the cylindrical portion 32*g* includes an engaging portion 32*e*, which projects upward in the axial direction D1 from a bottom surface 32*h* (see FIG. 19A) of the cylindrical portion 32*g*. The engaging portion 32*e* is engaged with the engaged portion 41*k* of the shutter member 41 as described below. Thus, the engaging portion 32*e* has a beveled boss shape with respect to the engaged portion 41*k* having a beveled hole shape.

Moreover, the engaging portion 32*e* is press-fitted into a hole portion 512*e* of the shutter presser member 512. Therefore, the hole portion 512*e* has a beveled hole shape as with the engaging portion 32*e*. Furthermore, the shutter presser member 512 is attached to the engaging portion 32*e* of the cylindrical portion 32*g* after a shutter member 507 of the receiving shutter unit 601 is fitted into the cylindrical portion 32*g*. Moreover, while, in the first exemplary embodiment, the shutter presser member 512 is fixed by being press-fitted into the engaging portion 32*e* of the cylindrical portion 32*g*, the first exemplary embodiment is not limited to this. For example, the shutter presser member 512 can be fixed to the cylindrical portion 32*g* by, for example, a method of using thermal adhesion or adhesive.

Figure 16A:
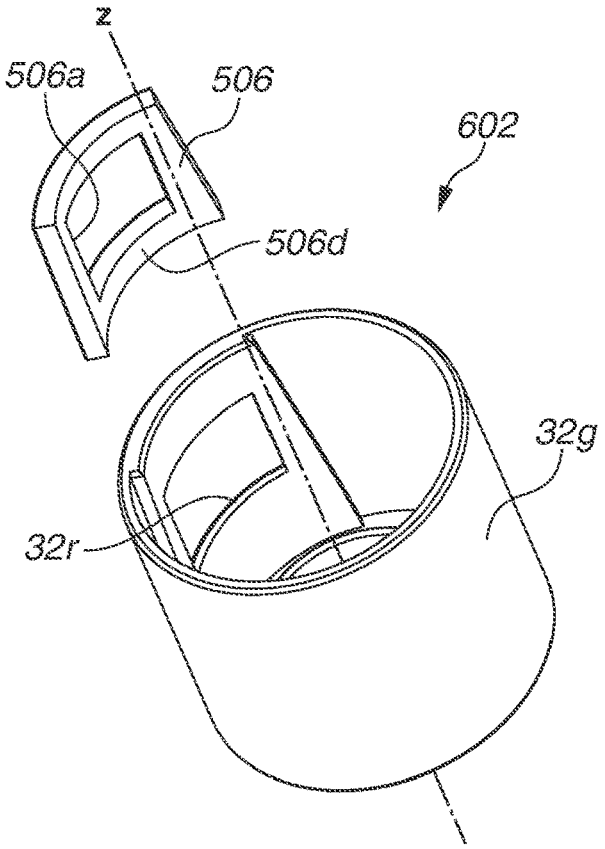
FIG. 16A is an exploded perspective view illustrating a cylindrical portion and a base seal.
Figure 16B:
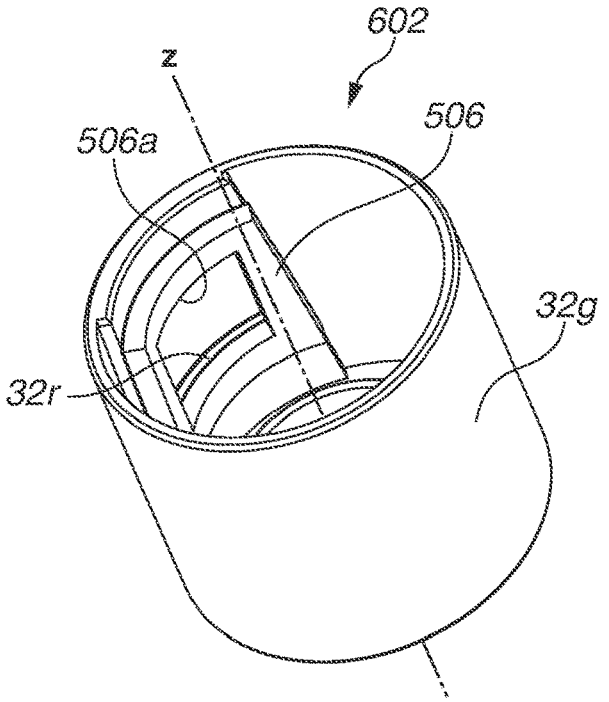
FIG. 16B is a perspective view illustrating the cylindrical portion and the base seal.

As illustrated in FIGS. 16A and 16B, the base seal 506 is configured with a material such as urethane foam or non-woven fabric which is elastically deformable, and is fixed to the cylindrical portion 32*g* by, for example, double-sided adhesive tape. This enables the base seal 506 to prevent or reduce any leakage of toner at the interface between the base seal 506 and the cylindrical portion 32*g*. Moreover, the base seal 506 has an opening portion 506*a* provided at a position corresponding to the toner supply port 32*r*, and toner which has passed through the opening portion 506*a* is supplied to the storage portion 36 (see FIG. 1) of the developing container 32 through the toner supply port 32*r*.

As illustrated in FIGS. 12A and 12B to FIG. 15 and FIGS. 17A and 17B, the receiving shutter unit 601 includes the shutter member 507 and a shutter sheet 505. Furthermore, the developing container 32 (see FIG. 1) includes the storage portion 36, the cylindrical portion 32*g*, and the shutter member 507, and supports the developing roller 31 in a rotatable manner. Then, the toner pack 40 is configured to be mountable to the developing container 32.

The shutter member 507 includes an inner diameter portion 507*h*, an outer diameter portion 507*k*, and a projecting portion 507*e*, which interconnects the inner diameter portion 507*h* and the outer diameter portion 507*k*. The projecting portion 507*e* projects to the more inner side in the radial direction than the outer diameter portion 507*k*, and, as illustrated in FIGS. 13A and 13B, includes an approximately fan-shaped horizontal portion 507*x* and a rising portion 507*s*, which extends in the axial direction D1. The horizontal portion 507*x* is configured to be able to pass through the slot portion 41*g* (see FIG. 9A) of the shutter member 41 of the toner pack 40. Moreover, the rising portion 507*s* is configured to be able to pass through the slot portion 41*h* (see FIG. 9A) of the shutter member 41.

Figure 17A:
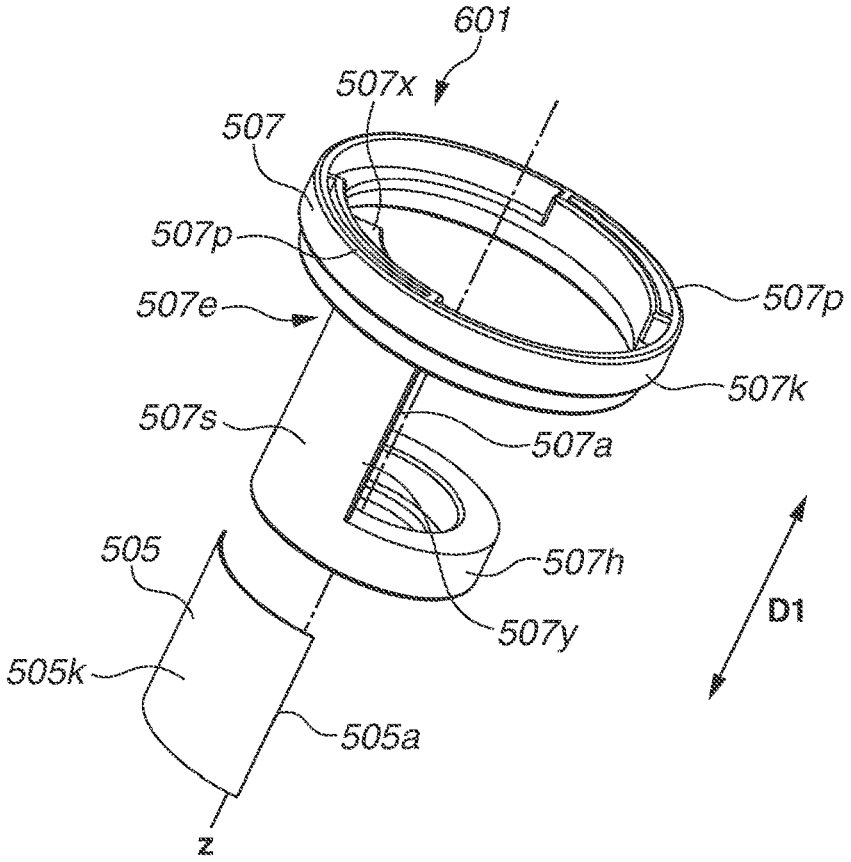
FIG. 17A is an exploded perspective view illustrating the shutter member and a shutter sheet.
Figure 17B:
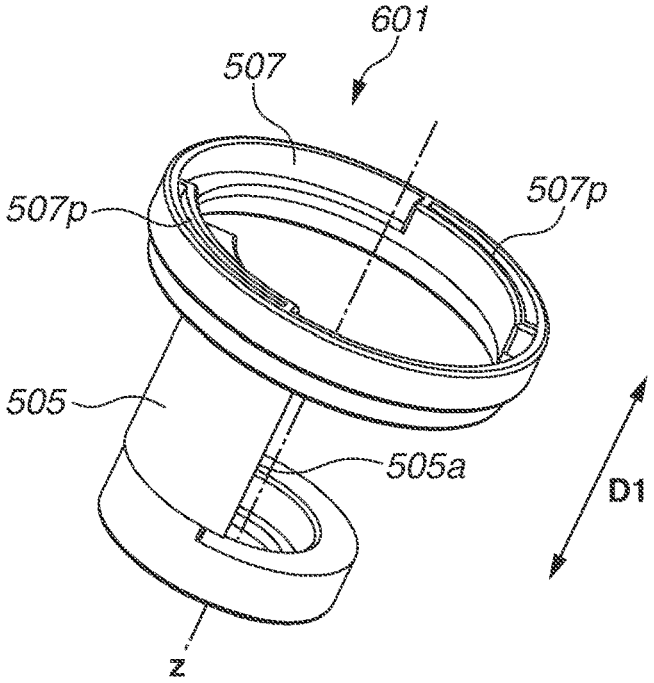
FIG. 17B is a perspective view illustrating the shutter member and the shutter sheet.

As illustrated in FIGS. 17A and 17B, the shutter sheet 505 is fixed to the outer circumferential surface of the rising portion 507*s* by, for example, double-side adhesion tape. The shutter sheet 505 is a film with a width of about 100 μm, and is arranged in such a manner that a front end portion 505*a* of the shutter sheet 505 protrudes from an edge portion 507*a* of the rising portion 507*s*. A sliding surface 505*k* of the shutter sheet 505 is configured to be able to slide with respect to a sliding surface 506*d* (see FIG. 16A) of the base seal 506.

Groove portions 507*p* and 507*p*, with which the ribs 510*b* (see FIG. 8A) formed in the outer ring member 510 of the toner pack 40 are able to be engaged, are formed in the outer diameter portion 507*k* of the shutter member 507. These groove portions 507*p* and 507*p* are arranged opposite each other in the radial direction, and are formed in such a way as to extend in the circumferential direction in respective partial ranges (about 90 degrees) in the circumferential direction of the outer diameter portion 507*k*. Therefore, the upper portion of the outer diameter portion 507*k* is divided into four sections by the groove portions 507*p* and 507*p*, and four ribs 510*b* of the outer ring member 510 are engaged with the four sections. With this configuration, the toner pack 40 is configured to be rotatable only in the range of about 90 degrees while being mounted to the toner receiving portion 600. Therefore, at the time of supplying toner from the toner pack 40 to the developing container 32, a range in which to rotationally operate the rotary container unit 401 of the toner pack 40 becomes clear, so that it is possible to improve usability.

Figure 18:
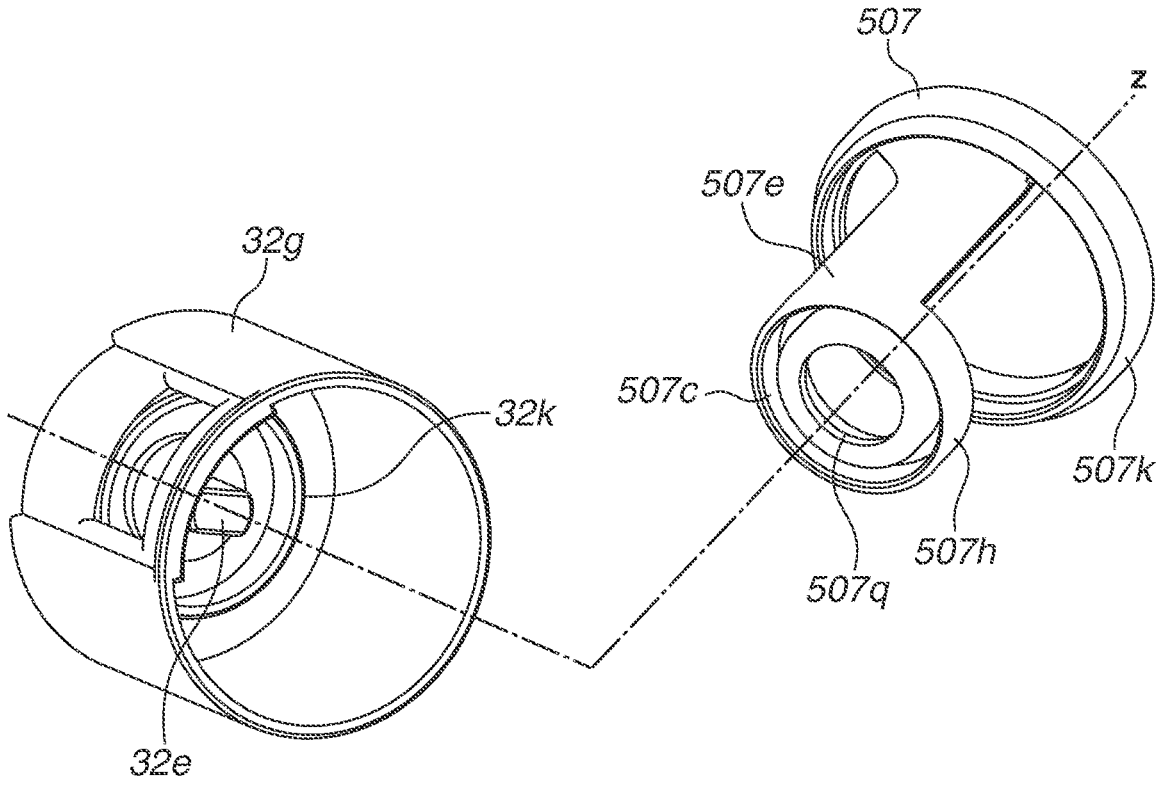
FIG. 18 is an exploded perspective view illustrating the cylindrical portion and the shutter member.
Figure 19A:
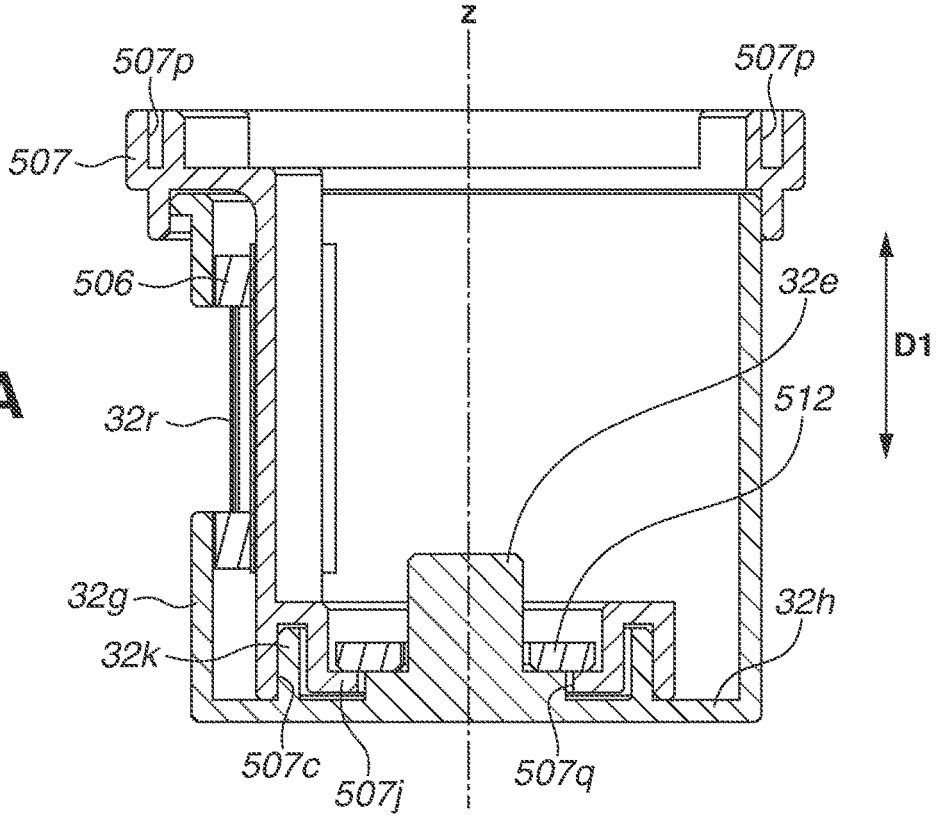
FIG. 19A is a sectional view illustrating the toner receiving portion being in a shielded state.
Figure 19B:
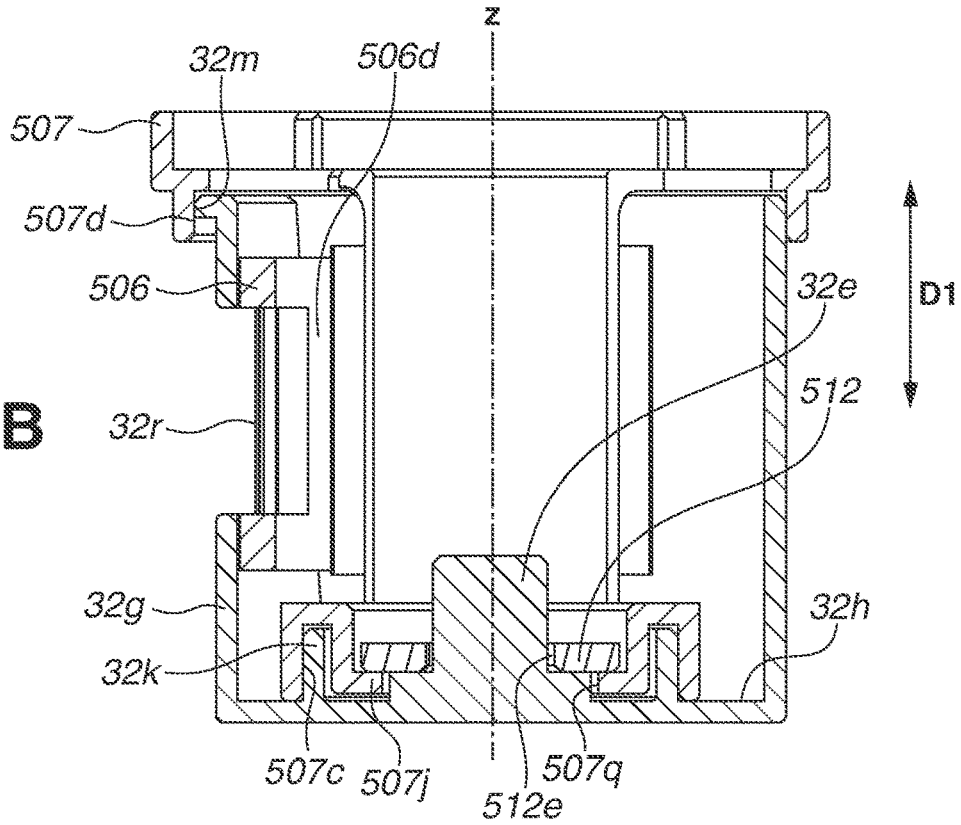
FIG. 19B is a sectional view illustrating the toner receiving portion being in an opened state.

As illustrated in FIG. 18, a guide groove 507*c* is formed in the inner diameter portion 507*h* of the shutter member 507, and a guide rib 32*k* of the cylindrical portion 32*g* is inserted into the guide groove 507*c*. As illustrated in FIG. 18 and FIGS. 19A and 19B, the guide groove 507*c* and the guide rib 32*k* are a cylindrical groove and a cylindrical projection portion, respectively, which are concentric about the rotational axis line z. Therefore, the guide rib 32*k* being inserted into the guide groove 507*c* causes the shutter member 507 to be guided to be rotatable around the rotational axis line z with respect to the cylindrical portion 32*g*.

Moreover, an inner circumferential surface 507d of the shutter member 507 is provided in such a way as to be able to be in sliding contact with a rib 32*m* of the cylindrical portion 32*g*. In this way, the shutter member 507 is supported in such a way as to be movable around the rotational axis line z with respect to the cylindrical portion 32*g*.

Additionally, a hole portion 507*q*, which is arranged on the inner side in the radial direction of the guide groove 507*c*, is formed in the inner diameter portion 507*h* of the shutter member 507. While the engaging portion 32*e* passes through the hole portion 507*q*, the outside diameter of the hole portion 507*q* is set larger than the outermost diameter of the engaging portion 32*e*, so that the shutter member 507 becomes rotatable freely without interfering with the engaging portion 32*e*.

Then, after the shutter member 507 is fitted to the cylindrical portion 32*g*, the shutter presser member 512 is press-fitted into the engaging portion 32*e*. This causes a rib 507*j* of the shutter member 507 to be sandwiched between the bottom surface 32*h* of the cylindrical portion 32*g* and the shutter presser member 512 in the axial direction D1. As a result, the shutter member 507 is restricted from moving in the axial direction D1. Thus, the receiving shutter unit 601 including the shutter member 507 is attached in such a way as to be relatively rotatable around the rotational axis line z and movable in the axial direction D1 and the radial direction with respect to the receiving base unit 602 including the cylindrical portion 32*g* and the shutter presser member 512.

The base seal 506 fixed to the cylindrical portion 32*g* is deformed by being pressed by the shutter sheet 505 fixed to the shutter member 507 in a direction to come close to the cylindrical portion 32*g*, i.e., outward in the radial direction perpendicular to the axial direction D1. This causes a surface pressure to be generated between the sliding surface 506*d* of the base seal 506 and the sliding surface 505*k* (see FIG. 17A) of the shutter sheet 505. Therefore, even if toner is currently stored in the developing container 32 when the developing container 32 is present alone, it is possible to prevent or reduce any leakage of toner at the interface between the base seal 506 and the shutter sheet 505.

[Coupling between Toner Pack and Cylindrical Portion of Developing Container]

Next, a coupling operation between the toner pack 40 and the developing container 32, a decoupling operation therebetween, and an opening and closing operation of the toner discharge port 501*r* and the toner supply port 32*r* are described. FIG. 3A and FIG. 11A each illustrate a shielded state of the toner pack 40, in which the toner discharge port 501*r* is shielded by the seal member 504 attached to the shutter member 41. FIG. 12A and FIG. 13A each illustrate a shielded state of the toner receiving portion 600, in which the toner supply port 32*r* is shielded by the shutter sheet 505 attached to the shutter member 507.

Usually, at the time of starting supplying toner to the developing container 32, each of the toner pack 40 and the toner receiving portion 600 is in a shielded state. In other words, when the supplying base 501 is present in the first shielded position, as viewed from the radial direction perpendicular to the axial direction D1, the toner discharge port 501*r* is at a position where the toner discharge port 501*r* does not overlap the toner supply port 32*r* of the cylindrical portion 32*g* and the shutter member 507 is present in the second shielded position.

Figure 20A:
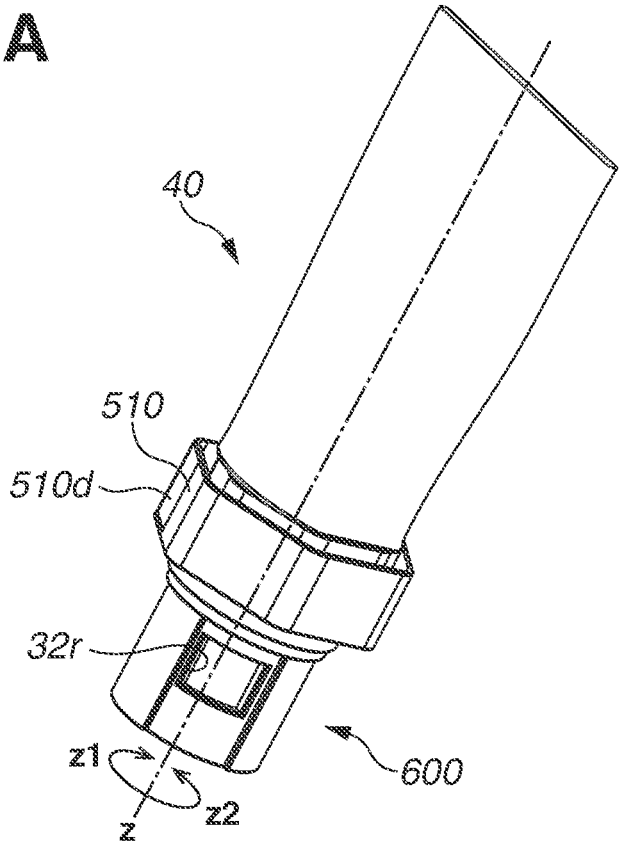
FIG. 20A is a perspective view illustrating the toner receiving portion being in a shielded state and the toner pack.

Then, the user fits the toner pack 40 into the toner receiving portion 600 as illustrated in FIG. 20A. At this time, the engaged portion 41*k* (see FIG. 3A) formed in the shutter member 41 of the toner pack 40 is engaged with the engaging portion 32*e* formed in the cylindrical portion 32*g* of the toner receiving portion 600.

Since the engaged portion 41*k* and the engaging portion 32*e* each have a beveled shape and are engaged with each other, the shutter member 41 is attached in such a way as to be unable to rotate around the rotational axis line z with respect to the cylindrical portion 32*g*. Thus, the engaged portion 41*k* is configured to be engaged with the engaging portion 32*e* of the image forming apparatus 1 when the toner pack 40 is mounted to the image forming apparatus 1, so that the shutter member 41 is restricted from rotating around the rotational axis line z.

In other words, the toner pack 40 is mounted to the image forming apparatus 1 in such a manner that the shutter member 507 is restricted from rotating around the rotational axis line z with respect to the cylindrical portion 32*g* and the supplying base 501 rotates together with the shutter member 507.

Moreover, the projecting portion 507*e* (see FIG. 13A) formed in the shutter member 507 of the toner receiving portion 600 passes through the cutout portion 41*f* of the shutter member 41 of the toner pack 40 and is engaged with the recessed portion 501*f* (see FIG. 8A) formed in the supplying base 501. Furthermore, in a case where both the toner pack 40 and the toner receiving portion 600 are in a shielded state, when the toner pack 40 is fitted into the toner receiving portion 600, an engagement between the engaged portion 41*k* and the engaging portion 32*e* and an engagement between the projecting portion 507*e* and the recessed portion 501*f* are able to be simultaneously performed.

Here, consider a case where the user rotates, from the state illustrated in FIG. 20A, the outer circumferential surface 510*d* of the outer ring member 510 in the direction of arrow z1 around the rotational axis line z and then supplies toner stored in the toner pack 40 to the developing container 32. When the outer ring member 510 is rotated in the direction of arrow z1, the supplying base 501 is also rotated in the direction of arrow z1 in conjunction with the rotation of the outer ring member 510. At this time, a step portion 501*n* (see FIG. 8A) of the recessed portion 501*f* of the supplying base 501 presses an end surface 507*f* (see FIG. 13A), serving as an abutting-contacted portion, of the projecting portion 507*e* of the shutter member 507.

In other words, the step portion 501*n* serving as an abutting-contact portion comes into abutting contact with the end surface 507*f* in such a manner that, when the toner pack 40 has been mounted to the image forming apparatus 1, the shutter member 507 rotates together with the shutter member 41 around the rotational axis line z. This causes the shutter member 507 serving as a body shutter to rotate together with the supplying base 501 in the direction of arrow z1 around the rotational axis line z.

On the other hand, the cylindrical portion 32*g* of the toner receiving portion 600 and the shutter member 41 of the toner pack 40 are restricted from being rotated as mentioned above, and, therefore, do not rotate. Therefore, as illustrated in FIG. 11B, the supplying base 501 of the toner pack 40 relatively rotates in the direction of arrow z1 with respect to the shutter member 41, so that the toner discharge port 501*r* becomes facing the cutout portion 41*f* of the shutter member 41. Thus, the toner pack 40 comes into an opened state and becomes able to discharge toner stored in the toner pack 40.

At the same time, as illustrated in FIG. 13B, the shutter member 507 of the toner receiving portion 600 relatively rotates in the direction of arrow z1 with respect to the cylindrical portion 32*g*, so that the shutter sheet 505 fixed to the shutter member 507 moves away from the toner supply port 32*r*. Thus, the toner receiving portion 600 comes into an opened state and becomes able to receive toner discharged from the toner pack 40. In other words, the shutter member 507 is situated in the second opened position for opening the toner supply port 32*r* in such a manner that toner supplied from the toner pack 40 is received by the storage portion 36 of the developing container 32 via the toner supply port 32*r*. Moreover, when the supplying base 501 is present in the first opened position, as viewed from the radial direction perpendicular to the axial direction D1, the toner discharge port 501*r* is at a position where the toner discharge port 501*r* overlaps the toner supply port 32*r* of the cylindrical portion 32*g* and the shutter member 507 is present in the second opened position.

Figure 20B:
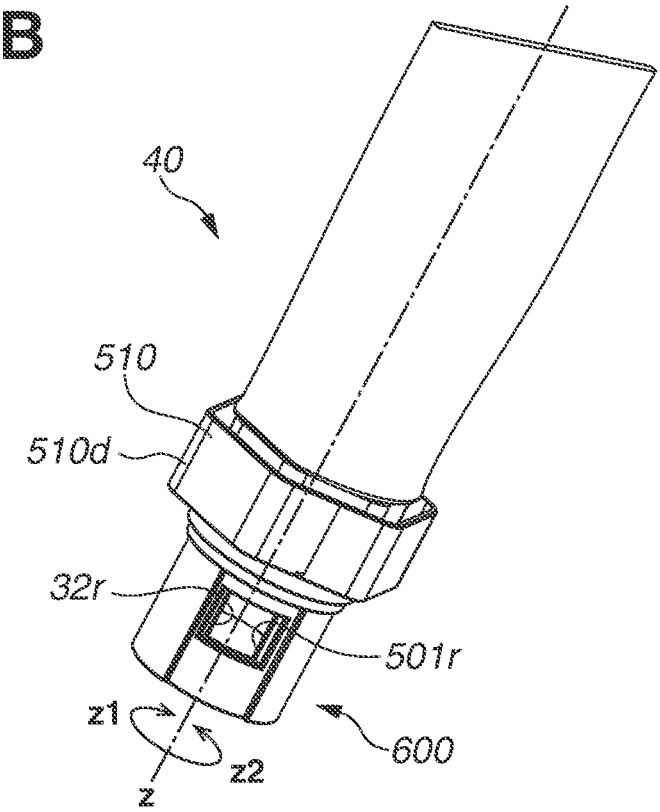
FIG. 20B is a perspective view illustrating the toner receiving portion being in an opened state and the toner pack.

With this operation, as illustrated in FIG. 20B, toner stored in the toner pack 40 is supplied to the developing container 32 through the toner supply port 32*r* and the toner discharge port 501*r*. Furthermore, the rotational angle of the outer ring member 510 is restricted to about 90 degrees by an engagement between the projecting portion 507*e* of the shutter member 507 and the slot portions 41*g* and 41*h* of the shutter member 41 and an engagement between the rib 510*b* of the outer ring member 510 and the groove portions 507*p* of the shutter member 507. Furthermore, the rotational angle of the outer ring member 510 is not limited to about 90 degrees but can be smaller than 90 degrees or larger than or equal to 90 degrees.

Moreover, the projecting portion 507*e* of the shutter member 507 being engaged with the slot portion 41*g* of the shutter member 41 causes the toner pack 40 to become unable to move in the axial direction D1 with respect to the toner receiving portion 600 and thus enables locking the toner pack 40 with respect to the toner receiving portion 600. This enables reducing a phenomenon in which, during supplying of toner, the toner pack 40 is accidentally detached from the toner receiving portion 600 and toner is scattered inside the image forming apparatus 1, and thus enables improving workability in a toner supplying operation.

Next, consider a case where the user rotates, from the state illustrated in FIG. 20B, the outer circumferential surface 510*d* of the outer ring member 510 in the direction of arrow z2 around the rotational axis line z and then disengages the toner pack 40 from the cylindrical portion 32*g* of the developing container 32. When the outer ring member 510 is rotated in the direction of arrow z2, the supplying base 501 is also rotated in the direction of arrow z2 in conjunction with the rotation of the outer ring member 510. At this time, a step portion 501*m* (see FIG. 8A) of the recessed portion 501*f* of the supplying base 501 presses an end surface 507*g* (see FIG. 13B) of the projecting portion 507*e* of the shutter member 507. This causes the shutter member 507 to rotate together with the supplying base 501 in the direction of arrow z2 around the rotational axis line z.

On the other hand, the cylindrical portion 32*g* of the toner receiving portion 600 and the shutter member 41 of the toner pack 40 are restricted from being rotated as mentioned above, and, therefore, do not rotate. Therefore, as illustrated in FIG. 11A, the supplying base 501 of the toner pack 40 relatively rotates in the direction of arrow z2 with respect to the shutter member 41, so that the toner discharge port 501*r* becomes facing the seal member 504 (see FIG. 10A) fixed to the shutter member 41. Thus, the toner pack 40 comes into a shielded state and becomes unable to discharge toner stored in the toner pack 40.

At the same time, as illustrated in FIG. 13A, the shutter member 507 of the toner receiving portion 600 relatively rotates in the direction of arrow z2 with respect to the cylindrical portion 32*g*, so that the shutter sheet 505 fixed to the shutter member 507 covers the toner supply port 32*r*. Thus, the toner receiving portion 600 comes into a shielded state and becomes unable to receive toner discharged from the toner pack 40. At this time, the shutter member 507 is present in the second shielded position, which shields the toner supply port 32*r*.

In this state, since the projecting portion 507*e* of the shutter member 507 is disengaged from the slot portions 41*g* and 41*h* of the shutter member 41, it is possible to detach the toner pack 40 from the toner receiving portion 600. Moreover, since both the toner pack 40 and the toner receiving portion 600 have come into a shielded state, it is possible to detach the toner pack 40 from the toner receiving portion 600 without toner being scattered.

[Configuration for Preventing or Reducing Leakage of Toner]

Next, a configuration for preventing or reducing any leakage of toner occurring between the toner pack 40 and the toner receiving portion 600 is described with reference to FIGS. 21A, 21B, and 21C to FIGS. 23A and 23B. FIGS. 21A to 21C to FIGS. 23A and 23B are schematic sectional views illustrating positional relationships between the toner pack 40 and the toner receiving portion 600 of the developing container 32. The seal member 504 and the base seal 506 are arranged as respective cylindrical curved surfaces, but, here, are schematically illustrated as plain surfaces.

FIGS. 21A to 21C to FIGS. 23A and 23B are views of the toner pack 40 and the toner receiving portion 600 as viewed in the axial direction D 1. Furthermore, when the outer ring member 510 (see FIG. 20A) of the toner pack 40 is rotated in the direction of arrow z1, the supplying base 501 moves to the left in a plane of paper of each of FIGS. 21A to 21C to FIGS. 23A and 23B.

Figure 21A:
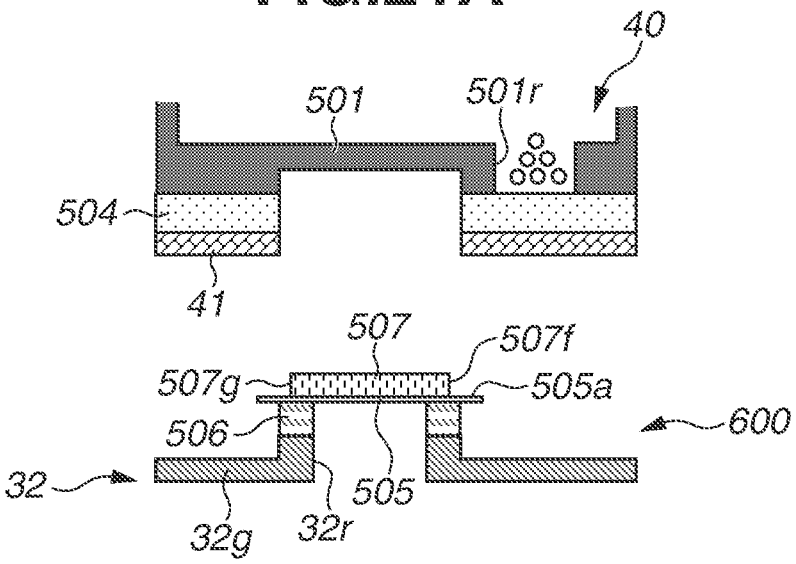
FIG. 21A is a sectional view illustrating a state obtained before the toner pack is mounted to a developing container and, FIG. 21B is a sectional view illustrating a state in which the toner pack has been mounted to the developing container.
Figure 21B:
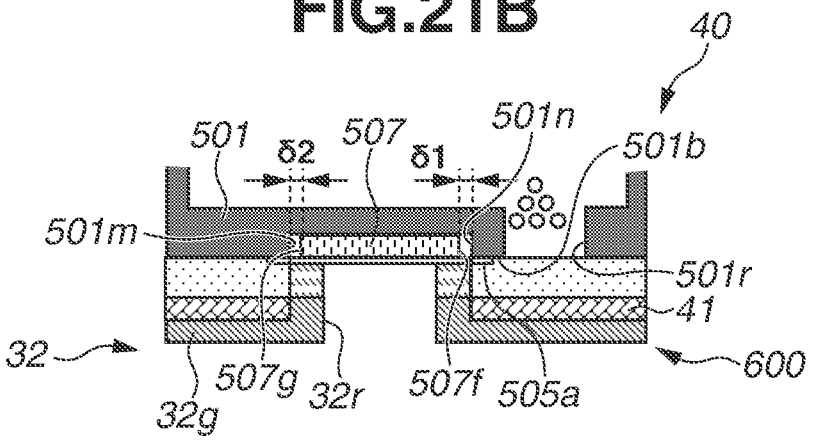
FIG. 21C is a sectional view illustrating a state in which the supplying base has rotated a predetermined angle from the state illustrated in FIG. 21B.

FIG. 21A illustrates a state obtained before the developing container 32 and the toner pack 40 are coupled to each other. FIG. 21B illustrates a state in which the toner pack 40 has been mounted to the developing container 32 from the state illustrated in FIG. 21A, and a state obtained before the supplying base 501 of the toner pack 40 and the shutter member 507 of the toner receiving portion 600 rotate. In the state illustrated in FIG. 21B, since the toner supply port 32*r* and the toner discharge port 501*r* have been shielded, toner stored in the pouch 503 (see FIG. 3A) is not discharged to the outside of the toner pack 40.

Figure 21C:
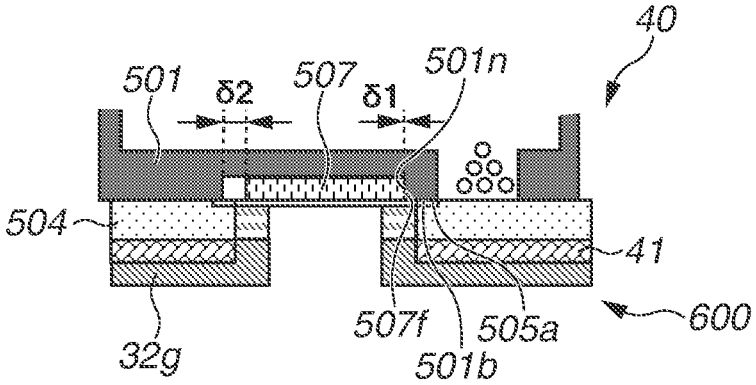
Figure 22A:
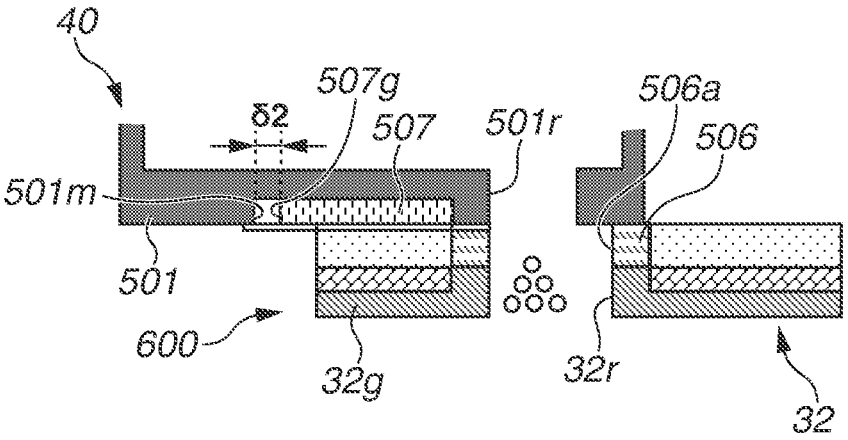
FIG. 22A is a sectional view illustrating a state in which a toner supplying port and a toner discharging port have been opened.

Moreover, FIG. 21C illustrates a state in which the supplying base 501 and the shutter member 507 have rotated by an angle θ1 (0°<θ1<90°) in the direction of arrow z1 (see FIG. 20A) around the rotational axis line z from the state illustrated in FIG. 21B. FIG. 22A illustrates a state in which the supplying base 501 and the shutter member 507 have rotated by 90° in the direction of arrow z1 (see FIG. 20A) from the state illustrated in FIG. 21B and a state in which the toner supply port 32*r* and the toner discharge port 501*r* have been opened.

As illustrated in FIG. 21B, in a state in which the toner pack 40 being in a shielded state has been mounted to the toner receiving portion 600 being in a shielded state, the front end portion 505*a* of the shutter sheet 505 is arranged to be in contact with the outer circumference portion 501*b* of the supplying base 501. Moreover, the step portion 501*n* of the supplying base 501 is arranged to have a clearance δ1 with respect to the end surface 507*f* of the shutter member 507 in a circumferential direction around the rotational axis line z. The step portion 501*m* of the supplying base 501 is also arranged to have a clearance δ2 with respect to the end surface 507*g* of the shutter member 507 in a circumferential direction around the rotational axis line z.

These clearances δ1 and δ2 are equivalent to clearances (allowances) which are provided for the user to mount the toner pack 40 to the developing container 32. Providing the clearances δ1 and δ2 enables readily mounting the toner pack 40 to the developing container 32 and thus improving the property of mounting the toner pack 40.

After mounting the toner pack 40 to the toner receiving portion 600 of the developing container 32, the user rotates the supplying base 501 in the direction of arrow z1. Then, as illustrated in FIG. 21C, the clearance δ1, which has existed in the state illustrated in FIG. 21B, disappears, so that the step portion 501*n* of the supplying base 501 comes into contact with the end surface 507*f* of the shutter member 507. Then, the end surface 507*f* is pressed by the step portion 501*n*, so that the supplying base 501 and the shutter member 507 integrally rotate in the direction of arrow z1. Furthermore, at this time, the clearance δ2 becomes having a space wider than in the initial state. Moreover, the front end portion 505*a* of the shutter sheet 505 is configured to come into abutting contact with the outer circumference portion 501*b* of the supplying base 501 without moving away from the outer circumference portion 501*b*.

Additionally, when the user rotates the supplying base 501 in the direction of arrow z1, as illustrated in FIG. 22A, the toner discharge port 501*r* and the toner supply port 32*r* are opened without being covered by the shutter sheet 505 and the shutter member 507. Then, toner stored in the toner pack 40 is supplied into the developing container 32 through the toner discharge port 501*r* and the toner supply port 32*r*. During such supplying of toner, the base seal 506 prevents or reduces the entry of toner to the interface between the base seal 506 and the supplying base 501.

Figure 22B:
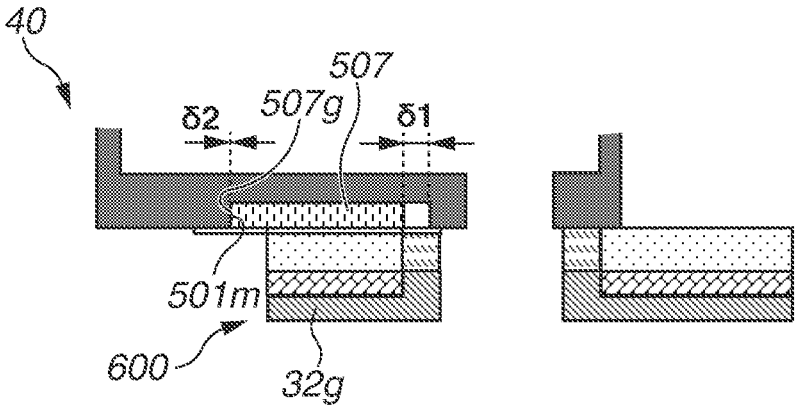
FIG. 22B is a sectional view illustrating a state in which the supplying base has rotated a predetermined angle from the state illustrated in FIG. 22A.

Next, in the case of detaching the toner pack 40 after completion of discharging of toner from the toner pack 40, as illustrated in FIG. 22B, the user rotates the supplying base 501 by an angle θ3 (0°<θ3<90°) in the direction of arrow z2 (to the right in a plane of paper) from the state illustrated in FIG. 22A. With this rotation, the step portion 501*m* of the supplying base 501 comes into contact with the end surface 507*g* of the shutter member 507, so that the clearance δ2, which has existed in the state illustrated in FIG. 22A, disappears. Then, the end surface 507*g* is pressed by the step portion 501*m*, so that the supplying base 501 and the shutter member 507 integrally rotate in the direction of arrow z2. Furthermore, at this time, the clearance δ1 becomes having a space wider than in the initial state.

Figure 23A:
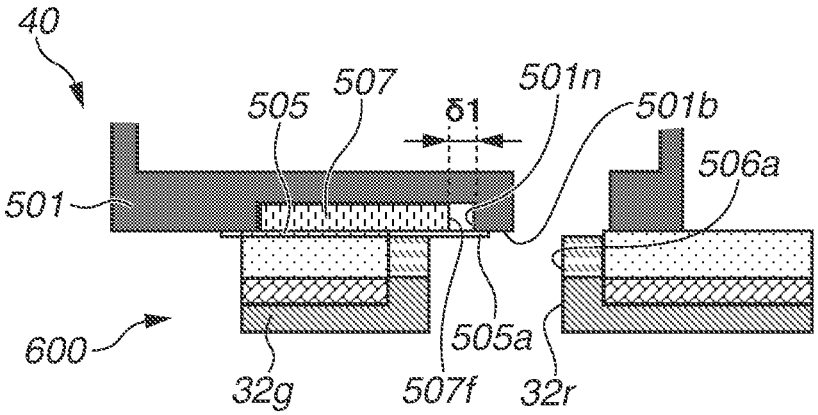
FIG. 23A is a sectional view illustrating a state in which the supplying base has rotated a predetermined angle from the state illustrated in FIG. 22B.

Additionally, when the user rotates the supplying base 501 in the direction of arrow z2, as illustrated in FIG. 23A, the clearance δ1, which is formed by the step portion 501*n* of the supplying base 501 and the end surface 507*f* of the shutter member 507, becomes situated above the toner supply port 32*r*. At this time, since the front end portion 505*a* of the shutter sheet 505 is in abutting contact with the outer circumference portion 501*b* of the supplying base 501, it is possible to prevent or reduce the entry of toner to the clearance δ1.

Figure 23B:
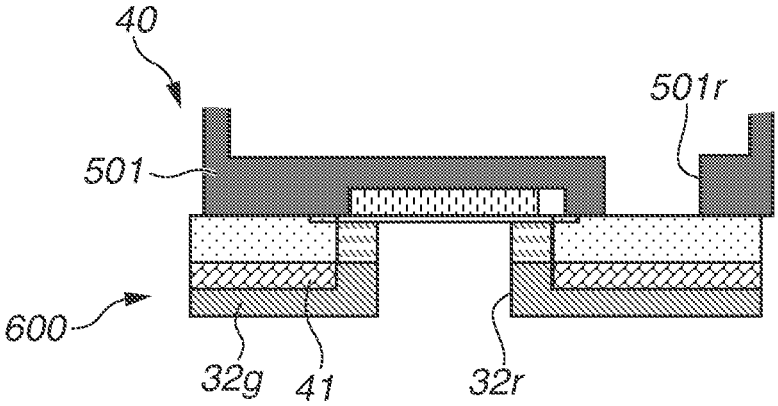
FIG. 23B is a sectional view illustrating a state in which the toner supplying port and the toner discharging port have been shielded.

When the user further rotates the supplying base 501 in the direction of arrow z2, as illustrated in FIG. 23B, the toner discharge port 501*r* is shielded by the seal member 504 and the toner supply port 32*r* is shielded by the shutter sheet 505 and the shutter member 507. Furthermore, in this state, it is possible to disengage the toner pack 40 from the cylindrical portion 32*g* of the developing container 32, and, when the toner pack 40 is disengaged from the cylindrical portion 32*g*, the state illustrated in FIG. 23B returns to the state illustrated in FIG. 21A.

<Display portion and Operation portion>

The display portion 350, the operation portion 300, and the arrangement of them are described with reference to FIG. 24, FIG. 25, FIG. 26, and FIG. 27.

Figure 24:
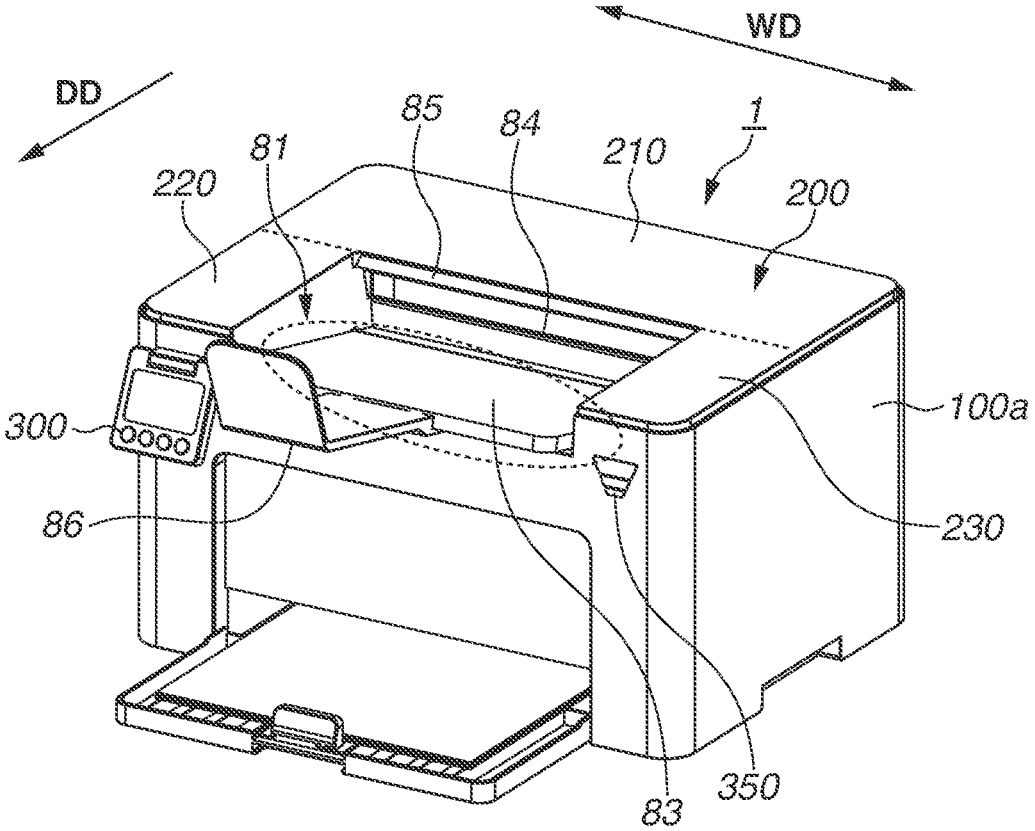
FIG. 24 is a perspective view illustrating an image forming apparatus according to a comparative example.
Figure 25:
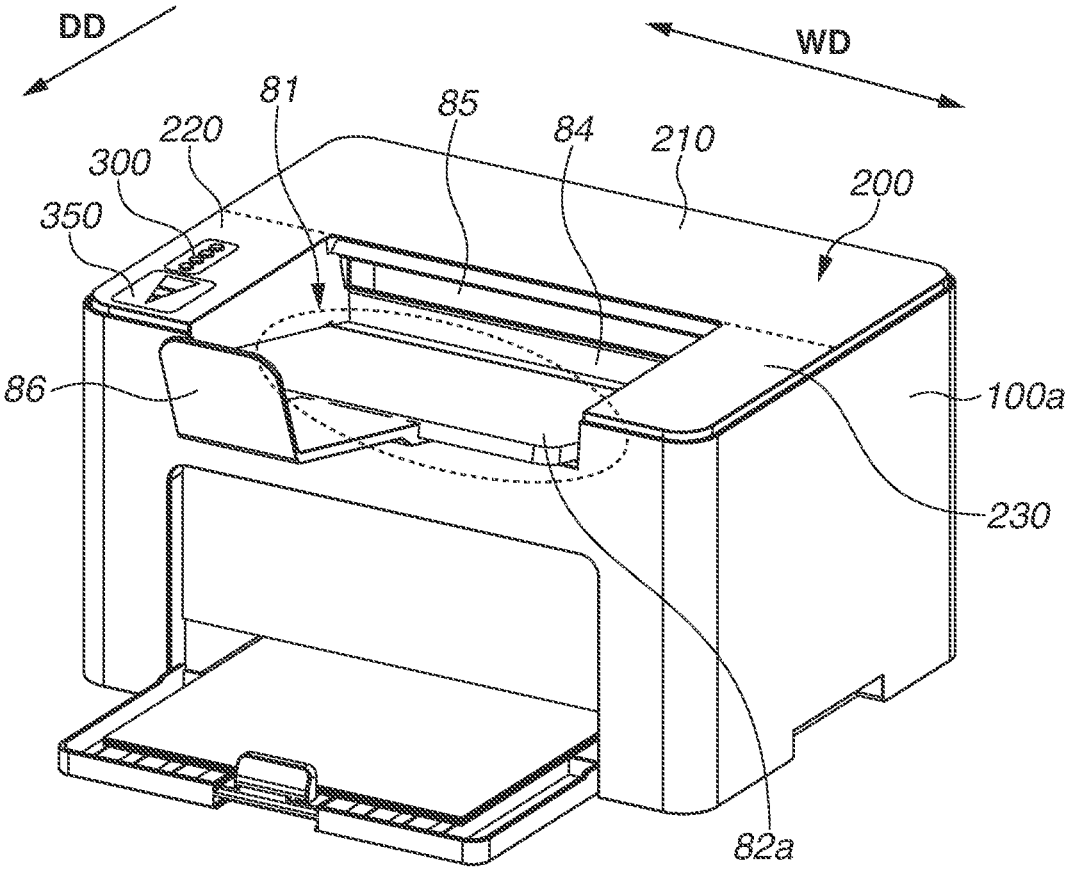
FIG. 25 is a perspective view illustrating the image forming apparatus according to the first exemplary embodiment.
Figure 26:
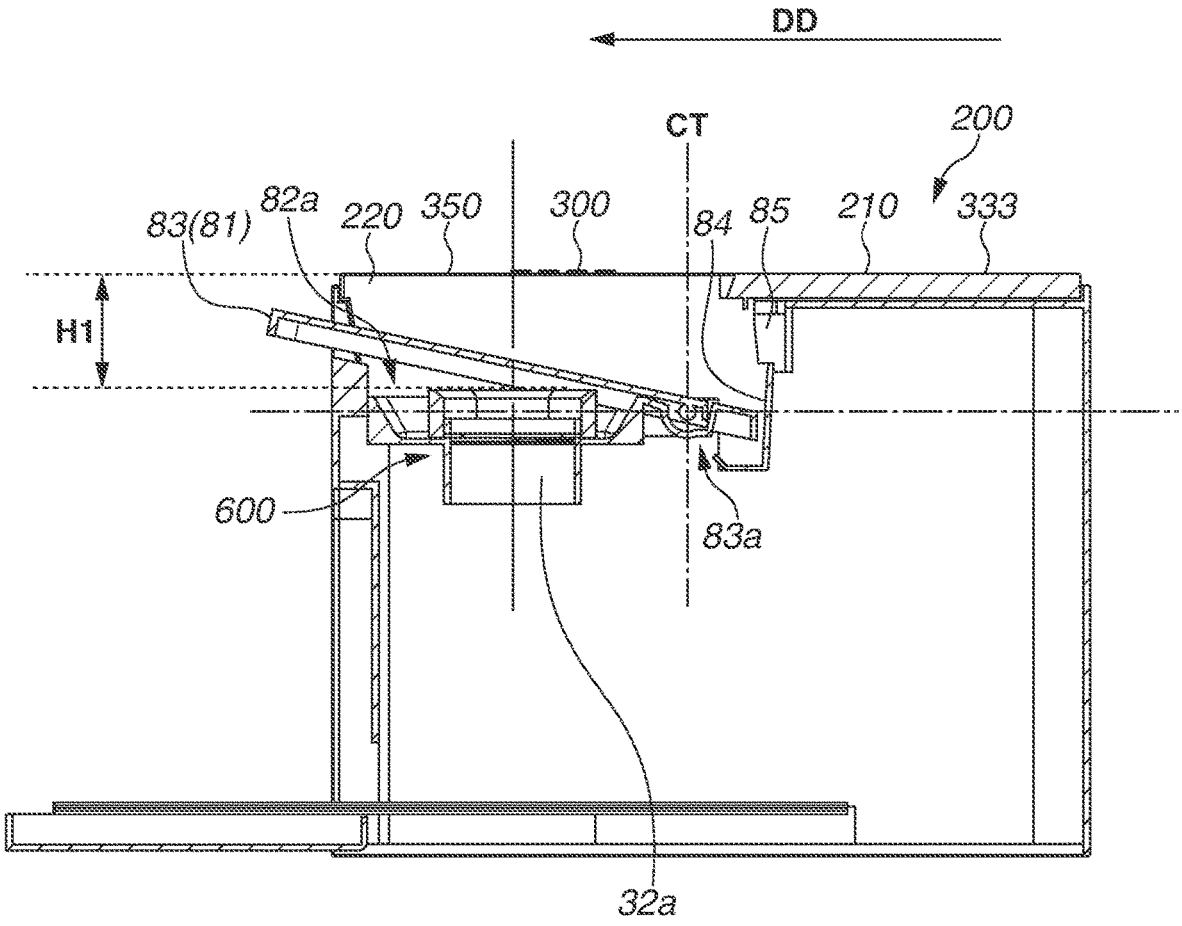
FIG. 26 is a sectional view illustrating the image forming apparatus according to the first exemplary embodiment.
Figure 27:
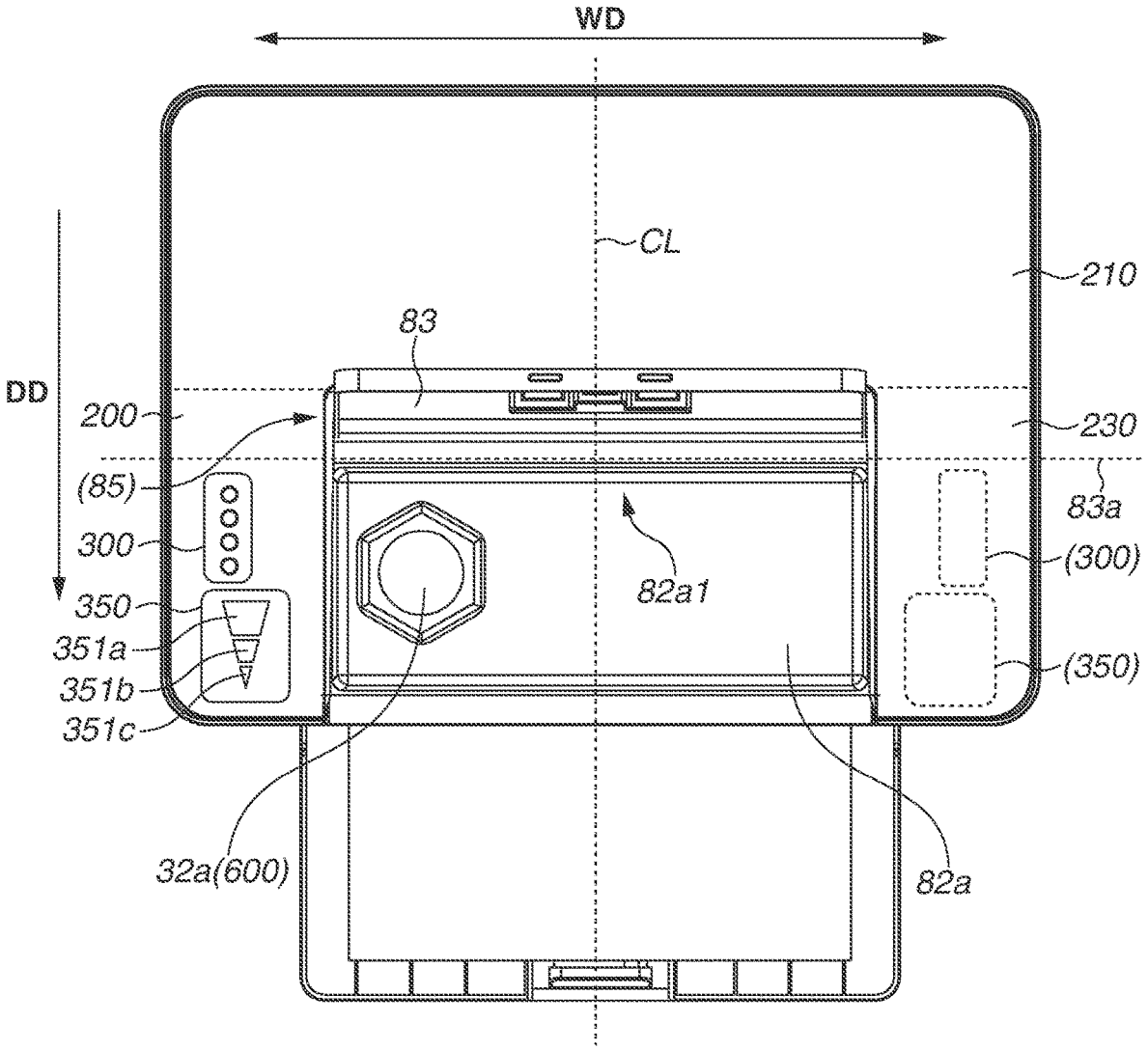
FIG. 27 is a plan view illustrating a state in which an opening and closing member of the image forming apparatus according to the first exemplary embodiment has been opened.

FIG. 24 is a perspective view illustrating an image forming apparatus according to a comparative example. FIG. 25 is a perspective view illustrating the image forming apparatus 1 according to the first exemplary embodiment. FIG. 26 is a sectional view of the image forming apparatus 1 according to the first exemplary embodiment. FIG. 27 is a plan view illustrating a state in which the opening and closing member 83 of the image forming apparatus 1 according to the first exemplary embodiment has been opened.

FIG. 24 and FIG. 25 each illustrate a state in which the opening and closing member 83 has been closed (a state in which the opening and closing member 83 is present in the closed position). FIG. 26 is a view as viewed along a width direction perpendicular to the discharging direction of a recording material P from the discharge port 85 and parallel to the horizontal direction. Moreover, in the first exemplary embodiment, the width direction WD is parallel to the direction of a rotational axis line 83*a* of the opening and closing member 83. FIG. 27 is a view of the image forming apparatus 1 as viewed along the vertical direction from above in the vertical direction. In these figures, the arrow DD indicates the discharging direction. In these figures, the arrow WD indicates the width direction.

The display portion 350 is configured to display information to the user of the image forming apparatus 1. It is favorable that the display portion 350 includes a light emitter. The light emitter includes, for example, a light source such as a light-emitting diode and a light guide which guides light emitted from the light source to the outside of the printer body 100.

The information which the display portion 350 displays in the first exemplary embodiment includes information related to the amount of toner stored in the storage portion 36 of the developing container 32. In the first exemplary embodiment, the display portion 350 is able to display the amount of toner stored in the developing container 32. The display portion 350 is also able to display, to the user, the progress of a toner supplying operation indicating, for example, whether additional supplying of toner is necessary or whether the toner supplying operation has been completed.

The display portion 350 in the first exemplary embodiment includes a plurality of light emitters, among which the number of light emitters that emit light varies according to a result of detection of the amount of toner stored in the storage portion 36 or a toner supplying operation performed from the toner pack 40.

The display portion 350 includes light guide portions 351*a*, 351*b*, and 351*c* which form icon shapes such as those illustrated in FIG. 27. The display portion 350 displays information to the user by switching between lighting-on, lighting-off, and blinking states of light-emitting diodes (LEDs), which are arranged in association with the light guide portions 351*a*, 351*b*, and 351*c*, according to the amount of toner stored in the storage portion 36. While, in the first exemplary embodiment, the number of light guide portions is set to three, the number of light guide portions can be two or less or can be four or more depending on the number of states to be displayed to the user. In the first exemplary embodiment, accordingly as a toner supplying operation from the toner pack 40 is performed, the number of light guide portions which are made lighting on in the display portion 350 increases. This enables the user to know that a toner supplying operation from the toner pack 40 has ended in an orderly manner. These operations of the display portion 350 are performed by the control unit 360.

In the first exemplary embodiment, the operation portion 300, via which the user operates the image forming apparatus 1, is arranged on a surface parallel to the surface on which the display portion 350 is arranged. The operation portion (first operation portion) 300 is a unit which is to be operated by the user of the image forming apparatus 1. The operation portion 300 includes, for example, a button which is able to be displaced, a detection portion which detects a contacting operation of the user, and an image displayed on the touch panel.

The operation portion 300 can include an operation portion via which to perform operations related to an image forming operation to be performed on a recording material P. The operations related to the image forming operation include, for example, an operation for starting an image forming operation to be performed on a recording material P, an operation for resuming the stopped image forming operation, and an operation for stopping the image forming operation. For example, in response to an operation performed on the operation portion 300, the control unit 360 controls the image forming apparatus 1 to perform, for example, starting, resuming, or stopping of an image forming operation.

The operation portion 300 can include an operation portion via which to perform operations related to a communication to be performed between the image forming apparatus 1 and an external apparatus. The communication includes wired communication and wireless communication, and the wireless communication includes, for example, Wi-Fi (Wireless Fidelity) and Bluetooth®. Examples of the external apparatus include a personal computer, a smartphone, a camera, and a router. The operations related to a communication to be performed between the image forming apparatus 1 and an external apparatus include an operation for establishing communication between the image forming apparatus 1 and the external apparatus. For example, in response to an operation performed on the operation portion 300, the control unit 360 can cause an output unit to output a signal for establishing communication between the image forming apparatus 1 and an external apparatus.

The operation portion 300 can include an operation portion via which to perform an operation related to at least one of start-up and shut-off of the image forming apparatus 1. Specifically, the operation portion 300 can include a power button of the image forming apparatus 1.

In the comparative example illustrated in FIG. 24, the operation portion 300 and the display portion 350 are arranged at a front surface portion of the image forming apparatus 1, which is arranged on the downstream side in the discharging direction with respect to the discharge port 85.

On the other hand, in the first exemplary embodiment illustrated in FIG. 25, the operation portion 300 and the display portion 350 are arranged at a top portion 200. The top portion 200 is a surface extending in a direction intersecting with the vertical direction. While, in the first exemplary embodiment, the top portion 200 extends in a direction perpendicular to the vertical direction (in a direction parallel to the horizontal direction), a part or the whole of the top portion 200 can be inclined with respect to the horizontal direction. As illustrated in FIG. 1, the top portion 200 is located above the supplying port 32*a* of the toner receiving portion 600 with respect to the vertical direction.

The top portion 200 includes a first region 210, a first extension portion 220, and a second extension portion 230. The first region 210, the first extension portion 220, and the second extension portion 230 are arranged on the same plane. The first extension portion 220 extends from the first region 210 toward the discharging direction DD. The second extension portion 230 extends from the first region 210 toward the discharging direction DD. At least a part of the first region 210 is located on the upstream side of the discharge port (discharge portion) 85 with respect to the discharging direction DD.

As understandable from FIG. 25, FIG. 26, and FIG. 27, as viewed along the vertical direction, at least a part of the opening and closing member 83 is located between the first extension portion 220 and the second extension portion 230, and is arranged in such a way as to be sandwiched between the first extension portion 220 and the second extension portion 230.

The opening and closing member 83 is configured to be rotatable (swingable) around the rotational axis line 83*a*. The rotational axis line 83*a* extends in a direction intersecting with the discharging direction DD. In the first exemplary embodiment, the direction of the rotational axis line 83*a* is parallel to the width direction WD.

As illustrated in FIG. 26, as viewed along the width direction WD, the opening and closing member 83 being in the closed position overlaps a side wall which extends downward from the first extension portion 220. Moreover, with regard to the opening and closing member 83 being in the opened position, at least a part thereof also overlaps the side wall which extends downward from the first extension portion 220. Furthermore, the second extension portion 230 has a shape similar to that of the first extension portion 220. Accordingly, as viewed along the width direction WD, the opening and closing member 83 and a side wall which extends downward from the second extension portion 230 similarly overlap each other.

When the opening and closing member 83 is present in the opened position, the opening and closing member 83 extends upward from its tail edge to its front edge. At this time, the front edge of the opening and closing member 83 is located at a position higher than the top portion 200.

As viewed along the vertical direction, at least one of the display portion 350 and the operation portion 300 is arranged on the downstream side of the rotational axis line 83*a* with respect to the discharging direction DD. In the first exemplary embodiment, the display portion 350 and the operation portion 300 are arranged on the downstream side of the rotational axis line 83*a* with respect to the discharging direction DD. Thus, as illustrated in FIG. 26, as viewed along a direction of the rotational axis line 83*a*, the display portion 350 and the operation portion 300 are arranged on the more downstream side in the discharging direction DD than a vertical line CT passing through the rotational axis line 83*a*.

Moreover, at least one of the display portion 350 and the operation portion 300 is arranged at the first extension portion 220. In the first exemplary embodiment, as illustrated in FIG. 2 and FIG. 26, the display portion 350 and the operation portion 300 are arranged at the first extension portion 220 of the top portion 200, which is away from the supplying port 32*a* by a height H1. The supplying port 32*a* is opened upward in the vertical direction, and a normal line to the first extension portion 220 is approximately equal to a direction toward which the supplying port 32*a* is opened. In the first exemplary embodiment, the direction toward which the supplying port 32*a* is opened is the same as the direction of a normal line to the upper wall 82*a*, and the toner pack 40 is attached to the supplying port 32*a* along the direction of a normal line to the upper wall 82*a*.

Moreover, in the width direction WD, which is perpendicular to the discharging direction DD and parallel to the horizontal direction, the supplying port 32*a* of the toner receiving portion 600, the operation portion 300, the display portion 350, and the first extension portion 220 are arranged on one end side with respect to the central portion CL of the discharge tray 81 (the same as the central portion of the opening and closing member 83). Thus, in the width direction WD, the operation portion 300, the display portion 350, and the first extension portion 220 are present on the same side as the supplying port 32*a* with respect to the central portion CL of the discharge tray 81.

Additionally, as viewed along the vertical direction, in the discharging direction DD, at least one of the operation portion 300 and the display portion 350 is arranged on the downstream side of an upstream end 82*a*1 of the upper wall 82*a* and the discharge port 85. In the first exemplary embodiment, the operation portion 300 and the display portion 350 are arranged on the downstream side of the upstream end 82*a*1 of the upper wall 82*a* and the discharge port 85. Additionally, the supplying port 32*a* of the toner receiving portion 600 is also arranged on the downstream side of the upstream end 82*a*1 of the upper wall 82*a* and the discharge port 85.

Moreover, as viewed along the vertical direction, in the discharging direction DD, at least one of the operation portion 300 and the display portion 350 is arranged on the downstream side of the opening and closing member 83 being in the opened position. In the first exemplary embodiment, the operation portion 300 and the display portion 350 are arranged on the downstream side of the opening and closing member 83 being in the opened position. Additionally, the supplying port 32*a* of the toner receiving portion 600 is also arranged on the downstream side of the opening and closing member 83 being in the opened position.

Accordingly, it is possible to improve the visibility of the supplying port 32*a* of the toner receiving portion 600, the display portion 350, and the operation portion 300.

The supplying port 32*a* of the toner receiving portion 600 is opened upward in the vertical direction. The upper wall 82*a* and the top portion 200 are surfaces facing upward in the vertical direction. Thus, each of the direction of a normal line to the top portion 200 and a direction toward which the supplying port 32*a* is opened is a direction intersecting with the horizontal direction. Arranging the operation portion 300 and the display portion 350 on the top portion 200 enables the user to visually recognize the supplying port 32*a*, the display portion 350, and the operation portion 300 from one direction. Thus, the user is able to, while viewing the image forming apparatus 1 from above in the vertical direction, perform attaching of the toner pack 40 to the supplying port 32*a*, an operation on the operation portion 300, and checking of the display portion 350. As a result, since the movement of the user's line of sight is small, it is possible to improve usability.

In a comparative example such as that illustrated in FIG. 24, the number of surfaces to which the user pays attention when performing, for example, a toner supplying operation is two, i.e., an upper surface and a front surface. On the other hand, in the image forming apparatus 1 according to the first exemplary embodiment, the number of surfaces to which the user pays attention when performing, for example, a toner supplying operation is one, i.e., a front surface. Accordingly, since the movement of the user's line of sight is small, it is possible to improve usability.

Furthermore, the operation portion 300 and the display portion 350 can be arranged at positions indicated by dashed lines in FIG. 27 on a side opposite to the supplying port 32*a* in the width direction WD. However, as in the first exemplary embodiment, arranging the operation portion 300 and the display portion 350 on the same side as the supplying port 32*a* in the width direction WD enables reducing the movement distance of the user's line of sight during a toner supplying operation, and is, therefore, more favorable in terms of usability.

In the first exemplary embodiment, the operation portion 300 and the display portion 350 are arranged on the top portion 200. Accordingly, it is possible to make the operation portion 300 and the display portion 350 readily visible by the user as compared with a case where the operation portion 300 and the display portion 350 are arranged on, for example, a side surface of the image forming apparatus 1.

Moreover, the operation portion 300 and the display portion 350 are arranged on the first extension portion 220. This enables preventing or reducing the visibility of the operation portion 300 and the display portion 350 from decreasing even when the opening and closing member 83 is present in the opened position. In the first exemplary embodiment, the operation portion 300 and the display portion 350 are arranged on the downstream side of the rotational axis line 83*a* of the opening and closing member 83. Accordingly, it is possible to further prevent or reduce the visibility of the operation portion 300 and the display portion 350 from decreasing even when the opening and closing member 83 is present in the opened position.

In the first exemplary embodiment, in the width direction WD, the operation portion 300 and the display portion 350 are arranged on the same side with respect to the central portion CL of the discharge tray 81 (the central portion of the opening and closing member 83). Accordingly, it is possible to arrange the display portion 350, the operation portion 300, and internal components of the printer body 100 related to the display portion 350 and the operation portion 300 in a space-saving manner as compared with a case where the operation portion 300 is arranged on one side and the display portion 350 is arranged on the other side with respect to the central portion of the discharge tray 81.

Moreover, in the first exemplary embodiment, in the width direction WD, the operation portion 300, the display portion 350, and the supplying port 32*a* are arranged on the same side with respect to the central portion CL of the discharge tray 81 (the central portion of the opening and closing member 83). Accordingly, it is possible to arrange the operation portion 300, the display portion 350, the supplying port 32*a*, and internal components of the printer body 100 related to the operation portion 300, the display portion 350, and the supplying port 32*a* in a space-saving manner.

Arranging the display portion 350 and the operation portion 300 in proximity to each other enables arranging the display portion 350, the operation portion 300, and internal components of the printer body 100 related to the display portion 350 and the operation portion 300 in a space-saving manner. Moreover, arranging the display portion 350 and the operation portion 300 in proximity to each other enables performing attaching of the toner pack 40 to the supplying port 32*a*, checking of the display portion 350, and an operation on the operation portion 300 in near positions, and thus enables improving usability of the image forming apparatus 1.

A second exemplary embodiment of the present disclosure is described with reference to FIG. 30. The second exemplary embodiment is an embodiment configured by replacing the shutter member 507 of the toner receiving portion 600 in the first exemplary embodiment with a shutter member 507B. Therefore, constituent elements similar to those of the first exemplary embodiment are described while being omitted from illustration or assigned the respective same reference characters in FIG. 30 as those in the first exemplary embodiment.

Figure 15:
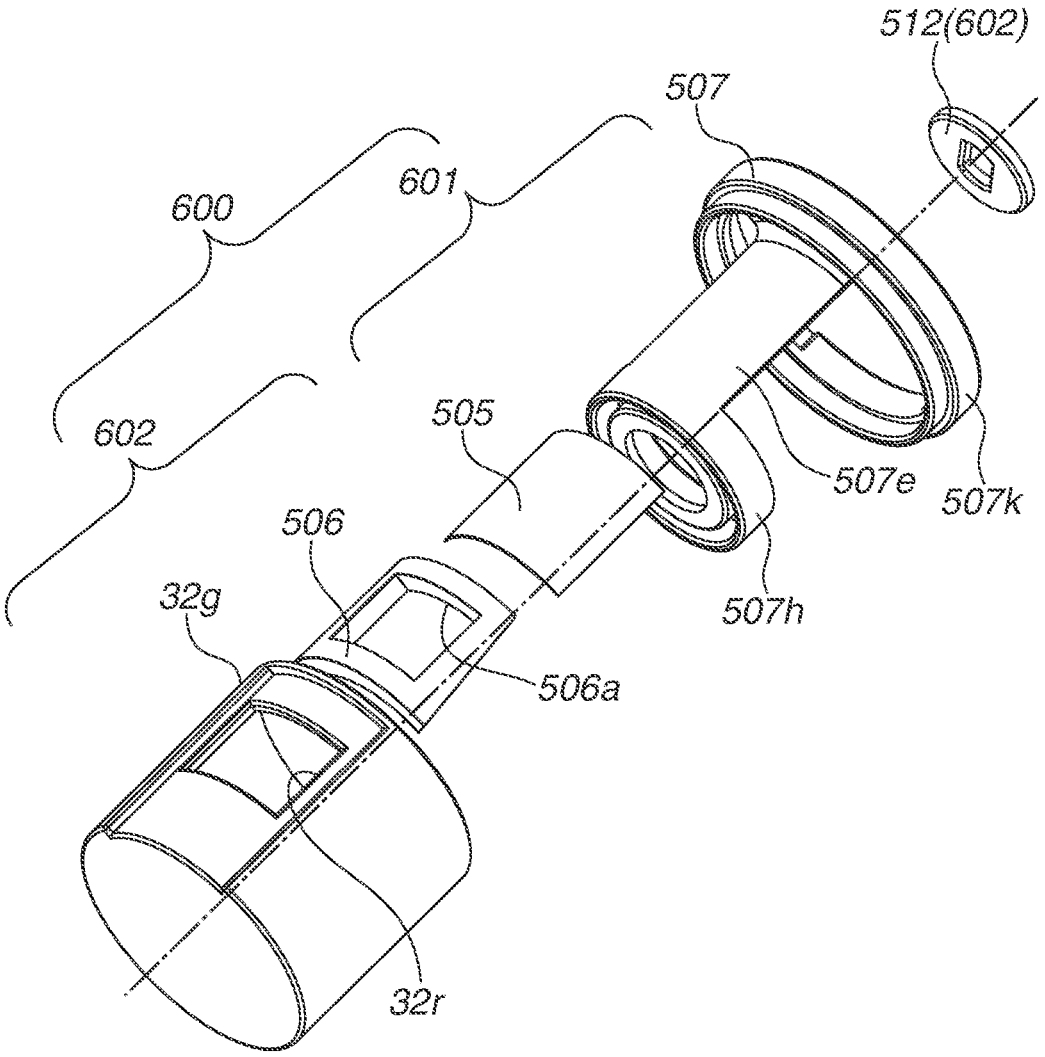
FIG. 15 is an exploded perspective view illustrating the toner receiving portion.

The shutter member 507B in the second exemplary embodiment includes, as illustrated in FIG. 15, an inner diameter portion 507*h*, an outer diameter portion 507*k*, and a projecting portion 507*e* as with the first exemplary embodiment. The shutter member 507B in the second exemplary embodiment further includes a fitting portion 513 in addition to the shutter member 507 in the first exemplary embodiment.

Figure 28A:
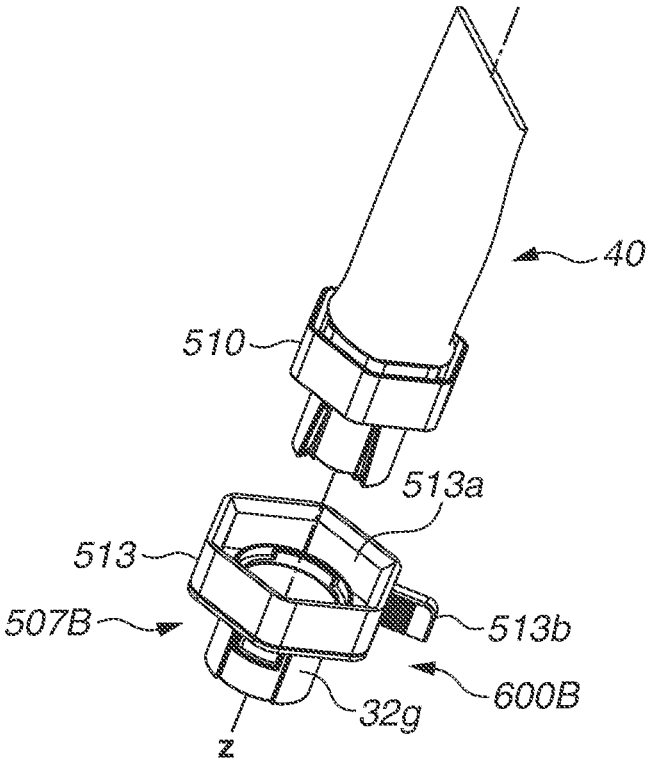
FIG. 28A is an exploded perspective view illustrating a toner pack according to a second exemplary embodiment.
Figure 28B:
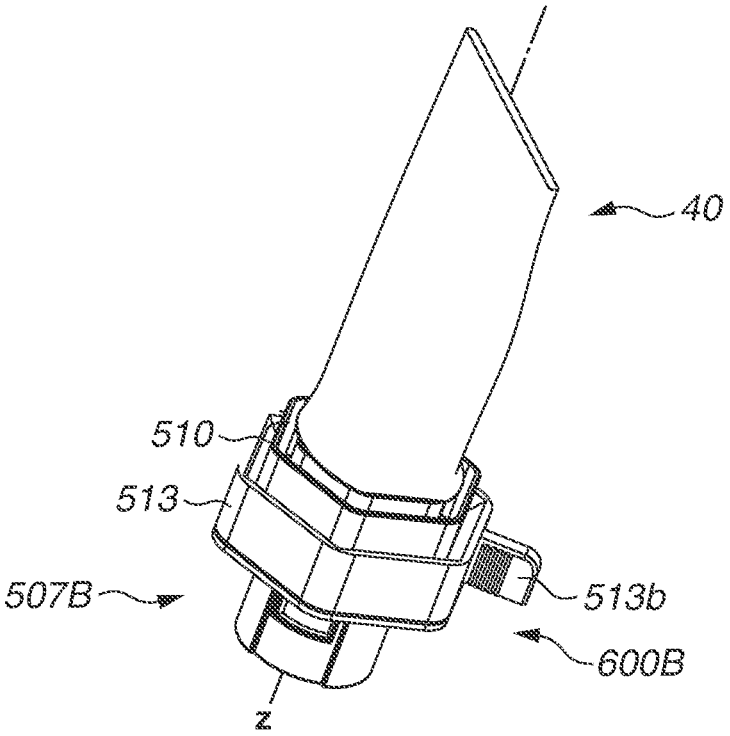
FIG. 28B is a perspective view illustrating the toner pack according to the second exemplary embodiment.
Figure 29:
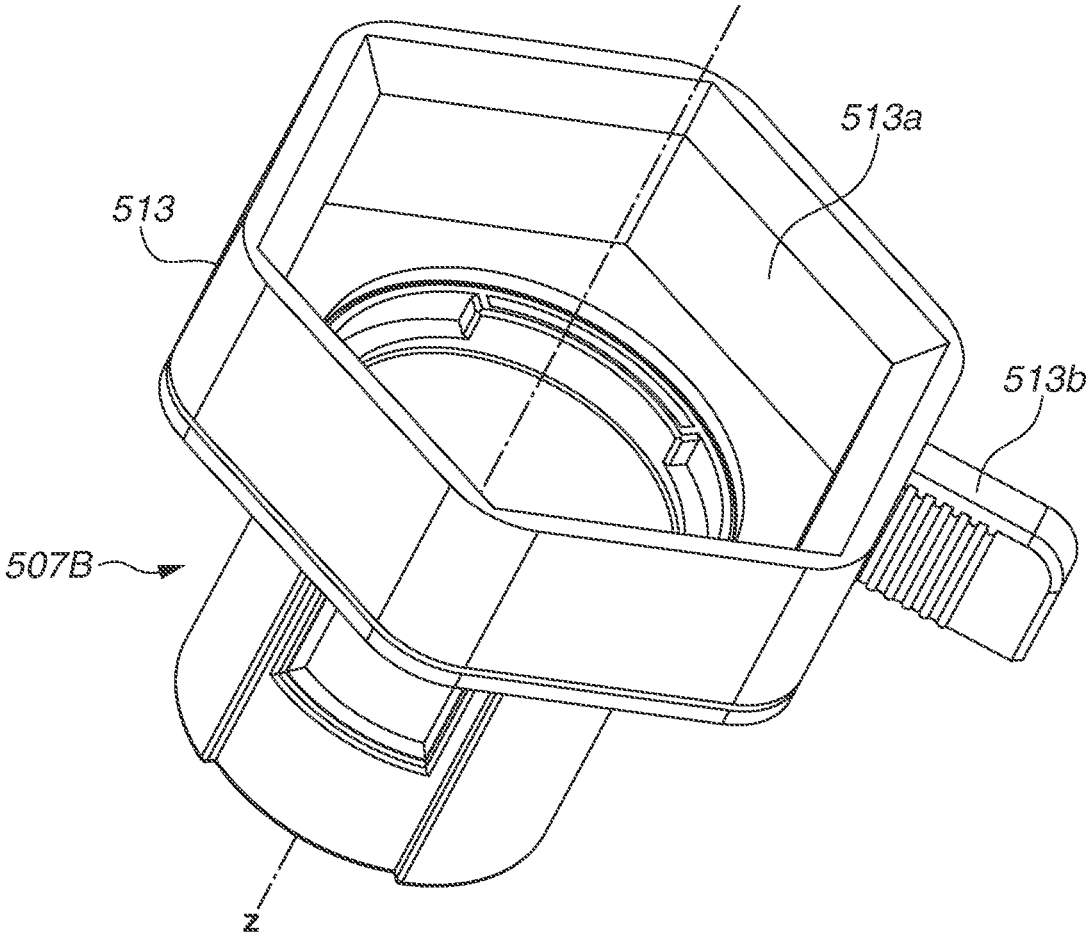
FIG. 29 is an enlarged perspective view illustrating a shutter member according to the second exemplary embodiment.

The fitting portion 513 of the shutter member 507B includes, as illustrated in FIGS. 28A and 28B and FIG. 29, an approximately hexagonally shaped opening portion 513*a*, with which the outer ring member 510 of the toner pack 40 is engaged, and a lever portion (second operation portion) 513*b*, which is able to be rotationally operated by the user.

Figure 30:
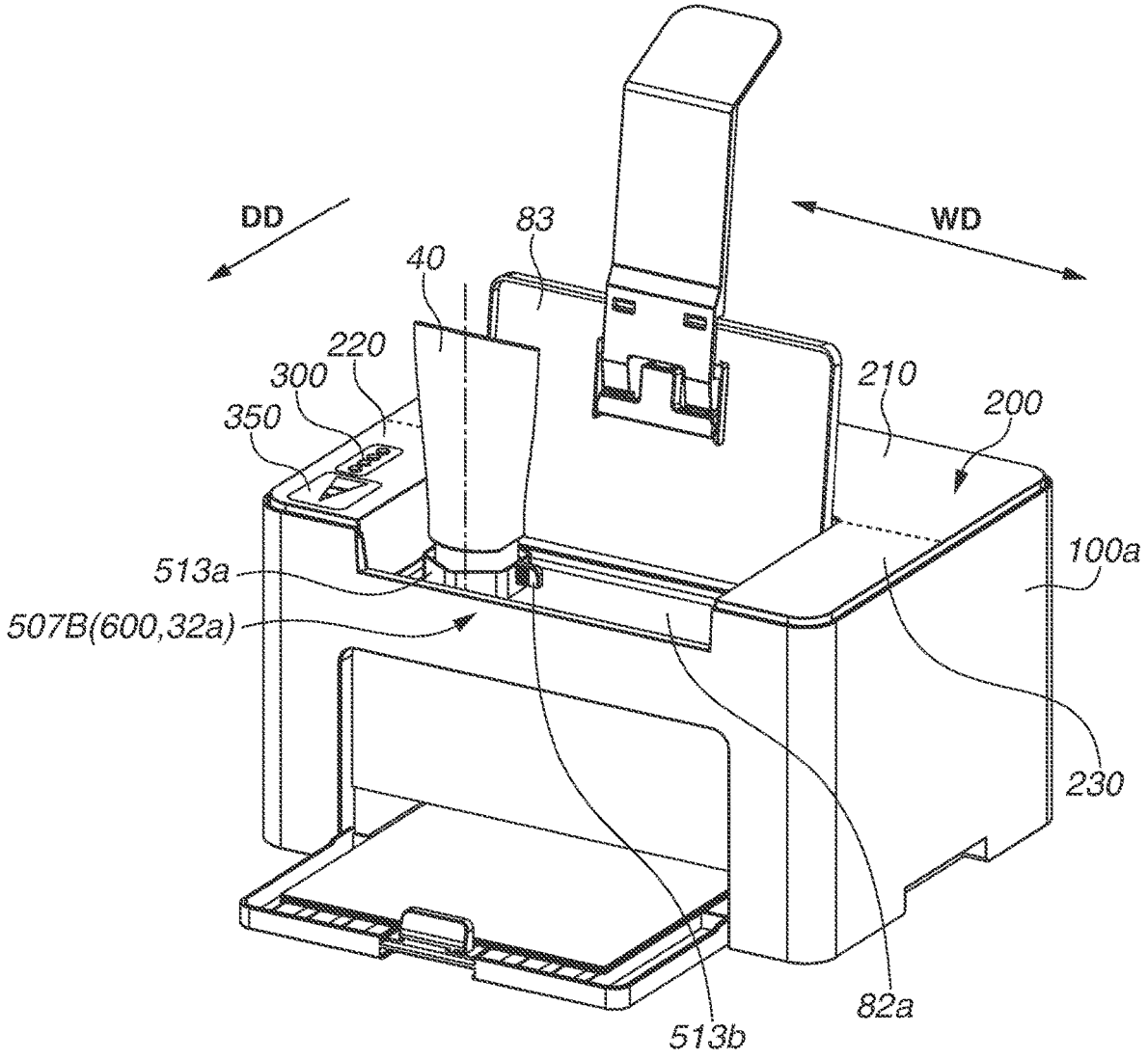
FIG. 30 is a perspective view illustrating an image forming apparatus according to the second exemplary embodiment.

FIG. 30 is a perspective view illustrating an image forming apparatus 1 according to the second exemplary embodiment. The image forming apparatus 1 has configurations and functions basically similar to those of the image forming apparatus 1 in the first exemplary embodiment except for the shutter member 507B.

The fitting portion 513 of the shutter member 507B is exposed outside via the upper wall 82*a*. When supplying toner to the developing container 32 (see FIG. 1), the user fits the toner pack 40 into the opening portion 513*a* of the fitting portion 513. More specifically, the user fits the outer ring member 510 of the toner pack 40 into the opening portion 513*a* of the fitting portion 513.

Then, the user operates the lever portion 513*b*, which is exposed outside from the upper wall 82*a*, to rotate the lever portion 513*b* around the rotational axis line z (see FIG. 28B). This causes the shutter member 507B and the rotary container unit 401 (see FIG. 5) of the toner pack 40 to rotate, so that the toner pack 40 and a toner receiving portion 600B transition from a shielded state to an opened state. As a result, it is possible to supply toner stored in the toner pack 40 to the developing container 32.

As described above, in the second exemplary embodiment, not operating the outer ring member 510 as in the first exemplary embodiment but operating the lever portion 513*b* of the shutter member 507B enables causing the toner pack 40 and the toner receiving portion 600B to transition from a shielded state to an opened state.

Since a space required for grasping the lever portion 513*b* only needs to be smaller than a space required for grasping the outer ring member 510, for example, even when the upper wall 82*a* is small, the operability of the lever portion 513*b* is good, so that it is possible to improve usability.

A third exemplary embodiment of the present disclosure is described with reference to FIG. 31. The third exemplary embodiment is an embodiment configured by replacing the display portion 350 in the second exemplary embodiment with a display portion 350*b*. Therefore, constituent elements similar to those of the first exemplary embodiment and the second exemplary embodiment are described while being omitted from illustration or assigned the respective same reference characters in FIG. 31 as those in the first exemplary embodiment and the second exemplary embodiment.

Figure 31:
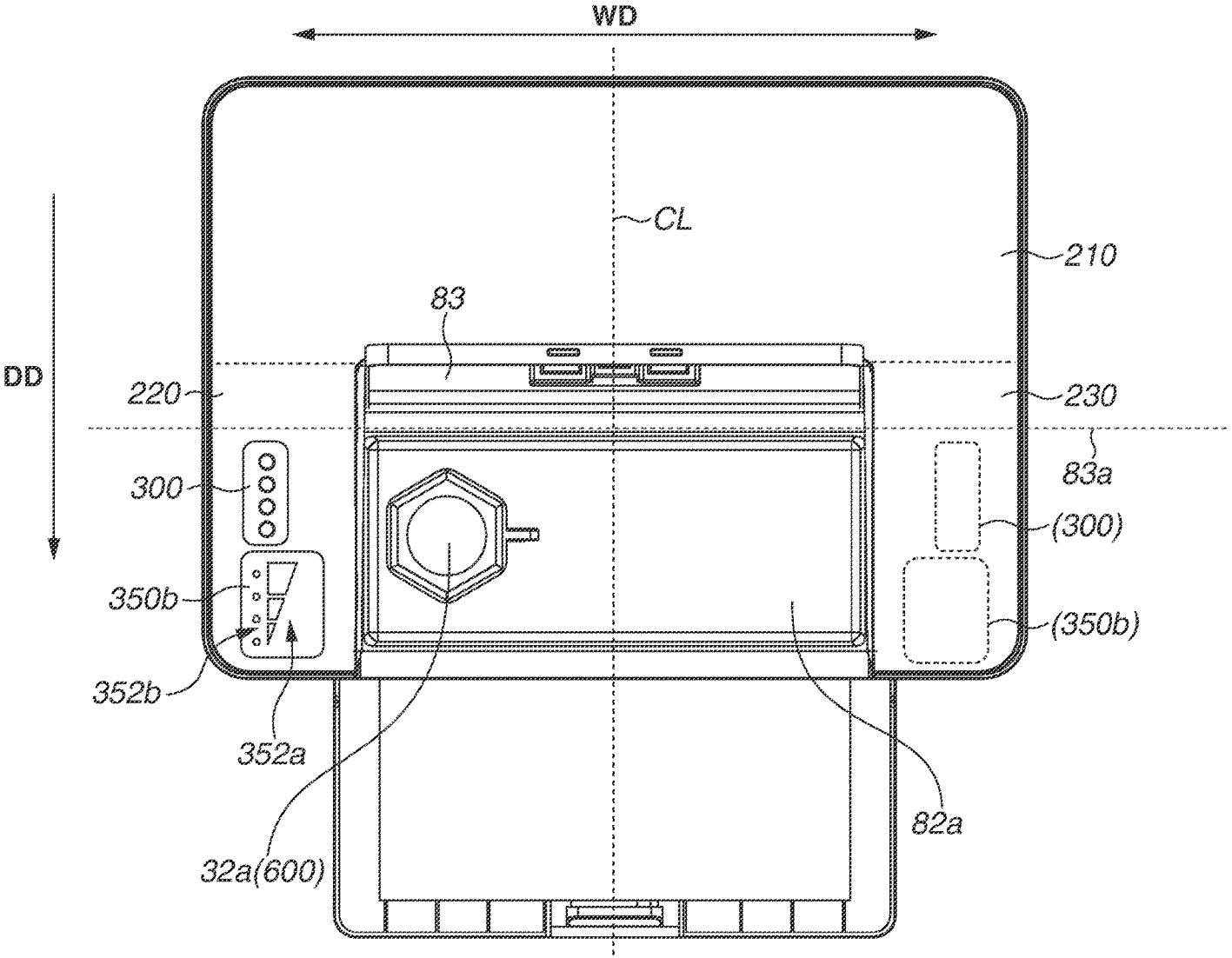
FIG. 31 is a plan view illustrating a state in which an opening and closing member of an image forming apparatus according to a third exemplary embodiment has been opened.

FIG. 31 is a plan view of an image forming apparatus according to the third exemplary embodiment, and is a view as viewed along the vertical direction as with FIG. 27.

In the first exemplary embodiment and the second exemplary embodiment, the display portion 350 includes the light guide portions 351*a* to 351*c*. In the third exemplary embodiment, the display portion 350*b* includes, as separate members, an icon portion 352*a*, which indicates the remaining amount of toner stored in the storage portion 36, and a light guide member 352*b*. The function of the light guide member 352*b* can be made the same as those of the light guide portions 351*a* to 351*c*. Accordingly, it is possible to more simplify the shape of the light guide member 352*b*. Furthermore, both the light guide member 352*b* and the icon portion 352*a* can be configured to perform emission of light. At that time, colors of light to be emitted from the light guide member 352*b* and the icon portion 352*a* can be made different from each other.

While, in the third exemplary embodiment, the light guide member 352*b* includes four elements, the number of elements of the light guide member 352*b* can be set to three or less or five or more depending on the number of pieces of information intended to be provided to the user.

Moreover, the display portion 350*b* and the operation portion 300 can be arranged at positions indicated by dashed lines illustrated in FIG. 31.

A fourth exemplary embodiment of the present disclosure is described with reference to FIG. 32. The fourth exemplary embodiment is an embodiment configured by replacing the display portion 350 in the second exemplary embodiment with a display portion 350*c*. Therefore, constituent elements similar to those of the first exemplary embodiment and the second exemplary embodiment are described while being omitted from illustration or assigned the respective same reference characters in FIG. 32 as those in the first exemplary embodiment and the second exemplary embodiment.

Figure 32:
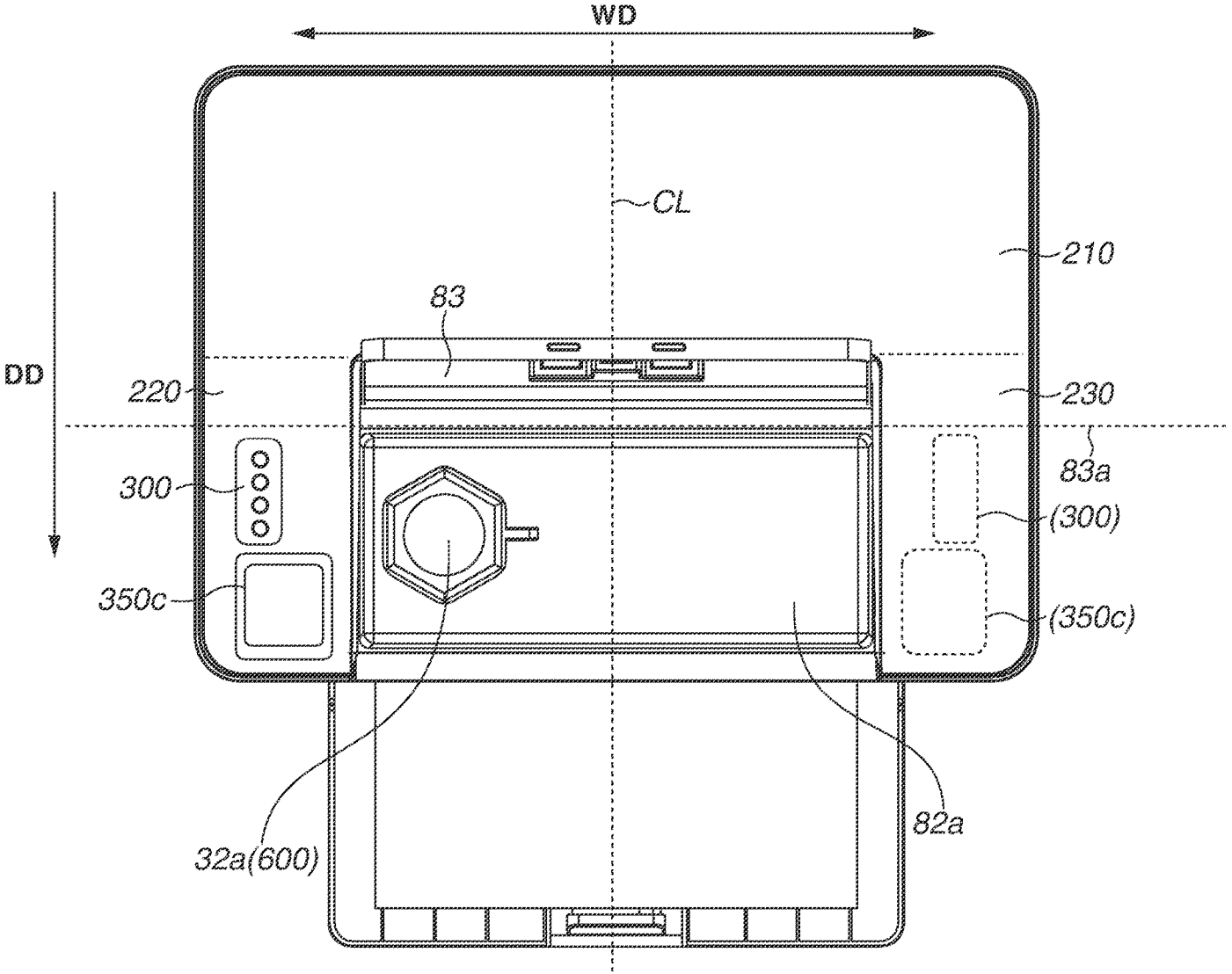
FIG. 32 is a plan view illustrating a state in which an opening and closing member of an image forming apparatus according to a fourth exemplary embodiment has been opened.

FIG. 32 is a plan view of an image forming apparatus according to the fourth exemplary embodiment, and is a view as viewed along the vertical direction as with FIG. 27.

The display portion 350*c* is a liquid crystal display which displays information to the user. The display portion 350*c* is able to display information about the amount of toner stored in the storage portion 36. Moreover, the fourth exemplary embodiment is not limited to this, and the display portion 350*c* is able to display various pieces of information to the user. For example, the display portion 350*c* can display, for example, a menu screen concerning control of the image forming apparatus 1, the status of the image forming apparatus 1, an error indication, and an instruction for a toner supplying operation from the toner pack 40 to the storage portion 36.

Moreover, the display portion 350*c* and the operation portion 300 can be arranged at positions indicated by dashed lines illustrated in FIG. 32.

A fifth exemplary embodiment of the present disclosure is described with reference to FIG. 33. The fifth exemplary embodiment is an embodiment configured by arranging the operation portion 300 in the first exemplary embodiment and the second exemplary embodiment on the upstream side of the upper wall 82*a* in the discharging direction DD. Therefore, constituent elements similar to those of the first exemplary embodiment and the second exemplary embodiment are described while being omitted from illustration or assigned the respective same reference characters in FIG. 33 as those in the first exemplary embodiment and the second exemplary embodiment.

Figure 33:
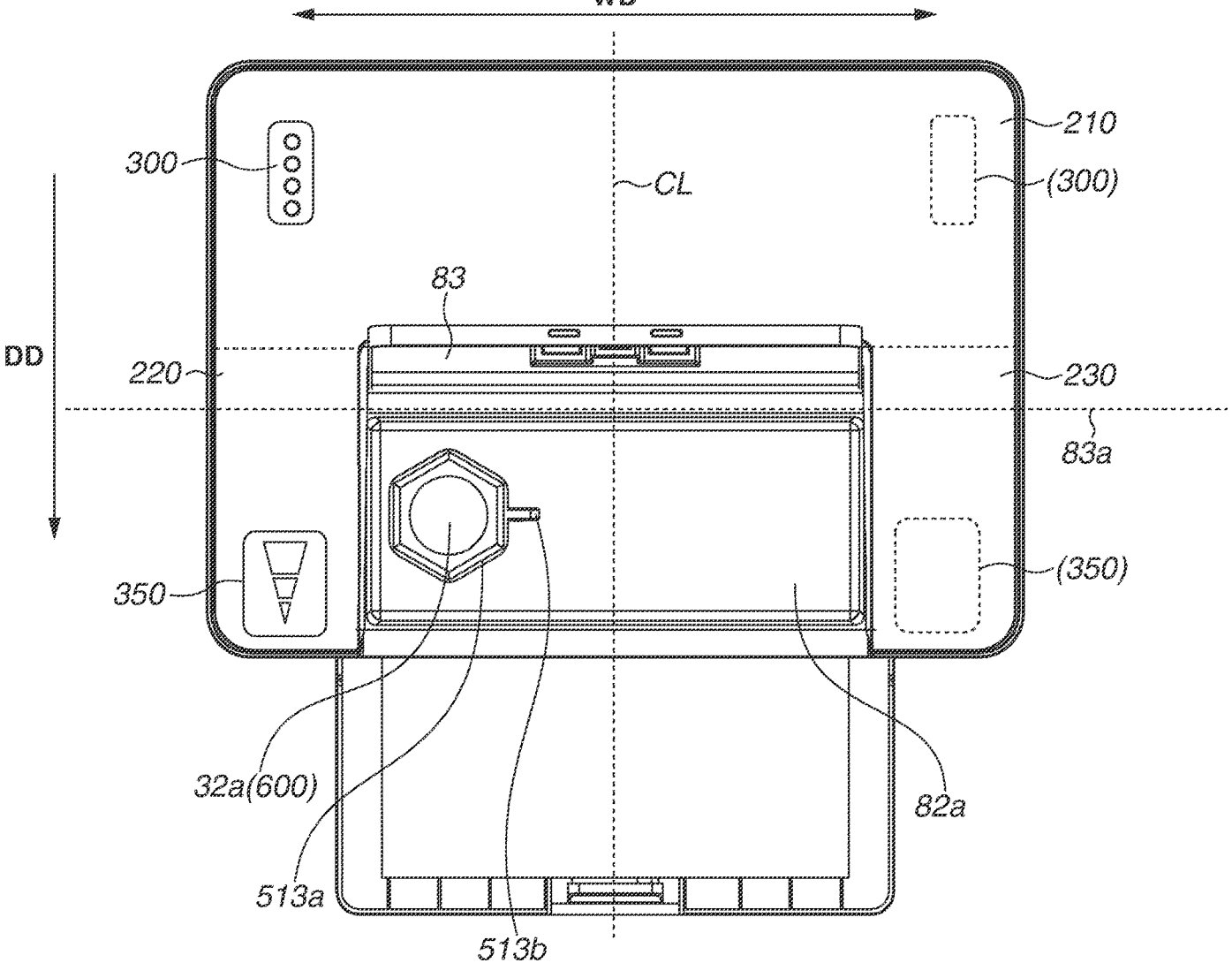
FIG. 33 is a plan view illustrating a state in which an opening and closing member of an image forming apparatus according to a fifth exemplary embodiment has been opened.

FIG. 33 is a plan view of an image forming apparatus according to the fifth exemplary embodiment, and is a view as viewed along the vertical direction as with FIG. 27.

In the fifth exemplary embodiment, the operation portion 300 is arranged at an end portion of the first region 210. In the width direction WD, which is perpendicular to the discharging direction DD and parallel to the horizontal direction, the supplying port 32*a* of the toner receiving portion 600, the operation portion 300, the display portion 350, and the first extension portion 220 are arranged on one end side with respect to the central portion CL of the discharge tray 81 (the same as the central portion of the opening and closing member 83). Thus, in the width direction WD, the operation portion 300, the display portion 350, and the first extension portion 220 are present on the same side as the supplying port 32*a* with respect to the central portion CL of the discharge tray 81.

In the fifth exemplary embodiment, it is possible to reduce a risk in which the user may mistakenly touch the operation portion 300 during a toner supplying operation to perform an unconscious operation.

Furthermore, the display portion 350 can be arranged on a side opposite to the supplying port 32*a* in the width direction WD as indicated by a dashed line illustrated in FIG. 33. However, arranging the display portion 350 on the same side as the supplying port 32*a* in the width direction WD as in the fifth exemplary embodiment enables reducing the amount of movement of the user's line of sight during a toner supplying operation, and is thus more favorable in terms of usability.

A sixth exemplary embodiment of the present disclosure is described with reference to FIG. 34. The sixth exemplary embodiment is an embodiment configured by replacing the display portion 350 and the operation portion 300 in the second exemplary embodiment with an operation panel unit 301. Therefore, constituent elements similar to those of the first exemplary embodiment and the second exemplary embodiment are described while being omitted from illustration or assigned the respective same reference characters in FIG. 34 as those in the first exemplary embodiment and the second exemplary embodiment.

Figure 34:
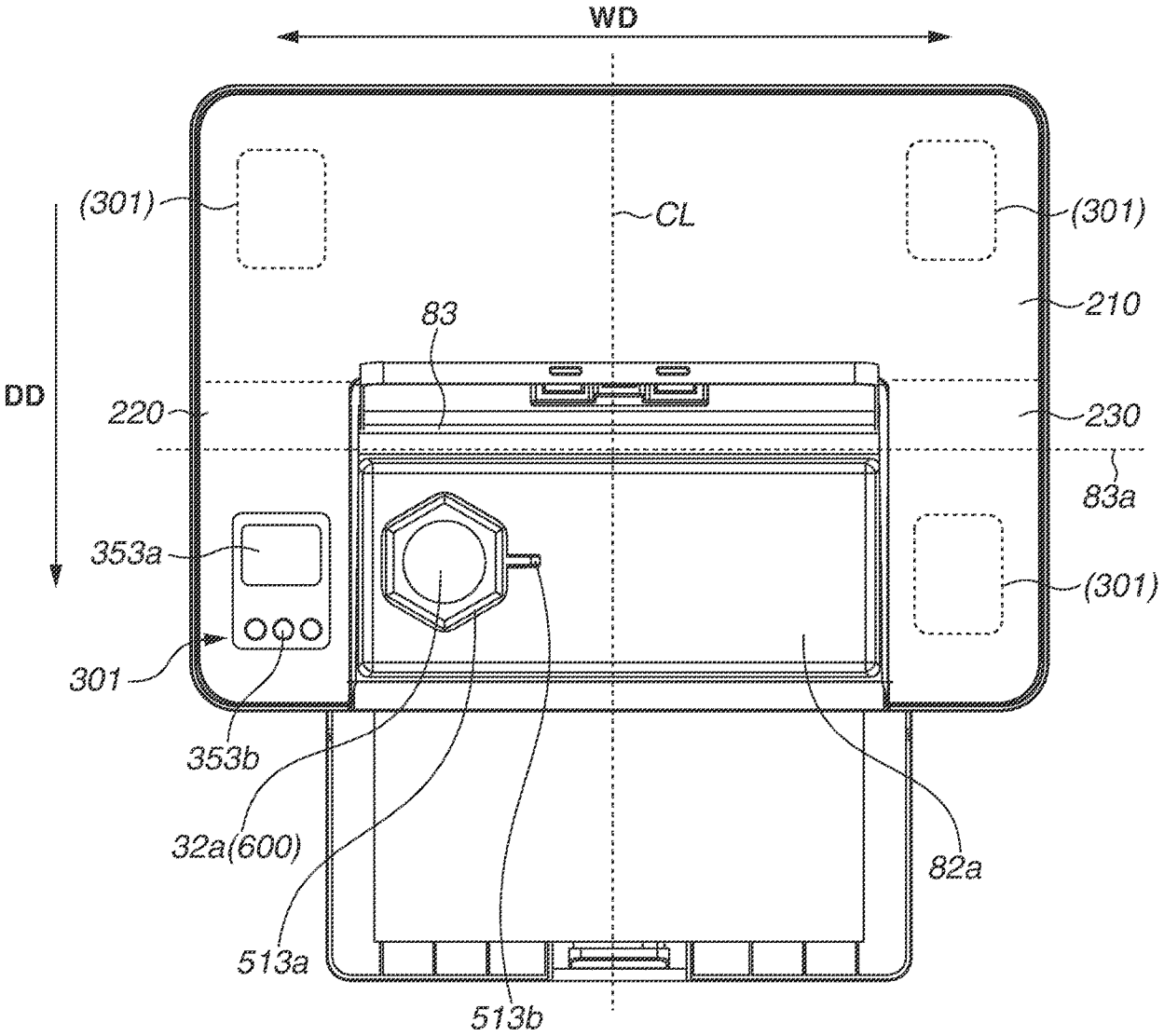
FIG. 34 is a plan view illustrating a state in which an opening and closing member of an image forming apparatus according to a sixth exemplary embodiment has been opened.

FIG. 34 is a plan view of an image forming apparatus according to the sixth exemplary embodiment, and is a view as viewed along the vertical direction as with FIG. 27.

The operation panel unit 301 includes a display portion (liquid crystal display) 353*a*, which displays information to the user, and an operation portion 353*b*. The function of the operation portion 353*b* is similar to that of the operation portion 300 in the first exemplary embodiment. The display portion 353*a* is able to display information about the amount of toner stored in the storage portion 36. Moreover, the sixth exemplary embodiment is not limited to this, and the display portion 353*a* is able to display various pieces of information. For example, the display portion 353*a* can display, for example, a menu screen concerning control of the image forming apparatus 1, the status of the image forming apparatus 1, an error indication, and an instruction for a toner supplying operation from the toner pack 40 to the storage portion 36.

Moreover, as long as information to be provided to the user is limitative, employing a configuration such as that in the first exemplary embodiment or the third exemplary embodiment enables attaining a cost reduction. Furthermore, the operation panel unit 301 can be arranged at a position indicated by a dashed line illustrated in FIG. 34.

A seventh exemplary embodiment of the present disclosure is described with reference to FIG. 35, FIG. 36, FIG. 37, FIG. 38, and FIG. 39. The seventh exemplary embodiment is an embodiment configured by forming a step difference in the top portion 200 of the image forming apparatus 1 in the second exemplary embodiment. Therefore, constituent elements similar to those of the first exemplary embodiment and the second exemplary embodiment are described while being omitted from illustration or assigned the respective same reference characters in FIG. 35 to FIG. 39 as those in the first exemplary embodiment and the second exemplary embodiment.

Figure 35:
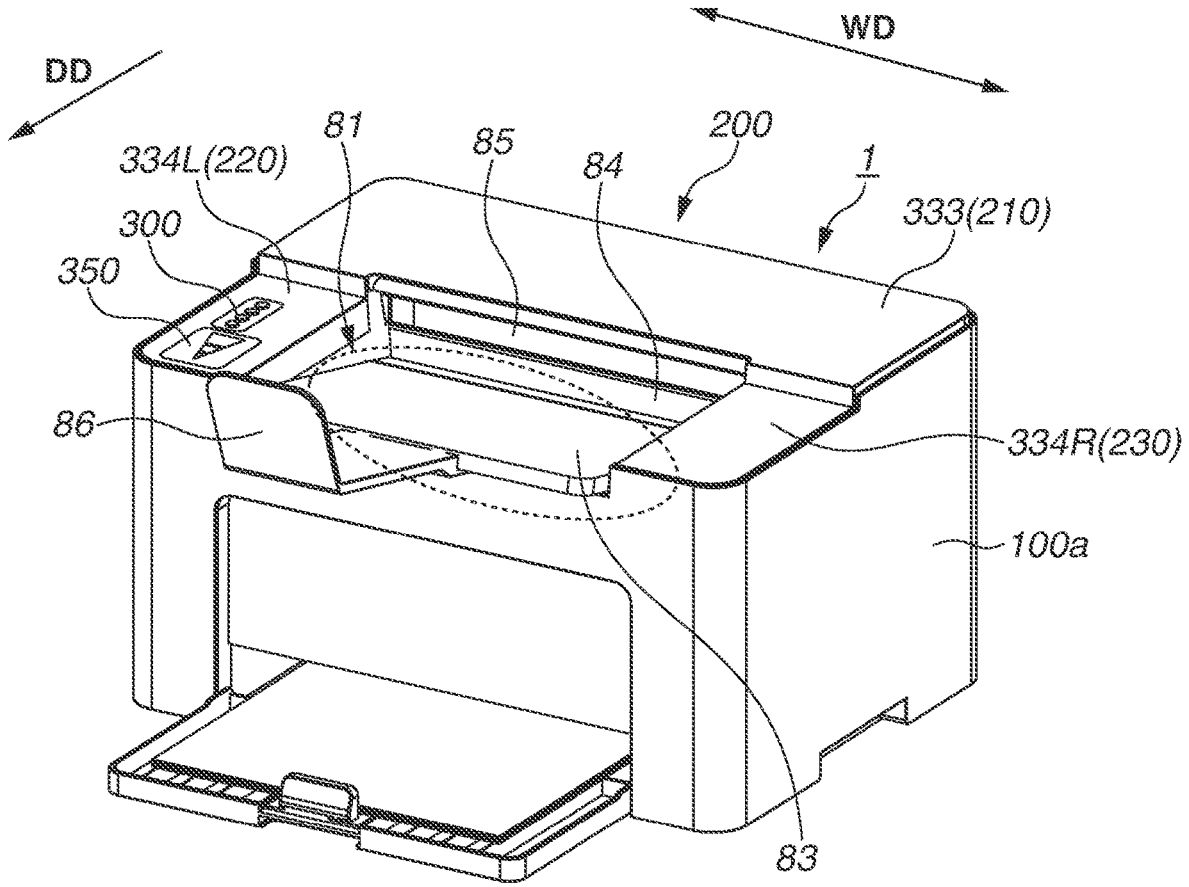
FIG. 35 is a perspective view illustrating an image forming apparatus according to a seventh exemplary embodiment.
Figure 36:
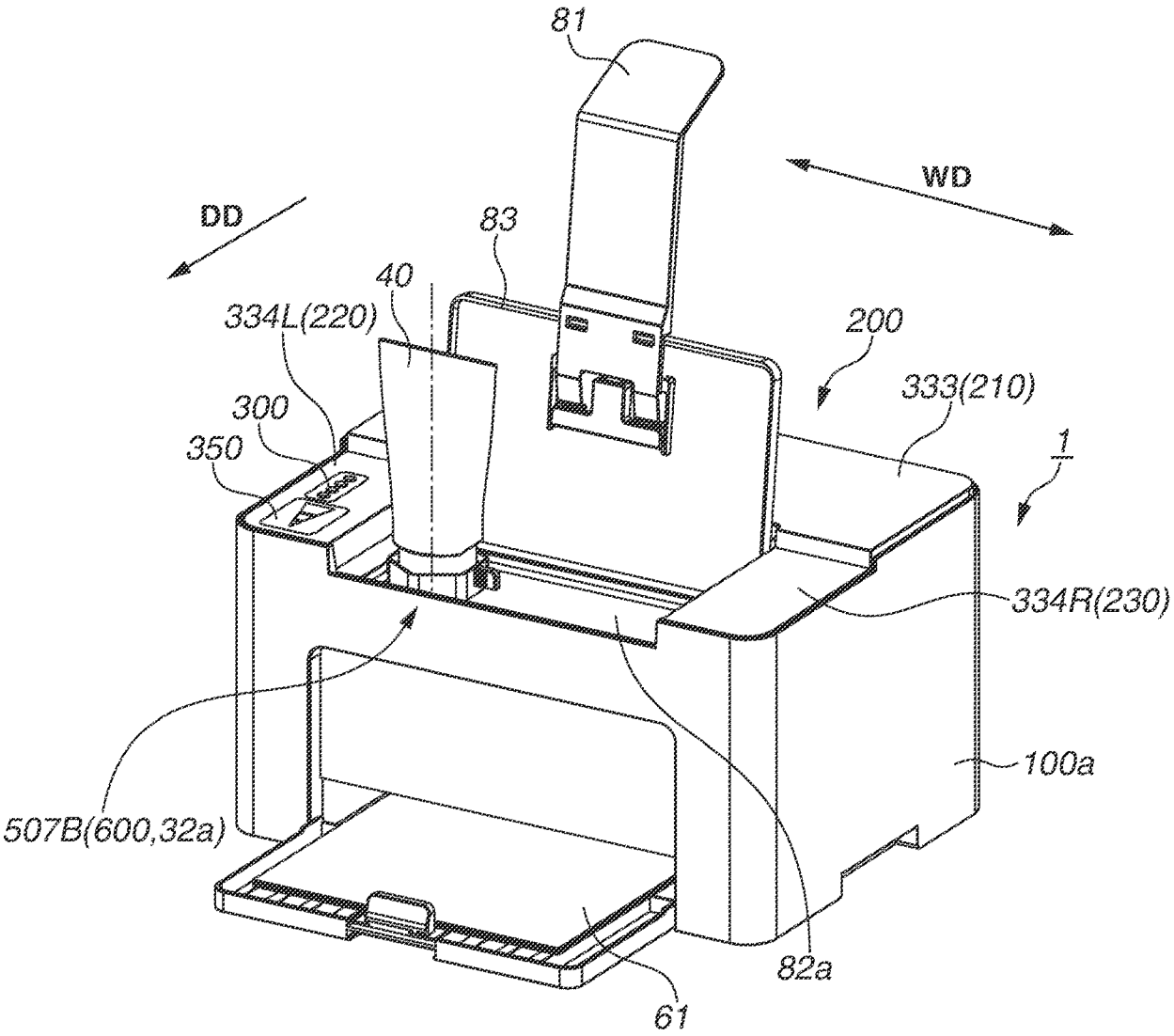
FIG. 36 is a perspective view illustrating a state in which an opening and closing member of the image forming apparatus according to the seventh exemplary embodiment has been opened and a toner pack has been engaged.
Figure 37:
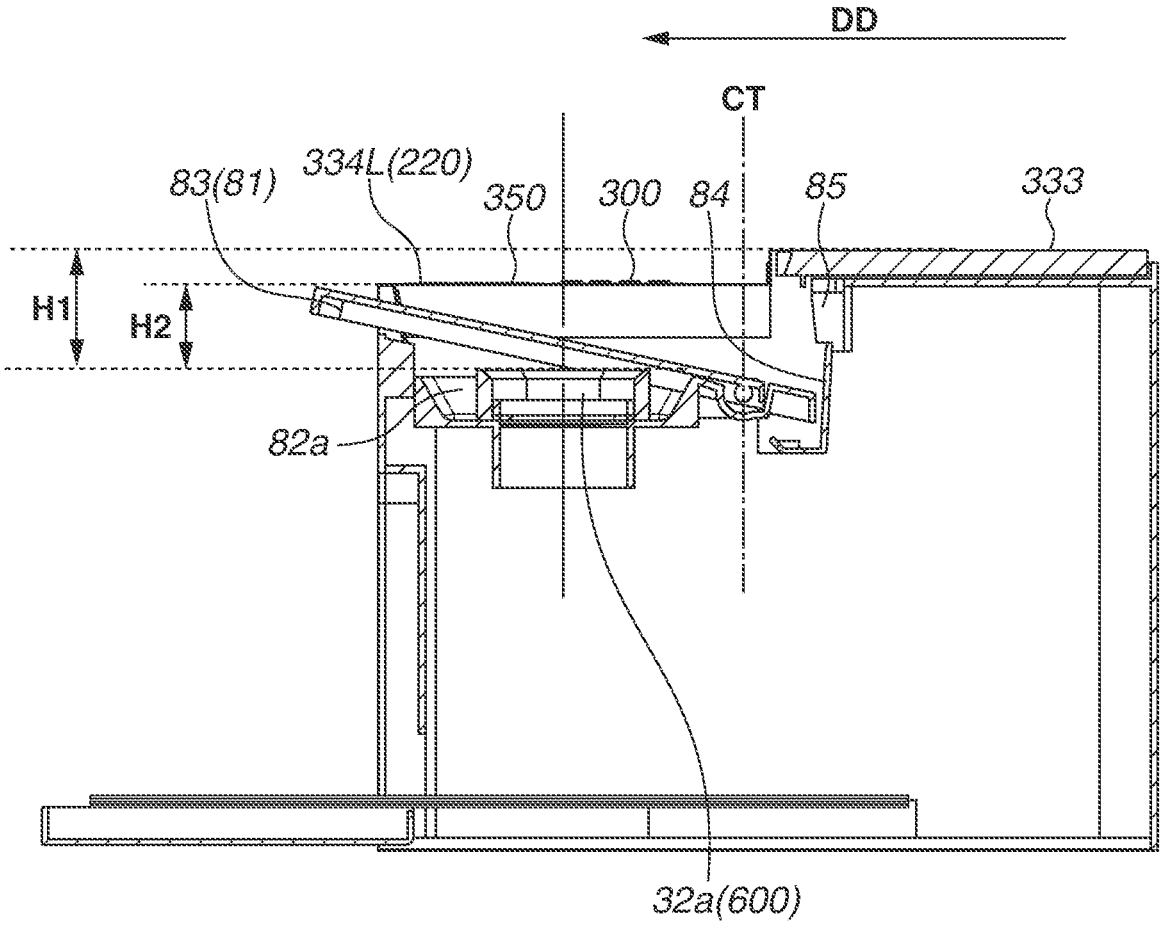
FIG. 37 is a sectional view of the image forming apparatus according to the seventh exemplary embodiment.
Figure 38:
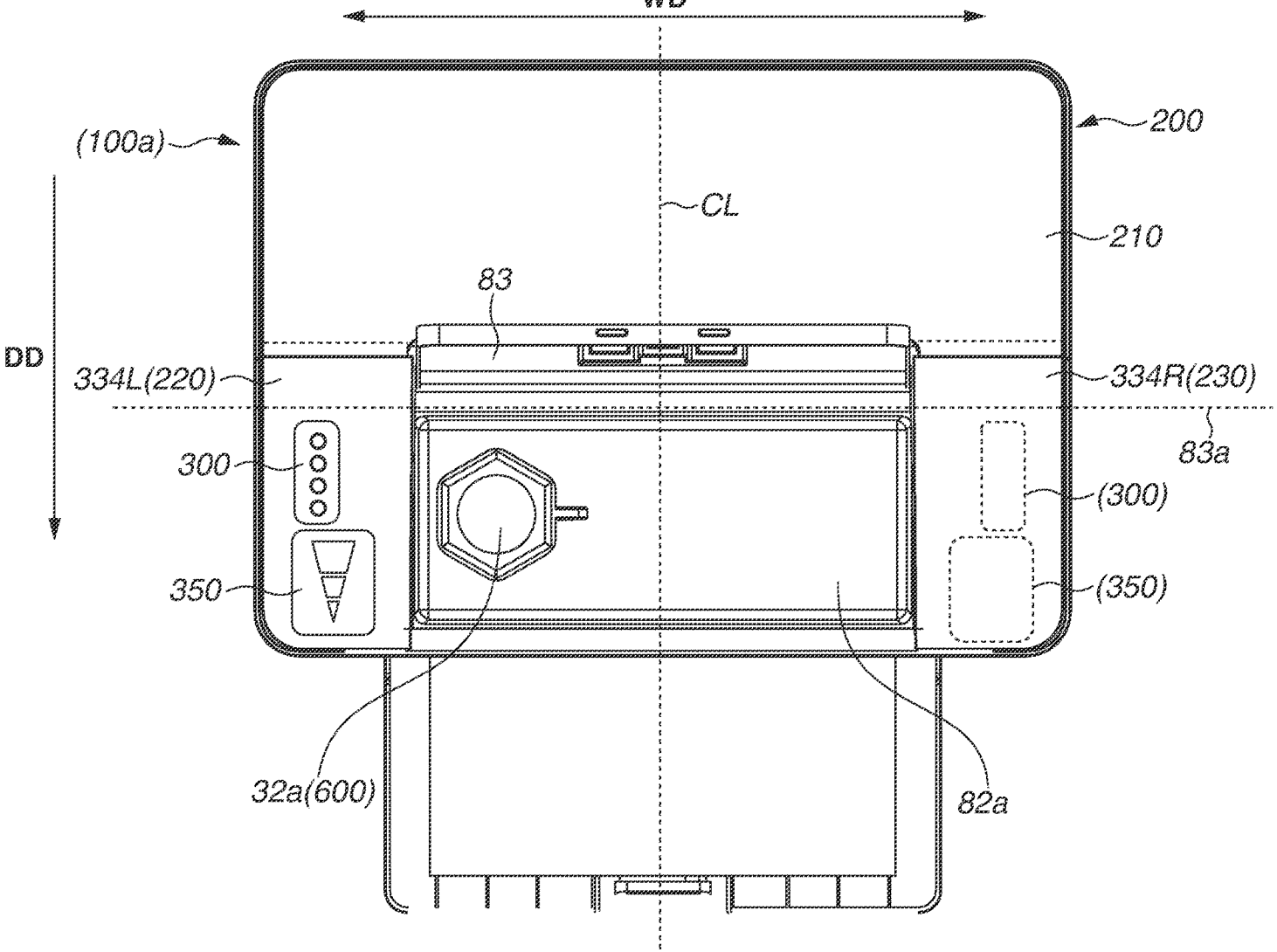
FIG. 38 is a plan view illustrating a state in which an opening and closing member of the image forming apparatus according to the seventh exemplary embodiment has been opened.
Figure 39:
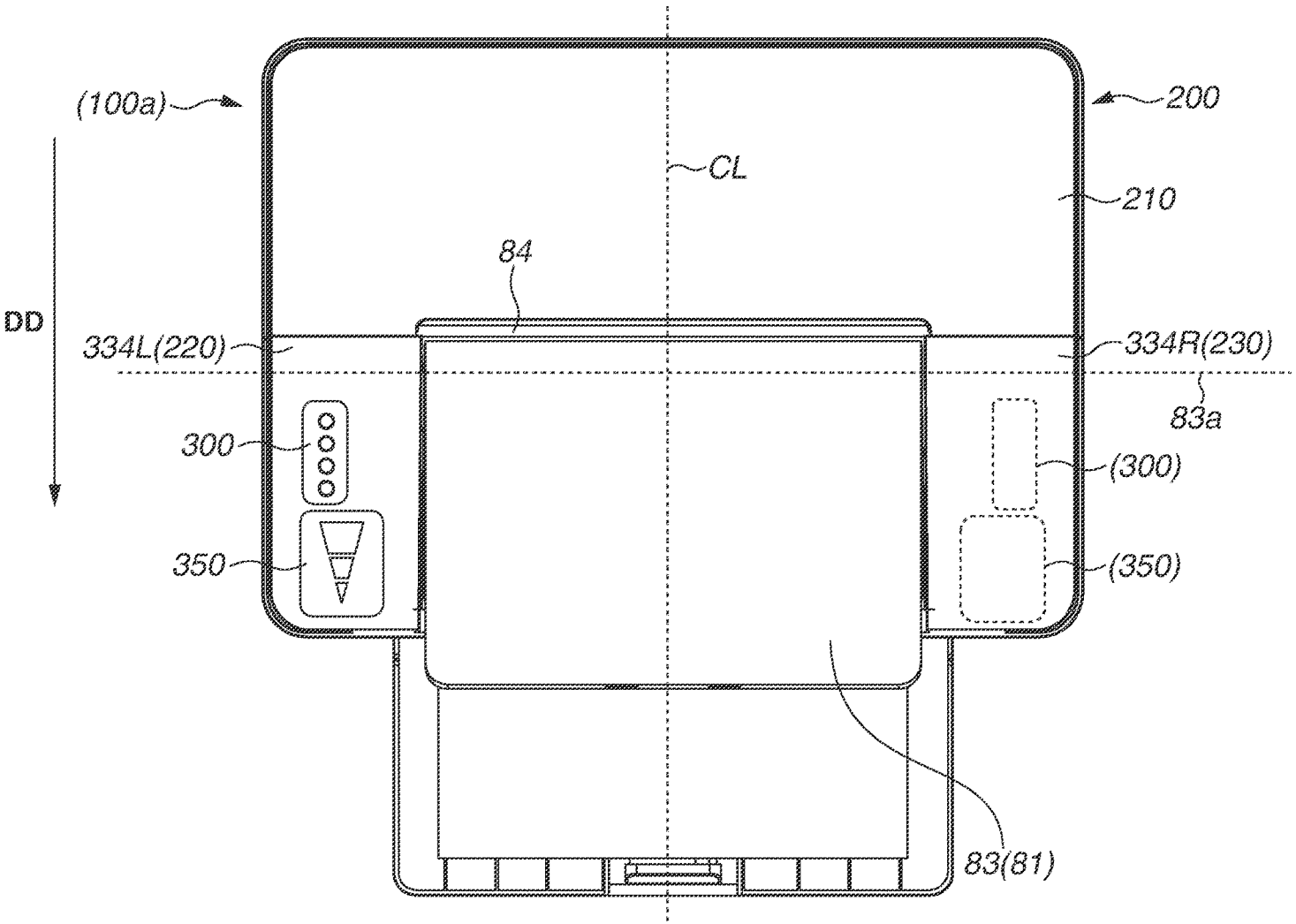
FIG. 39 is a plan view illustrating a state in which the opening and closing member of the image forming apparatus according to the seventh exemplary embodiment has been closed.

FIG. 35 is a perspective view illustrating an image forming apparatus 1 according to the seventh exemplary embodiment. FIG. 36 is a perspective view illustrating a state in which the opening and closing member 83 of the image forming apparatus 1 according to the seventh exemplary embodiment has been opened and the toner pack 40 has been engaged. FIG. 37 is a sectional view illustrating the image forming apparatus 1 according to the seventh exemplary embodiment. FIG. 38 and FIG. 39 are plan views of the image forming apparatus 1 according to the seventh exemplary embodiment, and are views as viewed along the vertical direction as with FIG. 27. FIG. 38 illustrates a state in which the opening and closing member 83 is present in the opened position, and FIG. 39 illustrates a state in which the opening and closing member 83 is present in the closed position.

As with the first to sixth exemplary embodiments, the top portion 200, which is fixed to the housing 100*a*, includes a first region 210, a first extension portion 220, and a second extension portion 230. As illustrated in FIG. 39, as viewed along the vertical direction, in a state in which the opening and closing member 83 is present in the closed position, at least a part of the opening and closing member 83 is arranged between the first extension portion 220 and the second extension portion 230.

As illustrated in FIG. 35 and FIG. 36, the top portion 200 of the printer body 100 of the image forming apparatus 1 includes an upper surface portion 333 and step difference portions 334R and 334L. In the seventh exemplary embodiment, the first region 210 includes the upper surface portion (first surface) 333, the first extension portion 220 includes the step difference portion (second surface) 334L, and the second extension portion 230 includes the step difference portion 334R.

The upper surface portion 333 can be formed in a part of the first region 210, and the upper surface portion 333 can be formed in the entirety of the first region 210. The step difference portion 334L can be formed in a part of the first extension portion 220, and the step difference portion 334L can be formed in the entirety of the first extension portion 220. The step difference portion 334R can be formed in a part of the second extension portion 230, and the step difference portion 334R can be formed in the entirety of the second extension portion 230.

As illustrated in FIG. 37, the step difference portion 334L and the step difference portion 334R are located below the upper surface portion 333 with respect to the vertical direction. The distance H2 in the up-and-down direction (vertical direction) from the upper edge of the supplying port 32*a* to the upper surface of the step difference portion 334L is shorter than the distance H1 in the up-and-down direction from the upper edge of the supplying port 32*a* to the upper surface portion 333.

Moreover, as illustrated in FIG. 38 and FIG. 39, as viewed from the downstream side in the discharging direction DD, the step difference portion 334L is arranged to the left of the upper wall 82*a* and the discharge tray 81, and the step difference portion 334R is arranged to the right of the upper wall 82*a* and the discharge tray 81. Additionally, each of the step difference portions 334L and 334R is longer than the upper wall 82*a* in the discharging direction DD. Even in the seventh exemplary embodiment, in the width direction WD, the supplying port 32*a* of the toner receiving portion 600, the operation portion 300, the display portion 350, and the first extension portion 220 are arranged on one end side with respect to the central portion CL of the discharge tray 81 (the same as the central portion of the opening and closing member 83). Thus, in the width direction WD, the operation portion 300, the display portion 350, and the first extension portion 220 are present on the same side as the supplying port 32*a* with respect to the central portion CL of the discharge tray 81.

At least any one of the display portion 350 and the operation portion 300 is arranged at the step difference portion 334L. In the seventh exemplary embodiment, both the display portion 350 and the operation portion 300 are arranged at the step difference portion 334L.

To engage the toner pack 40 with the printer body 100 and then operate the toner pack 40, it is favorable that the user can easily access the toner pack 40. Accordingly, it is favorable that the height of a portion surrounding the supplying port 32*a* is low. On the other hand, the quantity of recording materials P which are able to be stacked on the discharge tray 81 depends on a distance between the upstream end of the discharge tray 81 in the discharging direction DD and the discharge port 85. Additionally, at least a part of the top portion 200 is required to be located higher than the discharge port 85. Accordingly, if the entire top portion 200 is arranged low and a distance between the supplying port 32*a* and the top portion 200 is shortened in the vertical direction, the discharge port 85 is also required to be arranged low and, as a result, the quantity of recording materials P which are able to be stacked on the discharge tray 81 decreases.

In the seventh exemplary embodiment, since the step difference portion 334L is arranged lower than the upper surface portion 333 located higher than the discharge port 85, without the discharge port 85 being arranged low, it is possible to make the toner pack 40 easily accessible.

An eighth exemplary embodiment of the present disclosure is described with reference to FIG. 40. The eighth exemplary embodiment is an embodiment configured by combining the fifth exemplary embodiment and the seventh exemplary embodiment. Therefore, constituent elements similar to those of the fifth exemplary embodiment and the seventh exemplary embodiment are described while being omitted from illustration or assigned the respective same reference characters in FIG. 40 as those in the fifth exemplary embodiment and the seventh exemplary embodiment.

Figure 40:
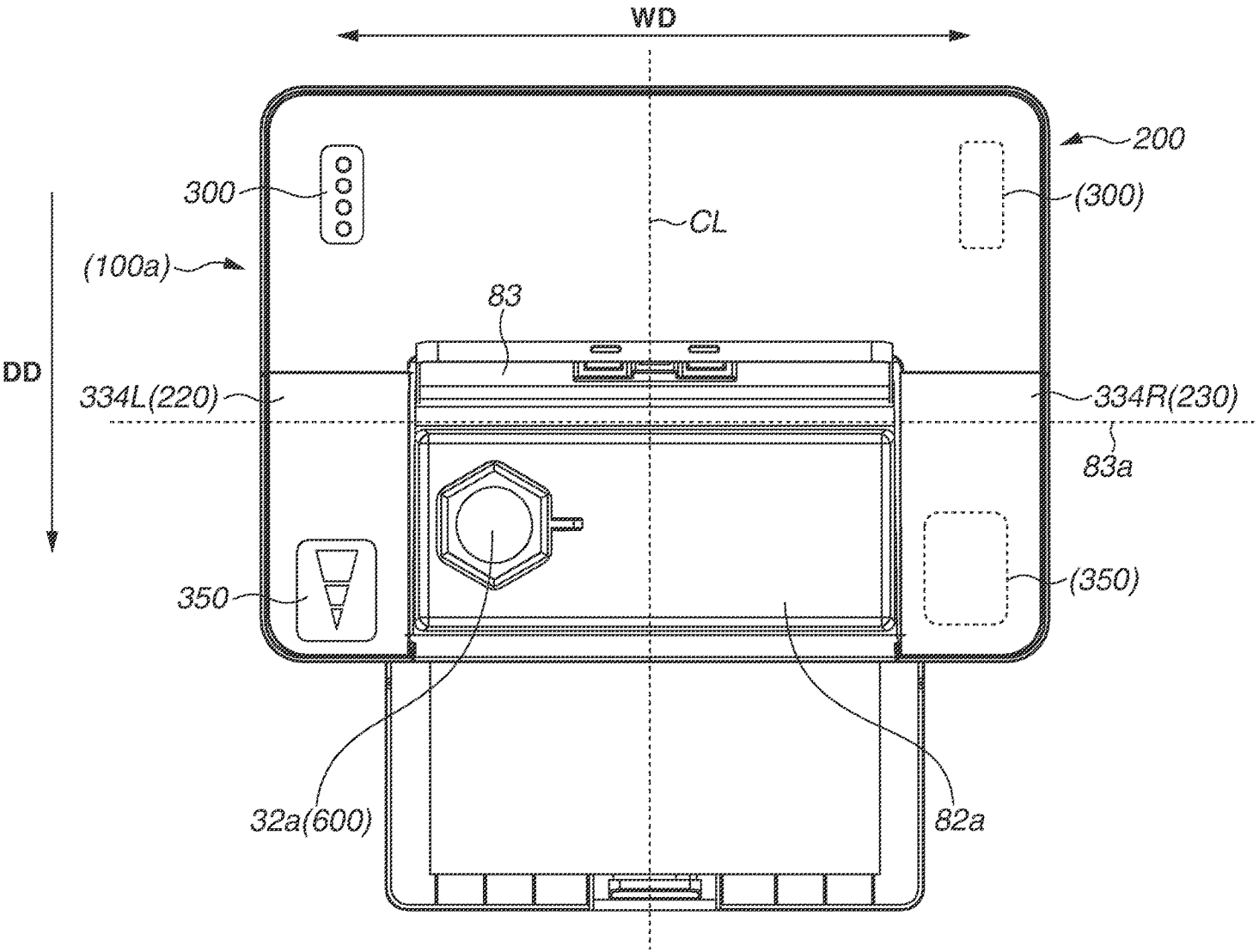
FIG. 40 is a plan view illustrating a state in which an opening and closing member of an image forming apparatus according to an eighth exemplary embodiment has been opened.

As illustrated in FIG. 40, in the eighth exemplary embodiment, the display portion 350 is arranged at the step difference portion 334L and the operation portion 300 is arranged at the upper surface portion 333. The display portion 350 and the operation portion 300 are arranged in a manner similar to that of the fifth exemplary embodiment, and the step difference portions 334R and 334L are arranged in a manner similar to that of the seventh exemplary embodiment.

MODIFICATION EXAMPLES

Figure 41A:
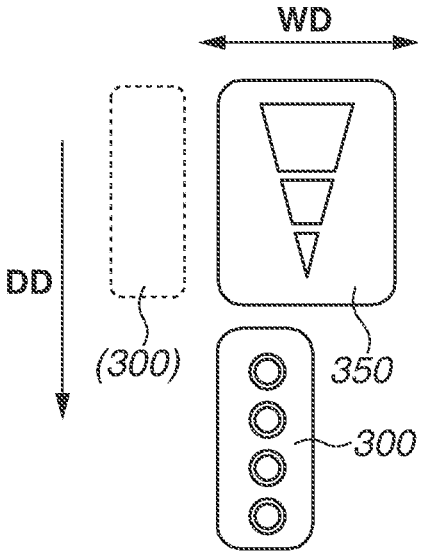
FIGS. 41A, 41B, 41C, and 41D are diagrams used to explain the arrangement of a display portion and an operation portion according to respective modification examples.
Figure 41B:
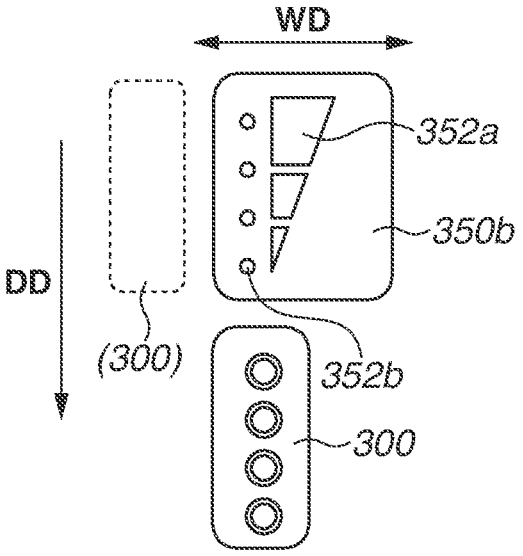
Figure 41C:
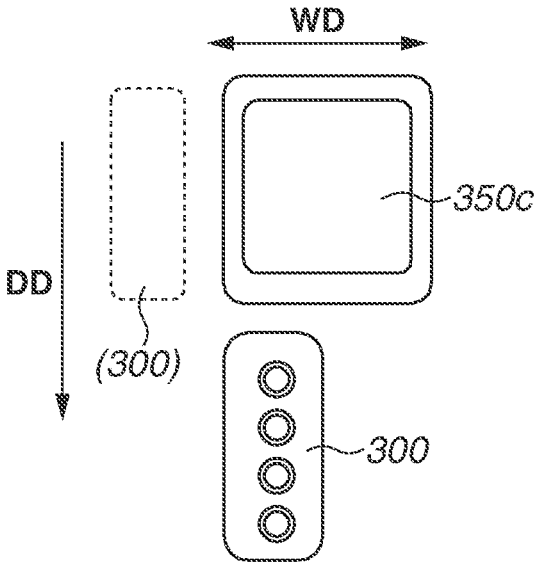
Figure 41D:
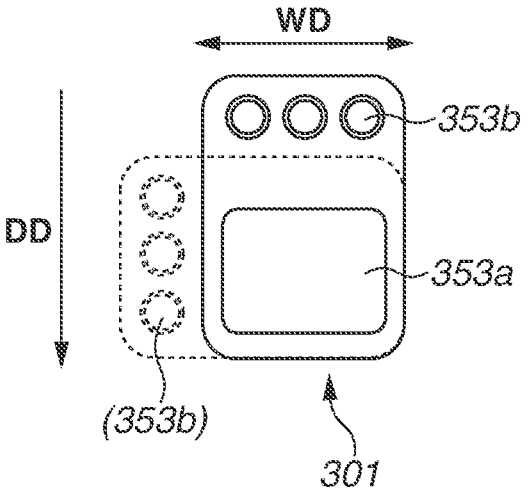

Configurations according to modification examples are described with reference to FIGS. 41A, 41B, 41C, and 41D. FIG. 41A is a diagram used to explain the arrangement of the operation portion 300 and the display portion 350 according to a modification example of the first exemplary embodiment. FIG. 41B is a diagram used to explain the arrangement of the operation portion 300 and the display portion 350*b* according to a modification example of the third exemplary embodiment. FIG. 41C is a diagram used to explain the arrangement of the operation portion 300 and the display portion 350*c* according to a modification example of the fourth exemplary embodiment. FIG. 41D is a diagram used to explain the arrangement of the display portion 353*a* and the operation portion 353*b* according to a modification example of the sixth exemplary embodiment.

As illustrated in FIG. 41A, in the discharging direction DD, the operation portion 300 can be arranged on the downstream side of the display portion 350. Moreover, as indicated by a dashed line, in the width direction WD, the display portion 350 and the operation portion 300 can be arranged side by side.

As illustrated in FIG. 41B, in the discharging direction DD, the operation portion 300 can be arranged on the downstream side of the display portion 350*b* including the icon portion 352*a* and the light guide portion 352*b*. Moreover, as indicated by a dashed line, in the width direction WD, the display portion 350*b* and the operation portion 300 can be arranged side by side.

As illustrated in FIG. 41C, in the discharging direction DD, the operation portion 300 can be arranged on the downstream side of the display portion 350*c*. Moreover, as indicated by a dashed line, in the width direction WD, the display portion 350*c* and the operation portion 300 can be arranged side by side.

As illustrated in FIG. 41D, in the discharging direction DD, the operation portion 353*b* of the operation panel unit 301 can be arranged on the downstream side of the display portion 353*a* of the operation panel unit 301. Moreover, as indicated by a dashed line, in the width direction WD, the display portion 353*a* of the operation panel unit 301 and the operation portion 353*b* of the operation panel unit 301 can be arranged side by side.

Some or all of the above-described first to eighth exemplary embodiments and modification examples can be combined as appropriate.

According to aspects of the present disclosure, various forms of image forming apparatuses can be provided.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. An image forming apparatus to which a supply container for supplying a developer is detachably attachable, the image forming apparatus comprising:

a developing container configured to store the developer supplied from the supply container;

an attachment portion to which the supply container is to be attached such that the developer is allowed to be supplied from the supply container to the developing container, the attachment portion including an attachment opening into which the supply container is inserted;

a casing which houses the developing container and includes a discharge portion for discharging a sheet in a discharging direction and a top portion extending in a direction intersecting with a vertical direction, the top portion being located above the attachment portion with respect to the vertical direction and including a first region, a first extension portion, and a second extension portion, in which, as viewed along the vertical direction, the first extension portion extends from the first region in the discharging direction, the second extension portion extends from the first region in the discharging direction;

a discharge tray including a cover for stacking thereon the sheet discharged from the discharge portion, in which the cover is configured to be movable relative to the top portion between a closed position for covering the attachment portion and an opened position for making the attachment portion exposed outside, wherein at least a part of the cover is located between the first extension portion and the second extension portion;

a display portion arranged at the top portion and configured to display information; and a plurality of operation portions arranged at the top portion, wherein, in a width direction perpendicular to the discharging direction and parallel to a horizontal direction, the attachment opening, the plurality of operation portions, and the first extension portion are arranged on one end side with respect to a central portion of the cover, and wherein, in a case where the supply container has been mounted to the attachment portion, the cover is restricted from moving to the closed position.

2. The image forming apparatus according to claim 1, wherein, in the width direction, the display portion is arranged on the one end side with respect to the central portion of the cover.

3. The image forming apparatus according to claim 1, wherein at least one of the display portion and the plurality of operation portions is arranged at the first extension portion.

4. The image forming apparatus according to claim 1, wherein the top portion includes a first surface and a second surface located below the first surface with respect to the vertical direction, and at least one of the display portion and the plurality of operation portions is arranged on the second surface.

5. The image forming apparatus according to claim 1, wherein the cover is rotatable around a rotational axis line extending in a direction intersecting with the discharging direction.

6. The image forming apparatus according to claim 5, wherein, as viewed along the vertical direction, at least one of the display portion and the plurality of operation portions is arranged on a downstream side of the rotational axis line in the discharging direction.

7. The image forming apparatus according to claim 1, wherein the discharge tray includes a stack portion configured to stack the sheet thereon, and the stack portion is located in upstream side of the cover in the discharging direction so as to support the sheet in conjunction with the cover.

8. The image forming apparatus according to claim 1, wherein a width of the cover is equal to a width of the discharge tray in the width direction.

9. The image forming apparatus according to claim 1, wherein the information is information about an amount of the developer stored in the developing container.

10. The image forming apparatus according to claim 1, further comprising:

a controller configured to perform apparatus operations of the image forming apparatus in response to an operation performed on each of the plurality of operation portions.

11. The image forming apparatus according to claim 10, wherein the apparatus operations include an operation related to an image forming operation for the sheet.

12. The image forming apparatus according to claim 10, wherein the apparatus operations include an operation related to at least one of start-up and shut-down of the image forming apparatus.

13. The image forming apparatus according to claim 10, wherein the apparatus operations include an operation related to a communication between the image forming apparatus and an external apparatus.

14. The image forming apparatus according to claim 1, wherein the casing houses a photosensitive drum and a developing device, and the developing device includes the developing container and a developing roller configured to develop a latent image formed on the photosensitive drum.

15. The image forming apparatus according to claim 1, wherein the plurality of operation portions include at least one button.

16. The image forming apparatus according to claim 1, wherein the plurality of operation portions include at least one detection portion configured to detect a contacting operation of a user.

17. The image forming apparatus according to claim 1, wherein the plurality of operation portion include at least one image displayed on a touch panel.

18. The image forming apparatus according to claim 1, wherein the display portion is configured to emit light.

19. The image forming apparatus according to claim 1, wherein the display portion is a liquid crystal display.

* * * * *